US006899337B2

(12) United States Patent
Fisher et al.

(10) Patent No.: US 6,899,337 B2
(45) Date of Patent: May 31, 2005

(54) CRANE AMUSEMENT GAME

(75) Inventors: Leonard C. Fisher, Ashmore Qld (AU); Raymond J. McGowan, Benowa (AU); Shaun P. O'Brien, Parkwood (AU)

(73) Assignee: Win 'n' Grin Amusements Pty Ltd., Ashmore Qld (AU)

( * ) Notice: Subject to any disclaimer, the term of this patent is extended or adjusted under 35 U.S.C. 154(b) by 258 days.

(21) Appl. No.: 10/062,136

(22) Filed: Feb. 1, 2002

(65) Prior Publication Data

US 2003/0151202 A1 Aug. 14, 2003

(51) Int. Cl.[7] ..... A63F 7/36
(52) U.S. Cl. ..... 273/447
(58) Field of Search ..... 273/447–448, 273/453–454, 440, 459, 461; 209/592

(56) References Cited

U.S. PATENT DOCUMENTS 5,321,212 A * 6/1994 Wadell ..... 177/25.18
5,415,417 A * 5/1995 Reis, Jr. ..... 273/447
5,513,853 A * 5/1996 Crompton et al. ..... 273/448
5,527,044 A * 6/1996 Lee et al. ..... 273/448
5,558,340 A * 9/1996 Ibe et al. ..... 273/448
5,711,530 A * 1/1998 Lewis ..... 273/448
5,855,374 A * 1/1999 Shoemaker, Jr. ..... 273/447
6,234,487 B1 * 5/2001 Shoemaker, Jr. ..... 273/447
6,315,665 B1 * 11/2001 Faith ..... 463/23
6,428,008 B1 * 8/2002 Singer ..... 273/447
6,588,760 B2 * 7/2003 Carter et al. ..... 273/448
6,634,940 B2 * 10/2003 Yoshida et al. ..... 463/7

* cited by examiner

*Primary Examiner*—Derris H. Banks
*Assistant Examiner*—Alex F. R. P. Rada, II
(74) *Attorney, Agent, or Firm*—Simpson & Simpson, PLLC

(57) ABSTRACT

An amusement game is provided with means for securing one or more prizes/objects arranged on a platform and a device for determining a characteristic of the prizes/objects. In a preferred embodiment the amusement game of the present invention comprises a crane for securing one or more prizes/objects arranged on a platform, a scale for weighing said one or more prizes/objects; and a means for indicating that the weight of said prizes/objects is less than a predetermined amount. In a preferred embodiment a prize/object gate is provided for dispensing or returning any secured game prizes/objects based on their combined weight and the means for securing the game prizes/objects includes a claw assembly operatively arranged for positioning about a game cabinet by the game player.

26 Claims, 52 Drawing Sheets

270

CRANE AMUSEMENT GAME

FIELD OF THE INVENTION

The present invention relates generally to amusement games, more particularly to crane type amusement games and, even more particularly in one embodiment, to an amusement game in which a player attempts to win prizes by placing one or more prizes/objects on a scale or similar device and wins one or more prizes when the weight of the prizes/objects fall within a predetermined range.

BACKGROUND OF THE INVENTION

Coin-operated crane type amusement games, in which a player pays money for the opportunity to control a crane (comprising a gantry assembly, crane assembly and claw assembly) to win toys, novelty items, trinkets, candy and other items are well known. At one time or another most of us have seen, or even played these games at nickelodeons, traveling carnivals, circuses, arcades, amusement parks, restaurants, movie theaters, game rooms, truck stops, bowling alleys, fairs or retail stores. Trying to win prizes from crane games is both fun and challenging. Unlike other redemption games, where one plays for tickets or prizes pre-selected by an arcade or game owner, crane games allow the player to select the prize to be sought. Crane games, then, provide entertainment to men, women and children alike.

A number of crane games are known in the marketplace, including the Plush Bus™, Sports Bus™, London Bus™, Chocolate Factory™ (the world's first crane/pusher candy bar dispensing game), Pinnacle™, Plush Palace™ (a double gantry/crane), Grab'n Go™, and Carnival™ crane, all of which are manufactured and distributed by Innovative Concepts in Entertainment, Inc. (ICE), of Clarence, N.Y.

Various improvements have been made in crane games over the years. Cabinets are now made of metal, with epoxy-powder coatings (e.g., Plush Bus™) for protection and longer life. Some games (e.g., Pinnacle™) offer cabinets with beautiful wood finishes. Improvements have been made in the claw structure and operation, and in gantry and claw positioning and control systems. Electronic sensors and switching mechanisms have replaced mechanical sensors. Perhaps the most exciting development in recent years was the combination of a crane and pusher game in the popular Chocolate Factory™ game. In this game, the first of its kind to dispense candy bars as prizes, a player operates a crane to pick up one or more candy bars, and then carefully places the bars on a platform. A "pusher" then pushes the candy bars along the platform, which fall off the end of the platform (hopefully) as prizes.

Another recent improvement in crane amusement games is a cylindrical crane game manufactured by ICE, which game is the subject of U.S. Design patent application Ser. No. 29/153,090, filed Nov. 9, 2001, for an invention entitled, "Cylindrical Crane Game", which application is incorporated herein by reference, and U.S. patent application Ser. No. 10/037,324, filed Nov. 9, 2001, for an invention entitled, "Cylindrical Crane Game". The game disclosed in these applications comprises a unique cylindrical (polar) coordinate system, and corresponding translational movement of the crane gantry, as well as a cylindrically shaped game housing.

Despite the number and variety of crane type amusement games which have been known in the marketplace over the years, to date no one has apparently invented or manufactured a crane game that enables a player to grab prizes in one or more attempts and place the prizes on a scale, winning the selected prizes if their combined weight is below a preset limit, but losing the selected prizes if a player is "too greedy" and attempts to win prizes that exceed the preset weight limit. Thus, a longfelt need has existed for a crane game where a player attempts to win one or more prizes that she places on a scale, but loses the sought after prizes if she fails to redeem them before exceeding a preset prize weight limit.

BRIEF SUMMARY OF THE INVENTION

The present invention broadly comprises an amusement game having a crane assembly operatively arranged for securing game prizes/objects arranged on a game platform, a scale for weighing game prizes/objects, and a means for dispensing game prizes to a player or returning game prizes/objects to the game platform based on the combined weight of the game prizes/objects.

A general object of the present invention is to provide an amusement game having a crane assembly for securing prizes/objects arranged on a platform.

Another object of the present invention is to provide an amusement game having a means for determining characteristics of prizes/objects moved to a platform.

A further object of the present invention is to provide an amusement game that awards prizes when the determined characteristics of prizes/objects moved a platform satisfy predetermined criteria.

Still another object of the present invention is to provide an amusement game that awards prizes when a player successfully transports one or more prizes/objects from a game platform of the game to a scale assembly, and the weight of the one or more prizes/objects is within a predetermined range.

These and other objects, features and advantages of the present invention will become apparent upon reading the following detailed description of the invention in view of the several drawing figures and appended claims.

BRIEF DESCRIPTION OF THE DRAWINGS

The invention will now be described in detail with reference to the appended drawings in which.

DETAILED DESCRIPTION OF THE INVENTION

In the detailed description that follows, identical reference numbers on different drawing views are intended to represent identical structural elements of the invention. The term "front" refers to the side of the game where the player controls are located, and the "rear" refers to the side of the game directly opposite the player controls (where the scale assembly is generally located). The terms "frontward" and "rearward" when used to describe movement of the gantry assembly, the crane assembly, the claw assembly and joystick, refer to movement toward the "front" and "rear" of the game, respectively.

The term "lateral" when used to describe movement of the crane and claw assemblies, or the prize gate, refers to movement to the "left" or to the "right" in relation to a player facing the player controls. The terms "up" and "down" refer to movement of the claw assembly direction toward and away from the crane assembly, respectively.

Figure 1:
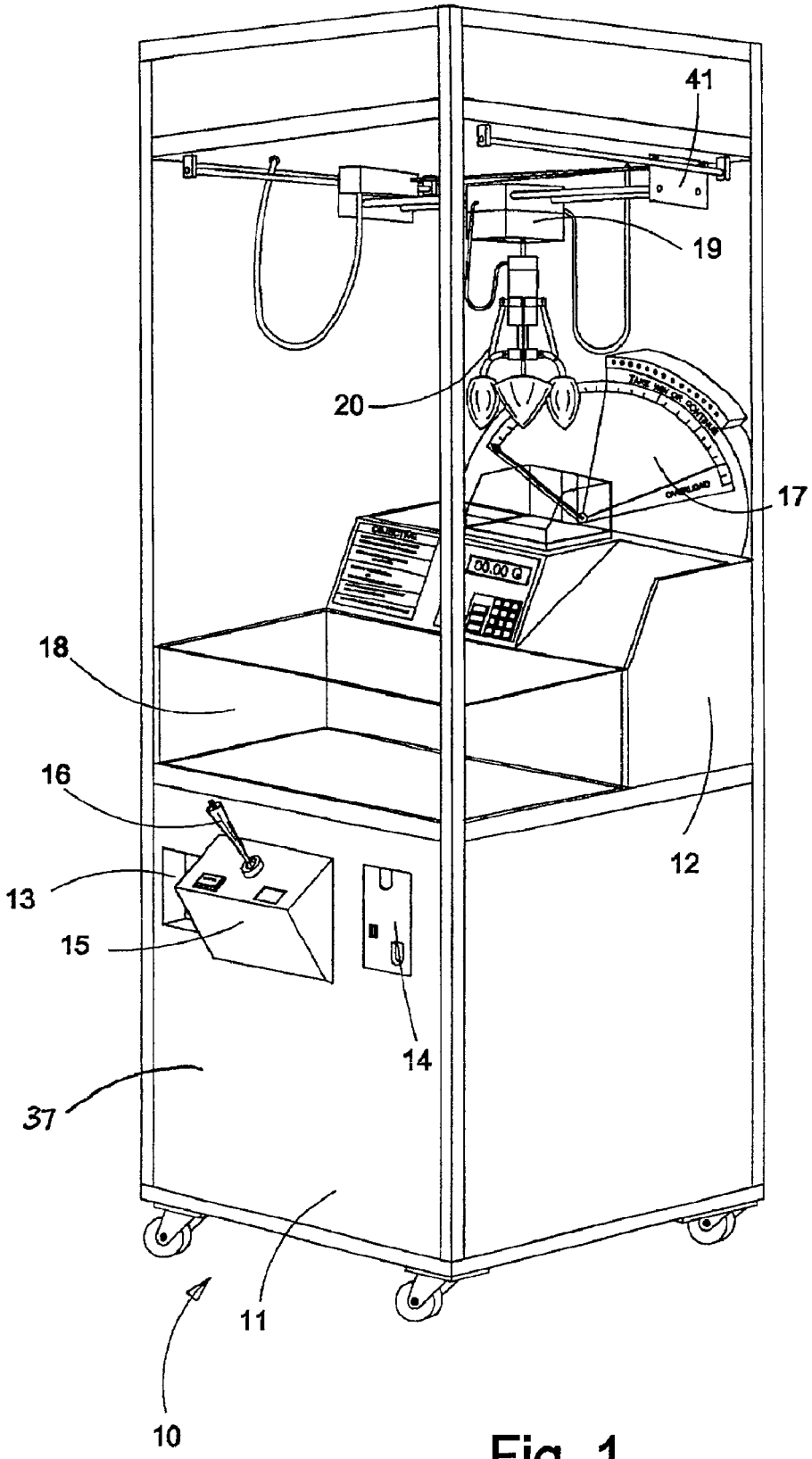
FIG. 1 is a perspective view of the amusement game of the invention.
Figure 8:
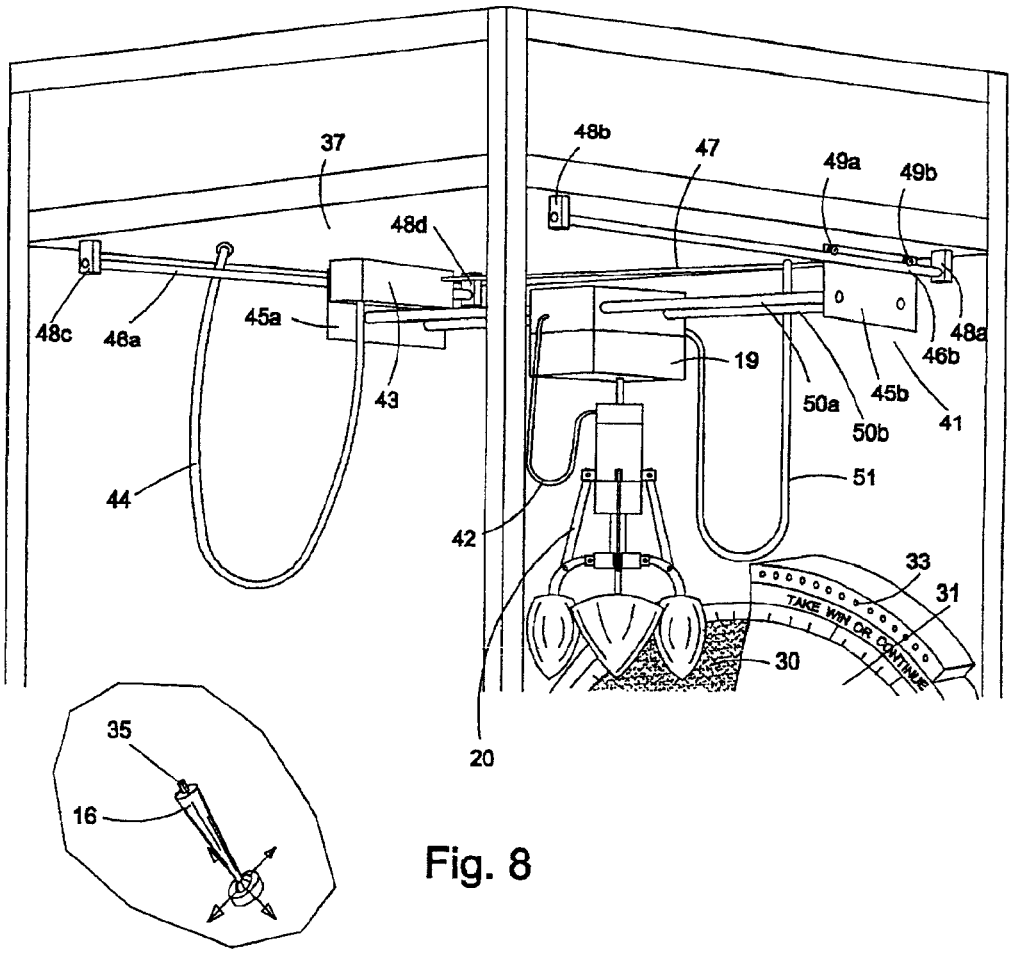
FIG. 8 is a fragmentary perspective view of the amusement game, showing the upper portion of the crane game comprising the gantry assembly, the crane assembly, and the claw assembly of the present invention.

For purposes of illustration, the "Home" position of the gantry assembly, crane and claw assemblies, refers to the position of the gantry assembly, crane and claw assemblies before and after insertion of a coin or game credit. The "Home" position is generally shown in FIGS. 1 and 8 and refers to the "rearward" position of the gantry assembly, the laterally centered position of the crane assembly over the prize/object gate and scale assembly, and the claw assembly in the raised position.

It should be appreciated that the term "scale assembly" can be used to refer to the components generally comprising the scale, which include but are not limited to: the scale, the scale plate, the load cell, the prize/object gate, the needle indicator and any electronic or mechanical components associated therewith.

Figure 4:
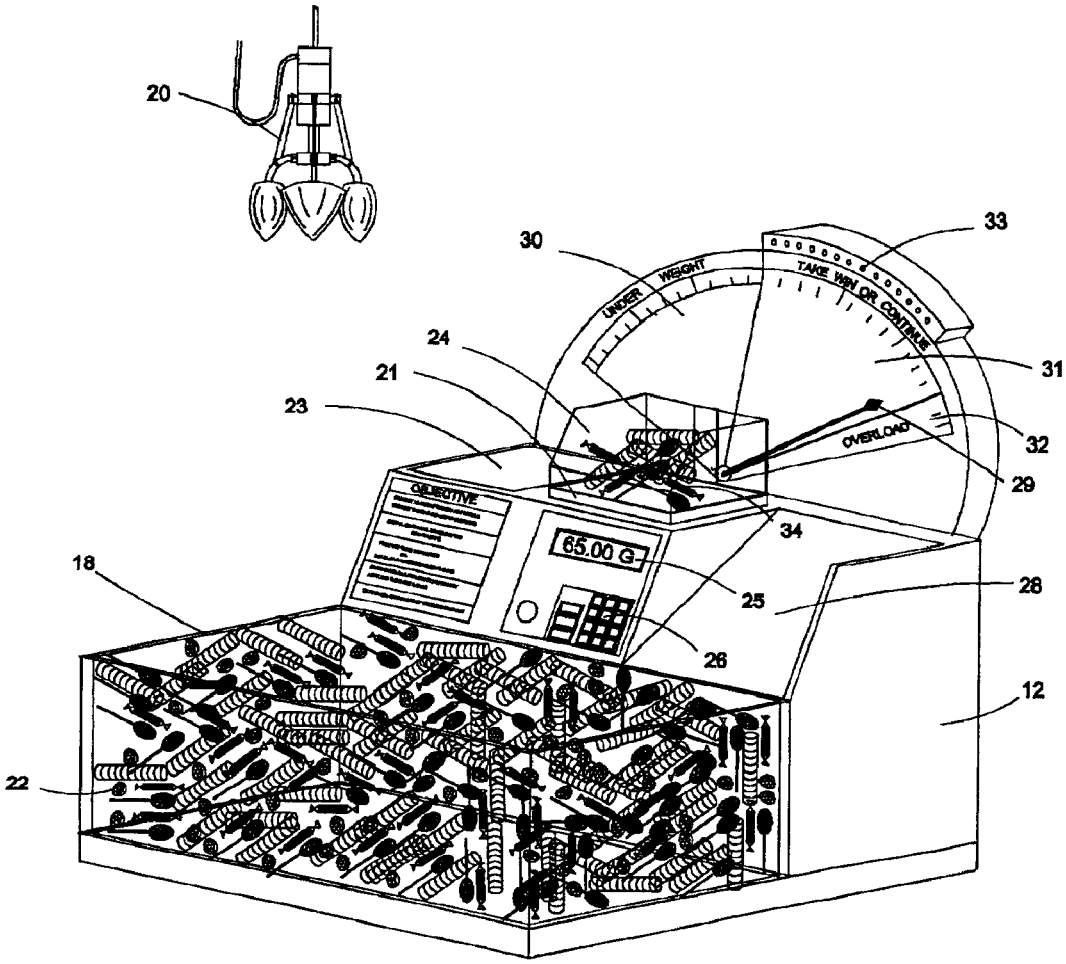
FIG. 4 is a perspective view of the game platform and scale assembly showing game prizes/objects placed in the prize/object gate.
Figure 5:
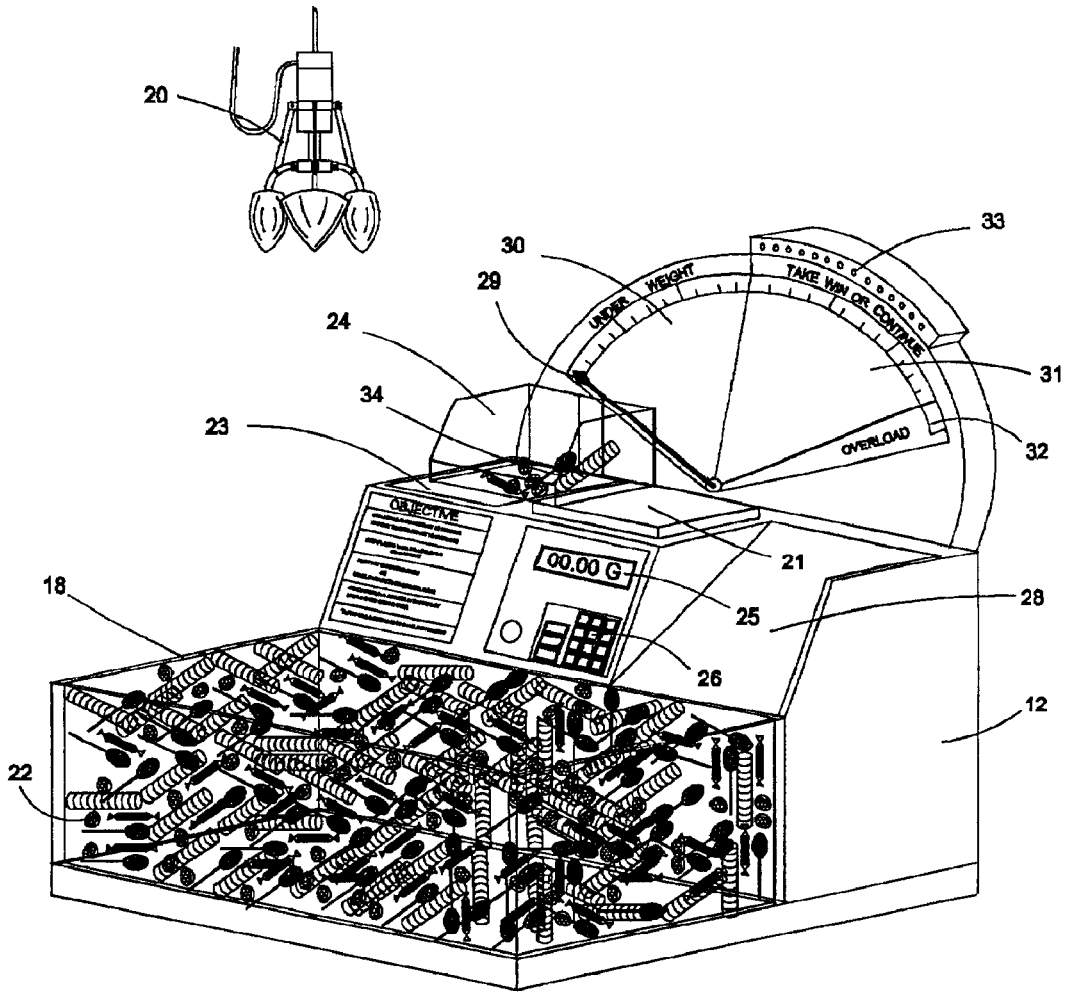
FIG. 5 is a perspective view of the game platform and scale assembly showing leftward movement of the prize/object gate for awarding game prizes/objects.
Figure 6:
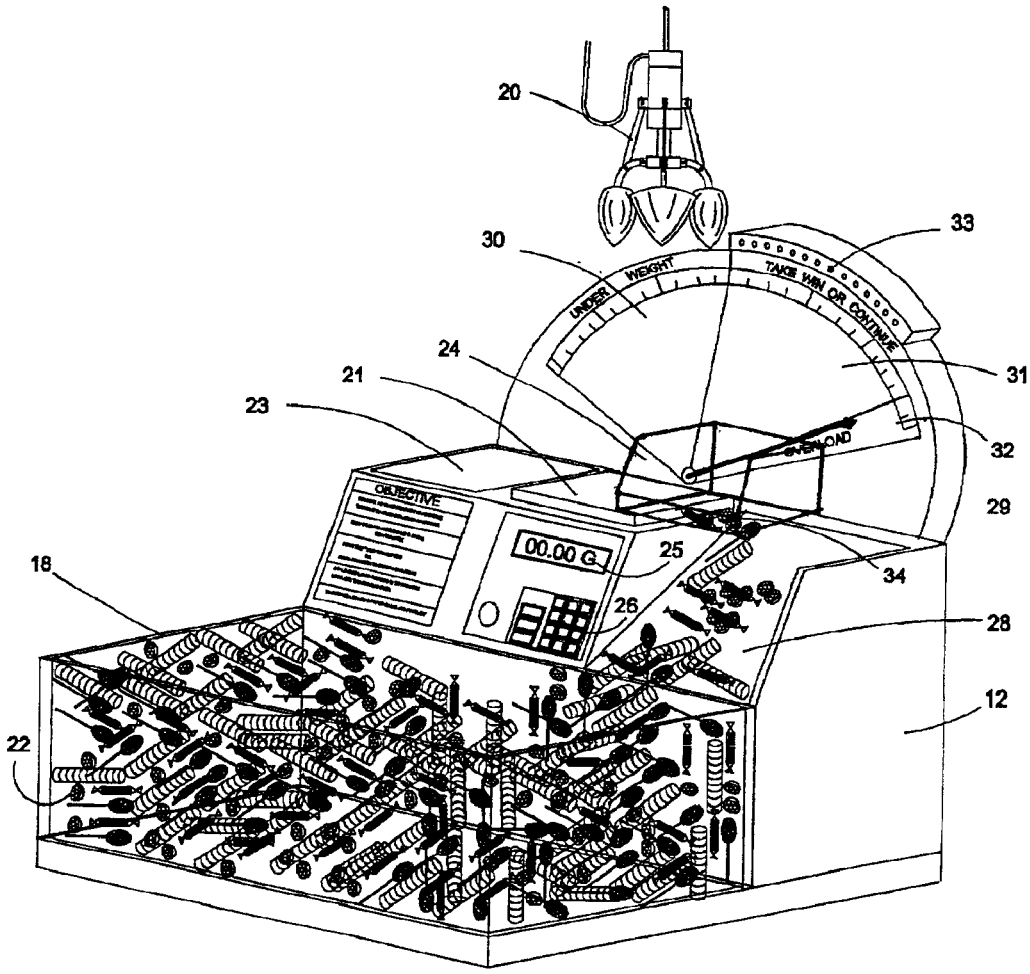
FIG. 6 is a perspective view of the and scale showing rightward movement of the prize/object gate for returning game prizes/objects to the game platform.

The amusement game of the present invention generally comprises a game cabinet enclosing a gantry assembly, a crane assembly, a claw assembly, a scale assembly, and game prizes/objects arranged on a game platform. Using the player controls, the primary object of the game is to maneuver the gantry assembly and the crane assembly such that the claw assembly is positioned over game prizes/objects, lower the claw assembly to secure an amount of prizes/objects, raise the claw assembly, and then release the prizes/objects onto the scale assembly for weighing. The game prizes/objects are then weighed by the scale assembly, which is calibrated to determine whether the weight of game prizes/objects falls within a predetermined range. As shown in FIG. 6, if the game prizes/objects weigh more than a maximum setting, the player loses the game and the game prizes/objects are returned to the platform. However, if the weight of the prizes/objects falls within a predetermined range, as shown in FIG. 4, the player has the choice of either continuing play (and adding more prizes/objects to the scale assembly) or ending play to collect the prizes/objects placed on the scale plate, as shown in FIG. 5. If the weight of the prizes/objects is less than the minimum setting, play continues and the player may add more prizes/objects to the scale assembly.

It should be appreciated by those having ordinary skill in the art that although the amusement game of the present invention comprises a gantry, crane, and claw means operatively arranged for movement within a polygonally shaped cabinet, other cabinet shapes (cylindrical, arcuate) and means for moving the gantry assembly, the crane assembly, and the claw assemblies are contemplated by the present invention, which shapes and means do not depart from the spirit and scope of the present invention.

It should also be appreciated by those having ordinary skill in the art that although the amusement game of the present invention comprises a "claw assembly" as having "scoops" for grasping game prizes/objects, the term "claw assembly" is meant to include any type of assembly that can be used to grasp game prizes/objects, which include but are not limited to: hooks, magnetic assemblies, vacuum assemblies, hook and loop fastener assemblies, and other types of gripping, grabbing, or adhesive mechanisms.

It should be further appreciated by those having ordinary skill in the art that although the amusement game of the present invention comprises gantry and crane assemblies having wheels, worms, pulleys and gears operatively arranged for movement upon parallel rails, other means (which means include but are not limited to: monorail means, belt means, chain means or magnetic means) for moving the gantry and crane assemblies are contemplated by the present invention, which means do not depart from the spirit and scope of the present invention.

It should also be appreciated that the term "crane" as used herein can be used to describe both a "crane", which generally comprises a gantry assembly, a crane assembly, and a claw assembly, as well as a "crane", which comprises crane assembly 19 as described infra.

It should also be appreciated that the game of the invention can be configured to permit a single operation of the claw, i.e., permit a single opportunity to select a prize/object with the hope that the selected prize/object(s) will fall within the predetermined target weight, or may permit multiple operations of the claw whereby prizes may be accumulated.

It should also be appreciated that while the scale assembly of the preferred embodiment comprises a analog readout (needle indicator), the present invention could be easily configured to comprise a scale assembly having a digital readout.

Finally, while a preferred embodiment comprises an amusement game wherein a player places one or more prizes/objects on a scale for weighing to try to win those prizes/objects, it should be appreciated that the amusement game of the present invention can be configured to award prizes other than the prizes/objects placed on the scale, for example, redemption tickets, game credits or other prizes can be awarded regardless of whether a player is successful or unsuccessful. In addition, although in a preferred embodiment the amusement game is configured to measure the weight of prizes/objects placed on a scale, it should be appreciated that the present invention can be configured to measure and determine other characteristics of the prizes/objects, such as size, shape, color, electrical, magnetic, and/or other visual properties, which configurations do not depart from the spirit and scope of the invention.

Structure of Apparatus of the Invention

The general structural elements of the present invention, which enable one having ordinary skill in the art to make the invention, will now be described in detail.

General

Figure 2:
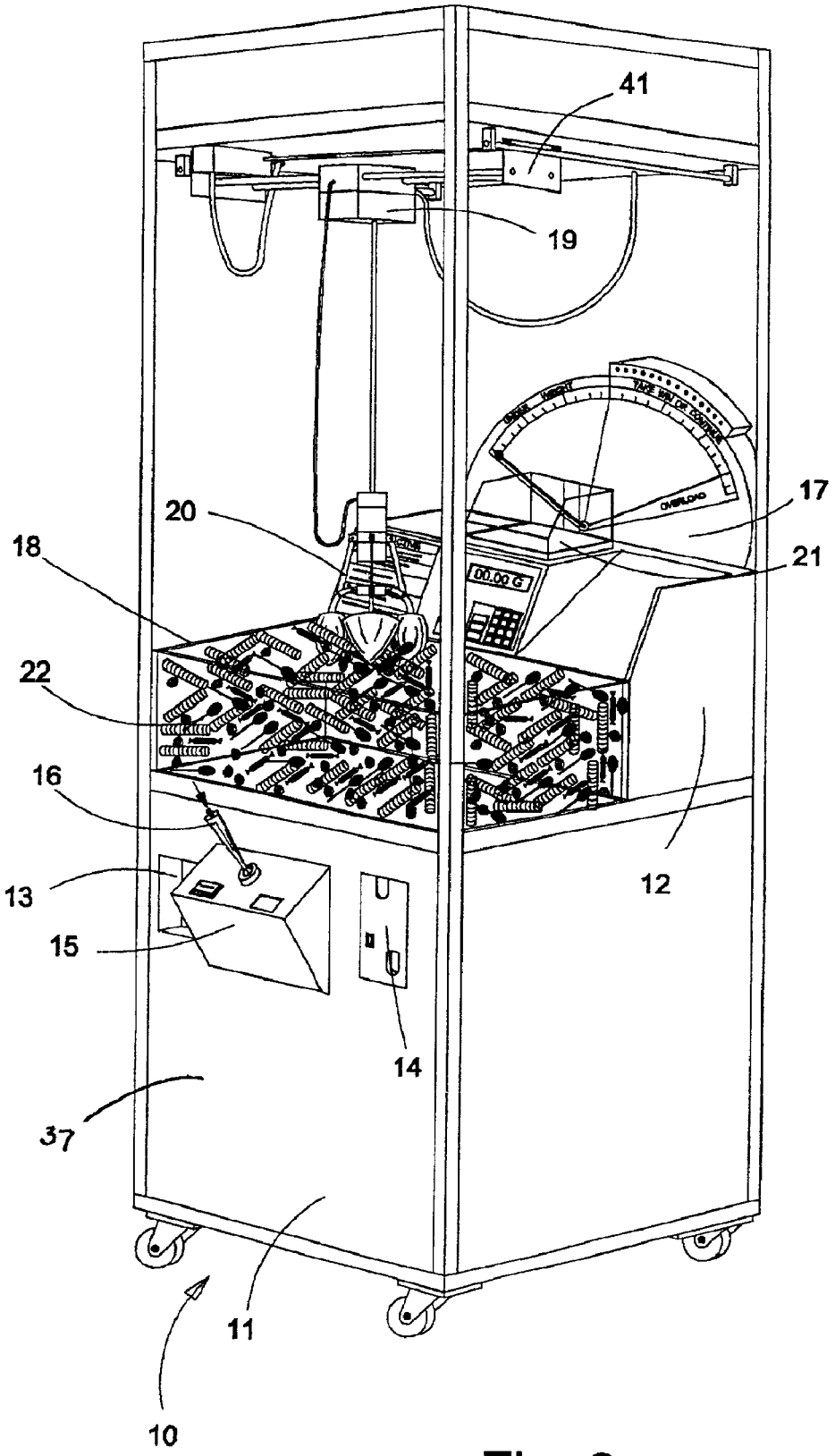
FIG. 2 is a perspective view of the amusement game filled with game prizes/objects and the claw assembly in a lowered position.

General structures of the combination amusement game are best understood by reference to FIGS. 1–2, which are perspective views of amusement game 10. Adverting now to FIGS. 1–3, in a preferred embodiment, amusement game 10 generally comprises cabinet 11, prize/object ejection door 13, coin mechanism holder 14 (including a dollar bill validator) and player control panel 15. Cabinet 11 generally encloses scale assembly 12, needle indicator assembly 17, game platform 18, crane assembly 19, claw assembly 20, scale plate 21, and game prizes/objects 22. Cabinet 11 comprises front panel 37. Adverting now to FIG. 7, control panel 15, coin mechanism holder 14 and prize/object ejection door 13 are mounted to front panel 37. Control panel 15 includes joystick 16, "take win" button 36, and player displays 38. Joystick 16 further comprises down button 35, which is used to lower the claw assembly. Coin mechanism holder 14 generally comprises coin slot 39, for inserting coins, coin return 40, and dollar bill validator (not shown), for accepting paper money.

The Gantry Assembly

Adverting to FIG. 8, gantry assembly 41 and crane assembly 19 are operatively arranged to move and position claw assembly 20 for securing game prizes/objects on game platform 18. Gantry assembly 41 generally comprises endplates 45*a* and 45*b* for securing parallel rails 50*a* and 50*b*. The gantry assembly further comprises "frontward" and "rearward" (F/R) motor assembly 43, which is operatively arranged for attachment to endplate 45*a* and drive shaft 47 for providing front and rear movement to gantry assembly 41. Gantry assembly 41 also comprises F/R wheels 49*a*, 49*b*, 49*c* (not shown) and 49*d* (not shown). Power and communications are provided to F/R motor assembly 43 by means of F/R power and communications cable 44. Similarly, power and communications are provided to crane assembly 19 by means of crane power and communications cable 51. The gantry assembly moves "frontward" and "rearward" about cabinet 11 along parallel rails 46*a* and 46*b* by means of F/R wheels 49*a*, 49*b*, 49*c* (not shown) and 49*d* (not shown). Parallel rails 46*a* and 46*b* are operatively arranged for supporting the gantry assembly and are secured to cabinet top 37 by means of supports/stops 48*a*, 48*b*, 48*c*, and 48*d*. Crane 19 is operatively arranged on rails 50*a* and 50*b* of gantry assembly 41 for lateral movement within cabinet 11.

Figure 15:
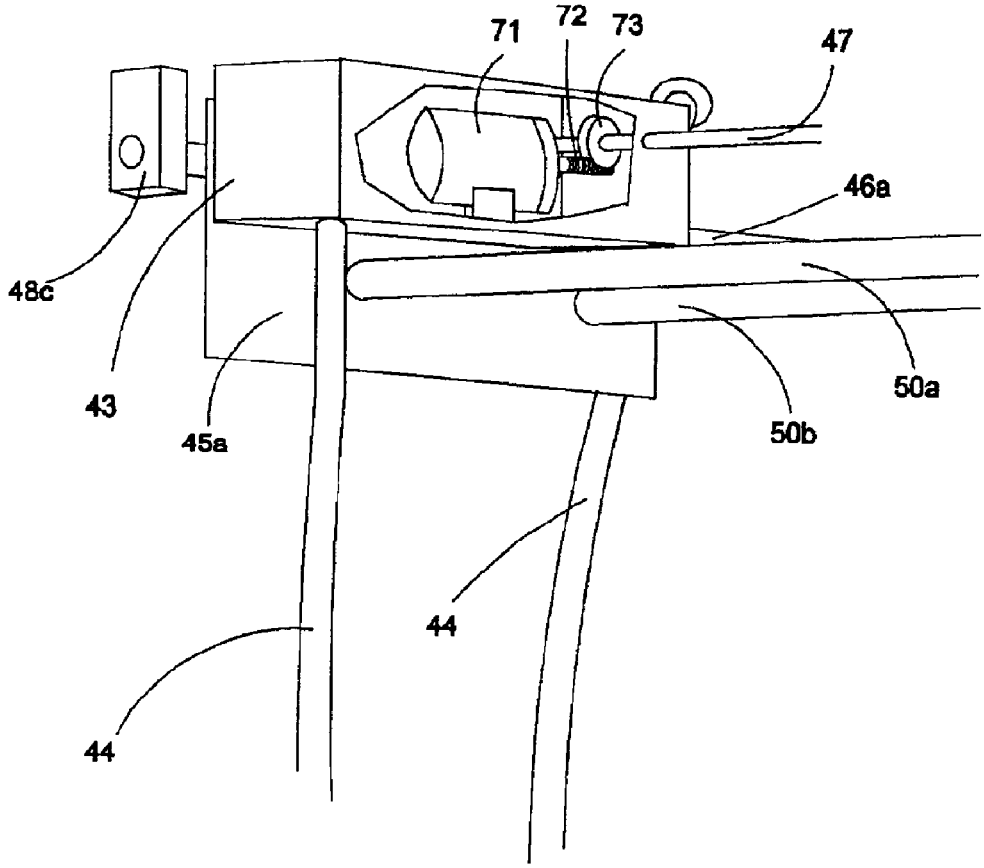
FIG. 15 is a fragmentary perspective view of the gantry assembly.

As shown in FIG. 15, which is a detailed fragmentary view of F/R motor assembly 43 secured to endplate 45*a*, F/R motor assembly additionally comprises electric F/R motor 71 for turning F/R worm gear drive 72. Turning of F/R worm gear drive 72 in either a clockwise or counter-clockwise direction rotates F/R drive gear 73 to cause frontward or rearward rotation of drive shaft 47. Frontward or rearward rotation of drive shaft 47 rotates F/R wheels 49*b* and 49*d* (not shown), which ride along rails 46*a* and 46*b* to cause frontward or rearward movement of gantry assembly 41. As shown in FIG. 15, support/stop block 48*c* is provided for securing rail 46*a* as well as for stopping frontward movement of gantry assembly 41.

The Crane

Vertical and lateral movements of the claw assembly are generally provided by means of the crane assembly. Adverting now to FIG. 14, crane assembly 19 comprises lateral motor 66, which is secured by appropriate means to the crane assembly housing. Lateral motor 66 is operatively arranged to turn lateral worm gear drive 69, which is operatively arranged to rotate lateral drive gear 70. Lateral drive gear 70 is secured to lateral drive wheel 68, which, in turn, is left/rightly secured to the crane assembly housing. The above described elements of the crane assembly are operatively arranged to provide lateral movement of the crane.

Figure 14:
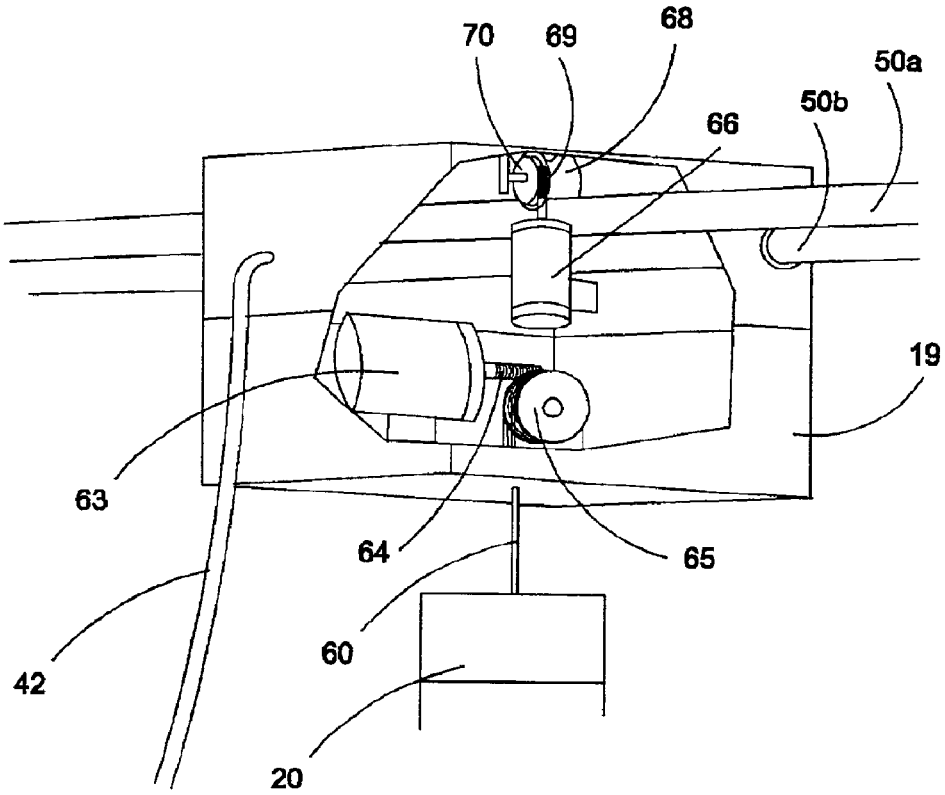
FIG. 14 is a fragmentary perspective view of the crane assembly.

As shown in FIG. 14, rotation of lateral worm gear drive 69 causes the left/right movement of lateral drive gear 70. Rotation of lateral drive gear 70 transfers left/right movement to lateral drive wheel 68 and causes crane assembly 19 to move along parallel rails 50*a* and 50*b*.

Crane assembly 19 further comprises up/down (U/D)) motor 63 for providing vertical movement of claw assembly 20 via U/D cable 60. As shown in FIG. 14, U/D motor 63 is secured by appropriate means to the crane assembly housing and is operatively arranged for turning U/D worm gear drive 64. Turning of U/D worm gear drive 64 transfers left/right movement to U/D pulley 65, which is secured to the crane assembly housing by appropriate means such that it is operatively arranged for left/right movement to wind or unwind U/D cable 60 for raising or lowering claw assembly 20.

The Claw

FIGS. 10–13 show side and fragmentary views of claw assembly 20 of the preferred embodiment. As shown in FIGS. 10–13, the claw assembly of the present invention generally comprises U/D cable 60, claw power and communications cable 42, coil cap 59, coil housing 58, claw interconnect holder 57, a plurality of claw interconnects 54*a–c*, plunger 55, ballast 61, claw "scoops" 52*a–c*, claw tines 53*a–c*, respectively, and claw connector 56.

Figure 12:
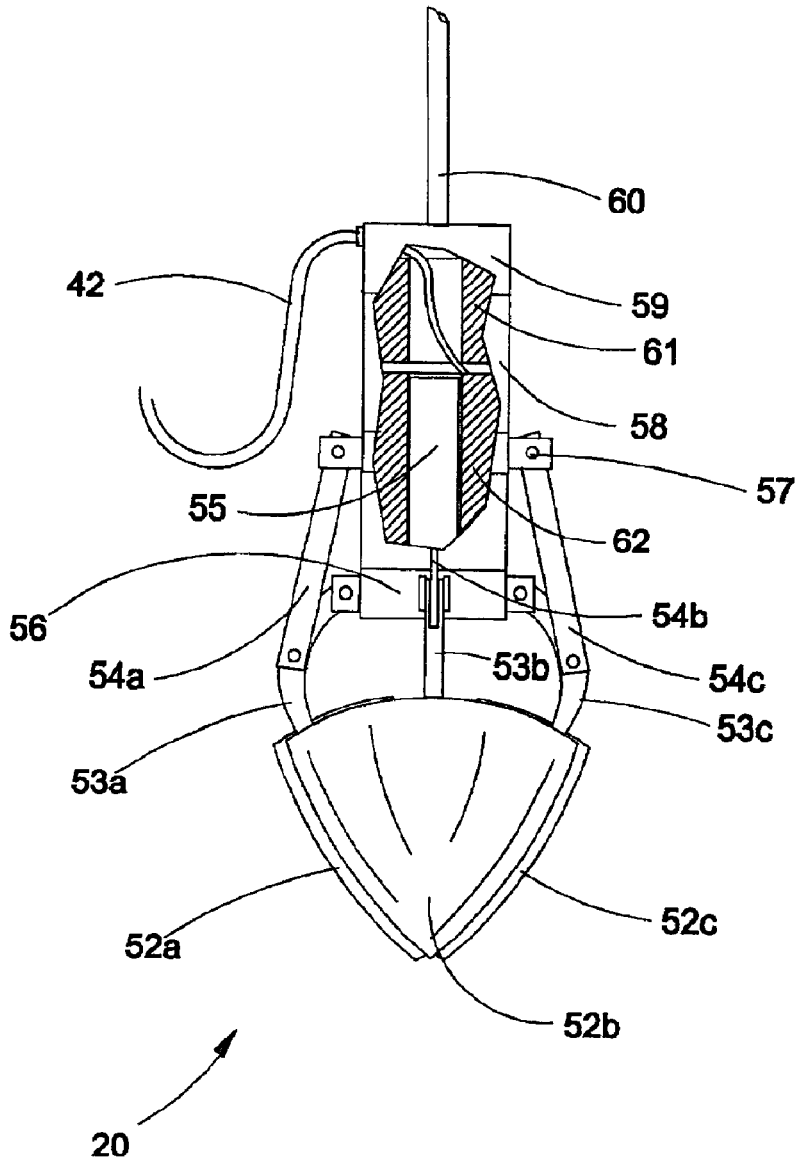
FIG. 12 is a fragmentary view of the claw assembly of the present invention in the closed position, with a part cut away to show the solenoid of the claw assembly.
Figure 13:
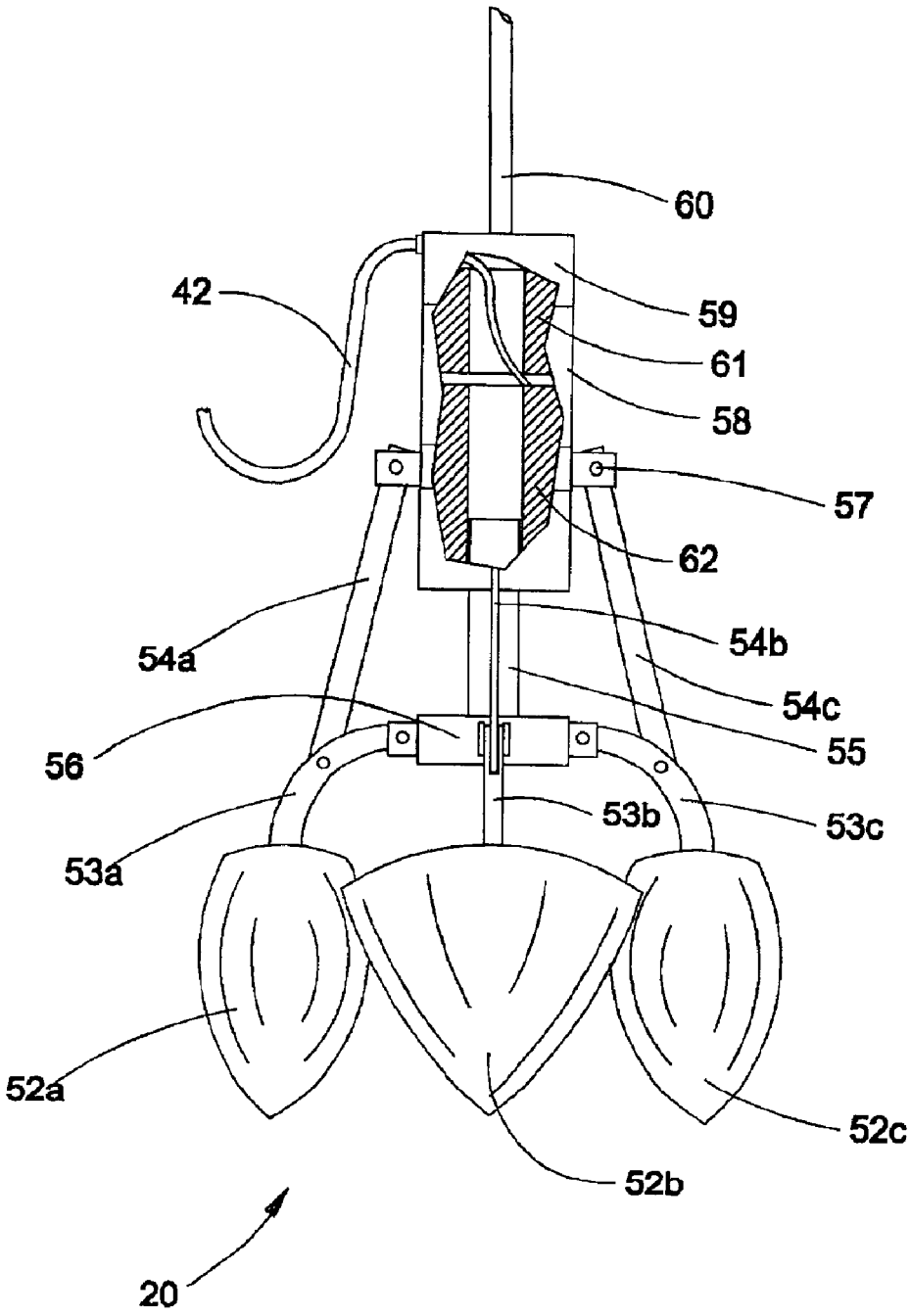
FIG. 13 is a view of the claw assembly similar to that of FIG. 12, except showing the claw assembly in an open position.

As shown in FIGS. 12–13, coil housing 58 and coil cap 59 are operatively arranged for encasing coil 62, which receives electronic communications and power from claw power and communications cable 42. Attached to coil cap 59 is U/D cable 60. Claw interconnect holder 57 is adjustably secured on the outer surface of coil housing 58. Claw interconnect holder 57 loosely secures a plurality of claw interconnects 54*a–c*. Claw interconnects 54*a–c* are operatively arranged for attachment to claw interconnect holder 57 as well as to claw tines 53*a–c* Plunger 55 is operatively arranged for slidable movement within coil 62. Plunger 55 is also secured to claw connector 56 by appropriate means. Ballast 61 is provided to assist claw scoop 52*a–c* reopening. Claw tines 53*a–c* attach to claw connector 56 at their distal ends. Attached to claw tines 53*a–c* are claw scoops 52*a–c* for grabbing prizes/objects. The attachment of claw scoops 52*a–c* and claw tines 53*a–c* to claw connector 56 and claw interconnect holder 57 via claw interconnects 54*a–c* form a structure capable of opening and closing under electromagnetic and opposing weight forces.

The Scale Assembly

As shown in FIGS. 3–6, 16–18 and 22, the components of scale assembly 12 generally comprise prizes/object delivery chute 23 for dispensing prizes/objects to a player, prizes/object gate 24 for collecting an amount of prizes/objects for weighing on scale plate 21, scale display 25 for determining the actual weight of game prizes/objects, scale data input and calibration means 26 for pre-programming and calibrating scale assembly 91 (shown in FIG. 18), and prizes/objects return chute 28 for returning game prizes/objects to the game platform in the event a player overloads the scale plate with game prizes/objects and "Tips the Scales".

As shown in FIGS. 3–6, scale assembly 12 additionally comprises needle indicator means 17, which is used for determining whether play may continue based upon the location of needle 29 in minimum range area 30, collection range area 31, or overload range area 32. Needle 29 is passed through the various ranges by means of needle motor 27 (Shown in FIG. 22). Needle indicator means 17 also comprises range light displays 33.

Figure 16:
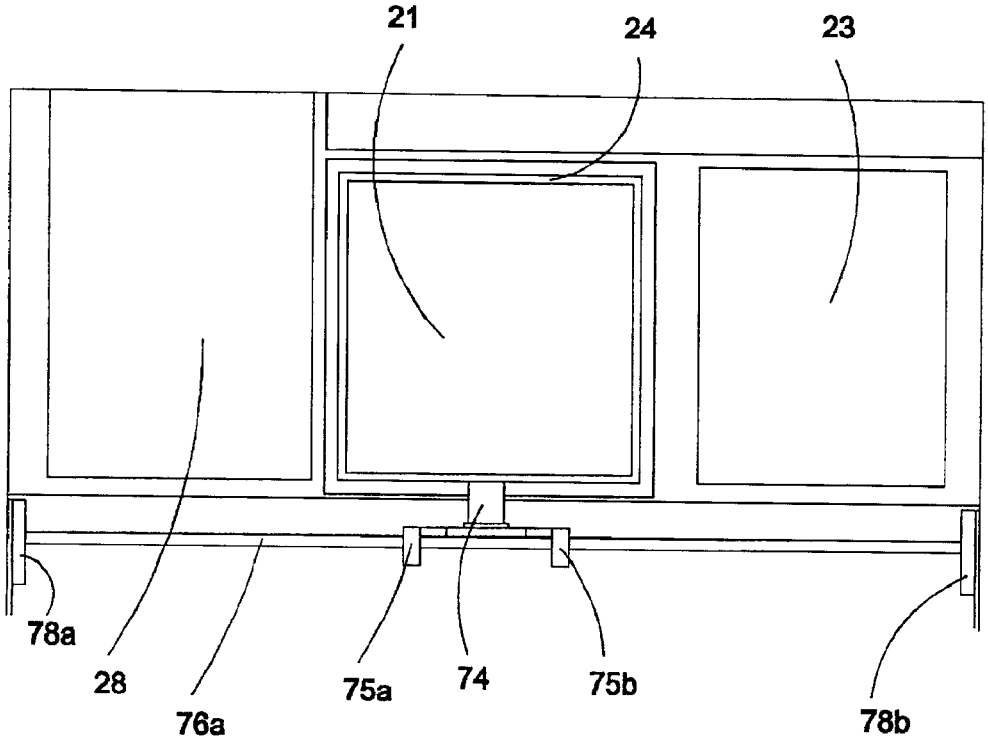
FIG. 16 is a top view of the scale assembly, prize/object delivery chute, and prize/object return chute.
Figure 17:
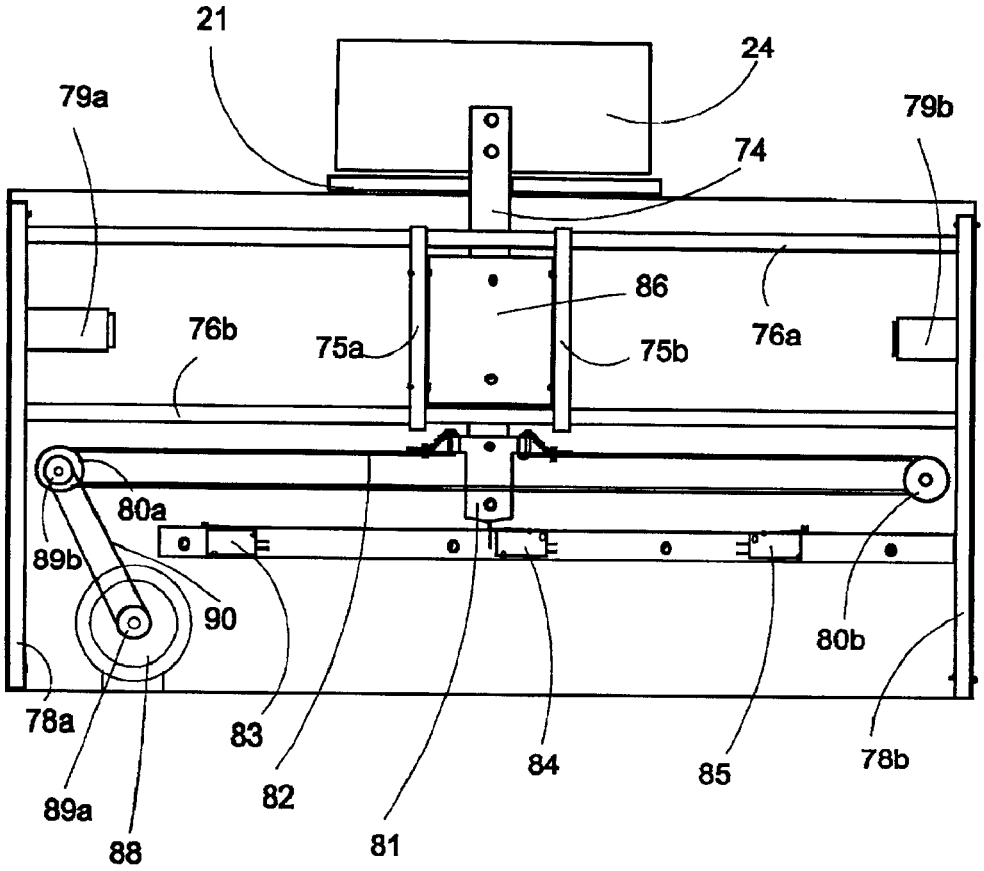
FIG. 17 is a rear view of the of the scale assembly showing means for laterally moving the prize/object gate.
Figure 18:
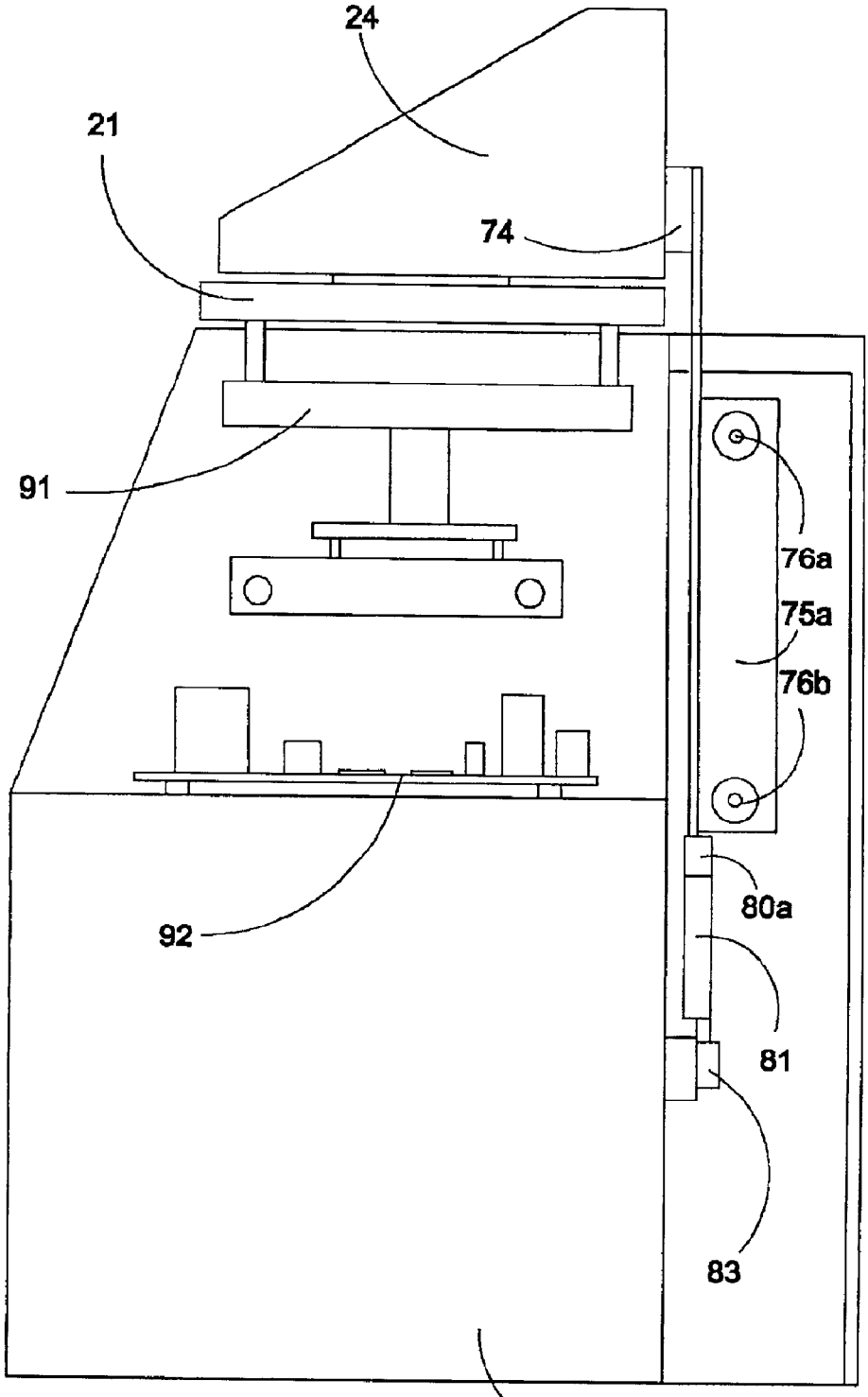
FIG. 18 is a side view of the scale assembly, with some internal components shown in phantom.

Internal components of scale assembly 12 are best viewed with reference to FIGS. 16–18 and 22. As shown in FIGS. 16–18, prizes/objects gate 24 is operatively arranged for lateral movement such that prizes/objects can be awarded to a player or returned to the game platform. Lateral movement of prizes/objects gate 24 is accomplished by a series of pulleys, belts, supports and shafts that ultimately transfer movement from prizes/objects gate motor 88.

As shown in more detail in FIG. 17, the internal components scale assembly 12 generally comprise prizes/objects gate motor 88 for providing left/right movement to attached drive pulley 89*a*, which rotates drive belt 90. Drive belt 90 is operatively arranged to engage belt pulley 89*b*, such that belt pulley 89*b* is rotated. Rotation of belt pulley 89*b* rotates cable pulley 80*a*, which is operatively arranged to engage and provide lateral movement to drive cable 82 about pulleys 80*a* and 80*b*. Lateral movement of drive cable 82 is transferred to cable support/switch activator 81, bearing block support 86, support bracket 74, and prizes/object gate 24. Bearing block support 86 is provided with bearing blocks 75*a* and 75*b* for slidable movement upon shafts 76*a* and 76*b*, which provide support for easing the lateral movement of prizes/objects gate 24. Shafts 76*a* and 76*b* are secured to cabinet 11 by means of shaft support blocks 78*a* and 78*b*. Left and right stop blocks 79*a* and 79*b* are provided for limiting the lateral movement of prizes/objects gate 24. Right, center and left limit switches, 83, 84 and 85, respectively, are provided for contacting cable support/switch activator 81 such that the prizes/objects gate maintains proper orientation and positioning.

Figure 22:
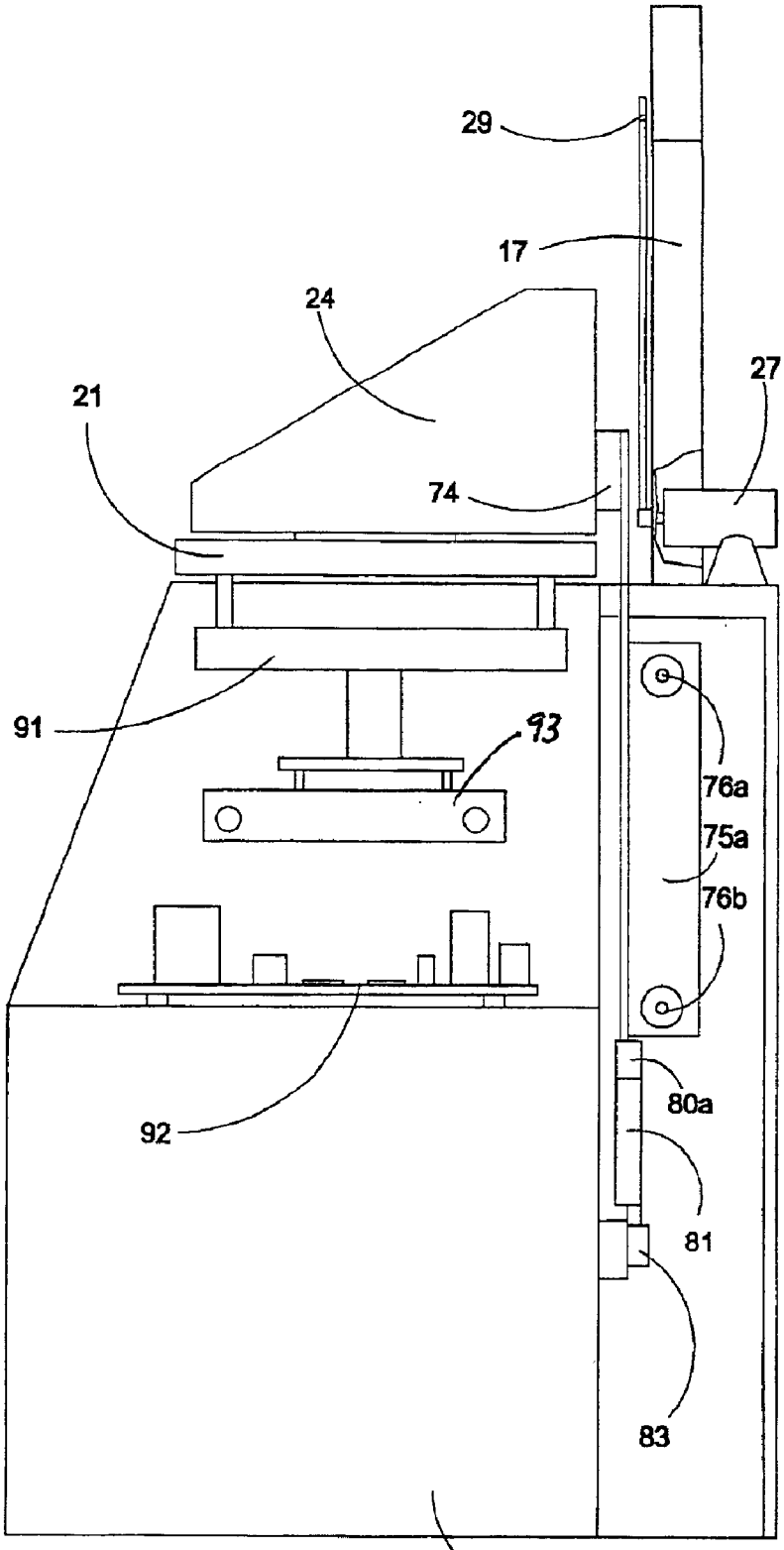
FIG. 22 is a side view of the scale assembly and needle indicator.

As shown in FIGS. 18 and 22, the internal components of scale additionally comprises scale 91 for weighing the game prizes/objects and needle motor 27 for passing needle 29 through the "continue", "take win or continue" and "overload" ranges. Scale assembly 12 additionally comprises load cell 93 and needle servo-motor 27. Game electronics are generally controlled by game electronics controller board 92 and other sub-electronics boards (not shown), which communicate with the main board.

Mechanical Operation

The frontward, rearward, lateral and vertical movement of the gantry assembly, the crane assembly, the prizes/object gate, and the claw assembly will now be more fully explained to enable a person having ordinary skill in the art to use the invention.

Figure 3:
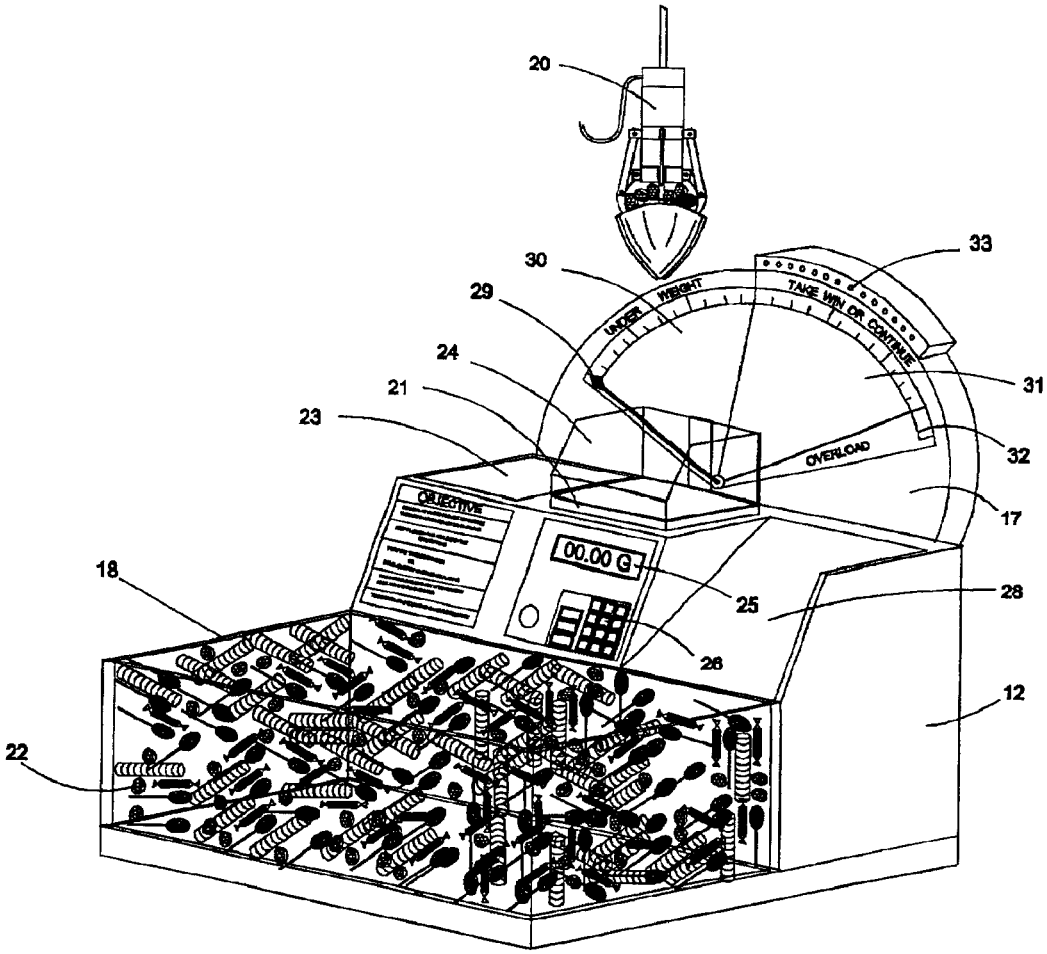
FIG. 3 is a perspective view of the game platform and scale assembly.

For purposes of illustration, movement of the gantry assembly and the crane and claw assemblies under direction of a player will be described with reference to the "Home" position which is generally shown in FIGS. 1, 3 and 8. As shown in FIGS. 1, 3 and 8, the "Home" position is generally defined as that position wherein the gantry assembly is to the rear, the crane assembly is laterally centered within the cabinet above scale plate 21 and prizes/objects gate 24, and the claw assembly is in the raised position. In the "Home" "position" the joystick is generally centered. "Left" or "right" movement refers to movement of the joystick, and crane and claw assemblies as would appear to an individual standing at the player controls and looking toward the rear of the game. "Frontward" and "rearward" movement refers to movement of the joystick and gantry assembly toward the front and rear of the game, where the "front" of the machine is that side defined by the player controls.

Figure 7:
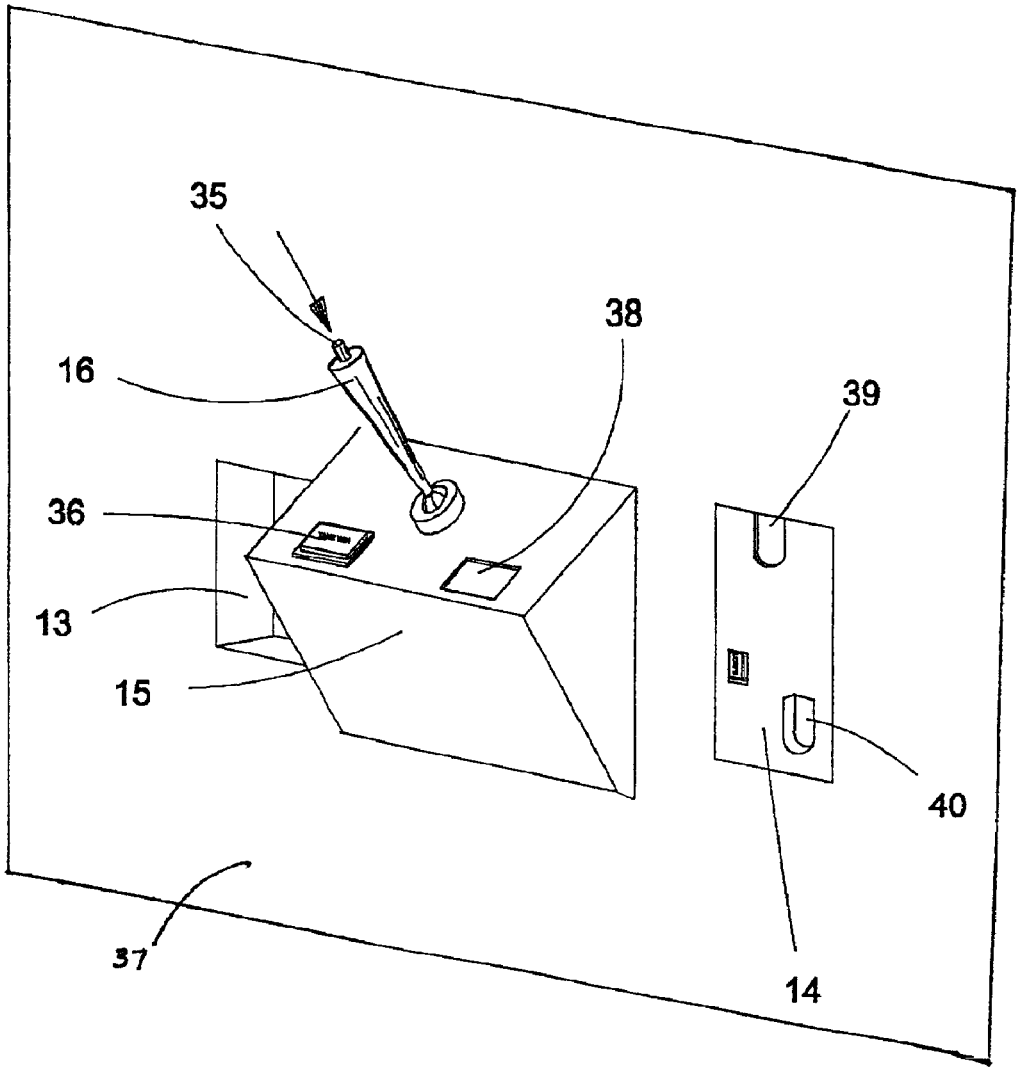
FIG. 7 is a perspective view of the player controls, prize/object ejection door and coin mechanism holder.

Adverting now to FIG. 7, which shows a detailed view of player control panel 15. Frontward, rearward, lateral and vertical control of the gantry, crane and claw assemblies of the combination amusement game are generally provided by player control panel 15. As shown in FIG. 7, player control panel 15 generally comprises joystick 16, down button 35, player displays 38, and "take win" button 36 for receiving prizes/objects placed on scale plate 21.

Frontward/Rearward Movement of the Gantry Assembly

Figure 9:
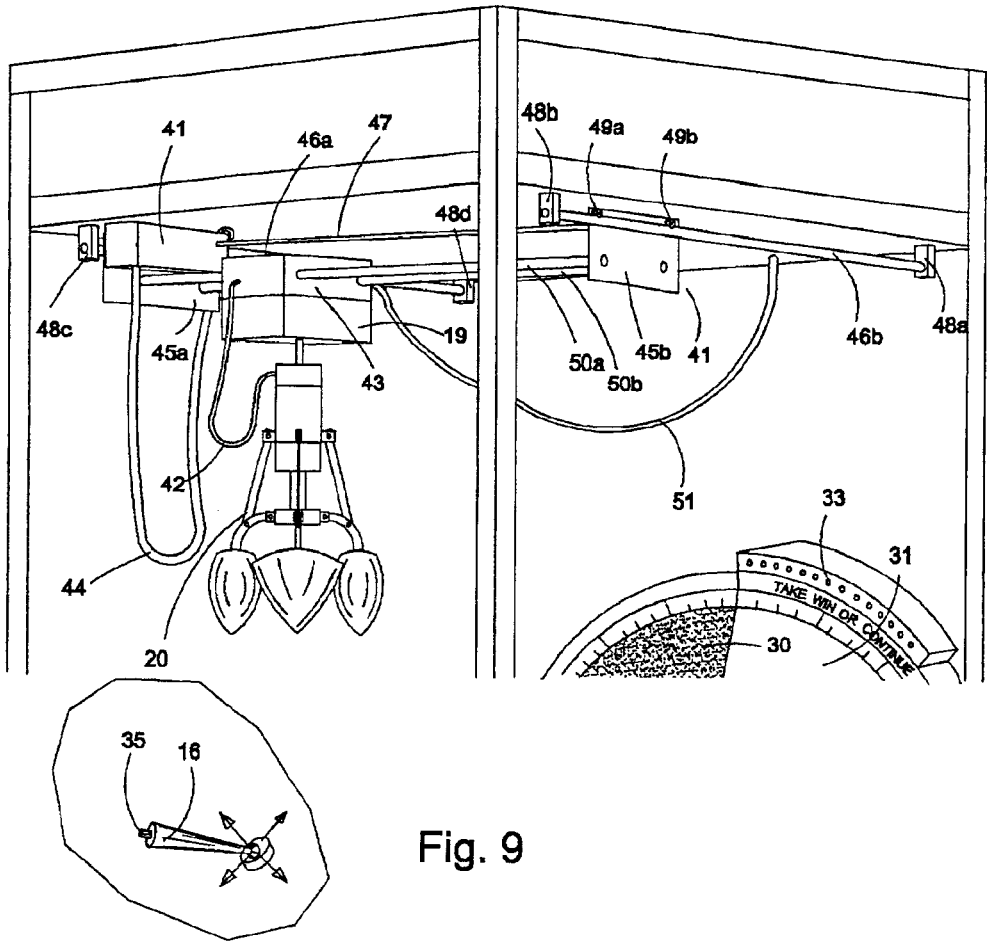
FIG. 9 is a fragmentary perspective view of the amusement game, showing the upper portion of the game and illustrating movement of the gantry assembly and the crane assembly.

Adverting now to FIGS. 8, 9 and 15. Front and rear movement of the gantry assembly is accomplished by moving joystick 16 toward the front and rear of the cabinet, respectively. Movement of joystick 16 in either the front or rear direction signals F/R motor 71 to turn F/R worm gear drive 72, which is operatively arranged to engage F/R drive gear 73 for turning drive shaft 47 and wheels 49*b* and 49*d* (not shown), which move along rails 46*a* and 46*b*. As shown in FIGS. 8 and 9, from the "Home" position, movement of joystick 16 toward the front of the machine causes gantry assembly 41 to move in a direction toward the player. Similarly, movement of the joystick toward the rear of the cabinet causes movement of the gantry assembly toward the rear of the cabinet.

Lateral Movement of the Crane Assembly

Lateral movement of the crane assembly is best understood by reference to FIGS. 8, 9 and 14. FIGS. 8 and 9 illustrate movement of the crane assembly is accomplished by moving joystick 16 toward the left or right of the cabinet. As shown in FIG. 9, movement of the joystick toward the left has caused leftward movement of the crane and claw assemblies. Referring now to FIG. 14; movement of the joystick to the left or right signals lateral motor 66 to turn lateral worm gear drive 69, which is operatively arranged to engage lateral drive gear 70, causing lateral drive wheel 68 to rotate in a counterclockwise or clockwise direction. As a result, the rotation of drive wheel 68 causes the crane assembly to move to the left or right within the cabinet along rails 50*a* and 50*b* of gantry assembly 41. It should be appreciated that although they are not shown, crane assembly 19 comprises additional wheels for supporting the crane assembly on rails 50*a* and 50*b*.

Vertical Movement of the Claw Assembly

Vertical movement of the claw assembly is both automatic and provided under the direction of a game player. Vertical movement of the claw assembly is best viewed by reference to FIGS. 2, 8 and 14. As shown in FIG. 2, lowering of the claw assembly is provided by a game player via pressing down button 35 of joystick 16 in the direction of the arrow. As shown in FIGS. 1, 2 and 14, from the raised claw assembly 20 position, pressing down button 35 signals U/D motor 63 to turn U/D worm gear drive 64. U/D worm gear drive 64 is operatively arranged for engaging and turning U/D drive pulley 65, which unwinds U/D cable 60 to lower the claw assembly. After pressing U/D button 35, the claw assembly continues to lower until slack is formed in U/D cable 60. When slack in U/D cable 60 is formed (as occurs when the claw assembly contacts game prizes or the game platform), the U/D motor 63 is signaled to stop and the claw assembly is signaled to contract in an attempt to grab prizes/objects. A short time period after contraction of the claw assembly (0.5 seconds), U/D motor 63 is automatically signaled to raise the claw assembly, which causes U/D 63 motor to reverse such that U/D worm gear drive 64 rotates U/D drive pulley 65 to cause winding of U/D cable 60 for raising the claw assembly. As shown in FIG. 3, once fully raised, the claw assembly then automatically returns to the "Home" position to drop any secured prizes/objects into the prizes/object gate and onto scale plate 21 for weighing.

Claw Operation

Figure 10:
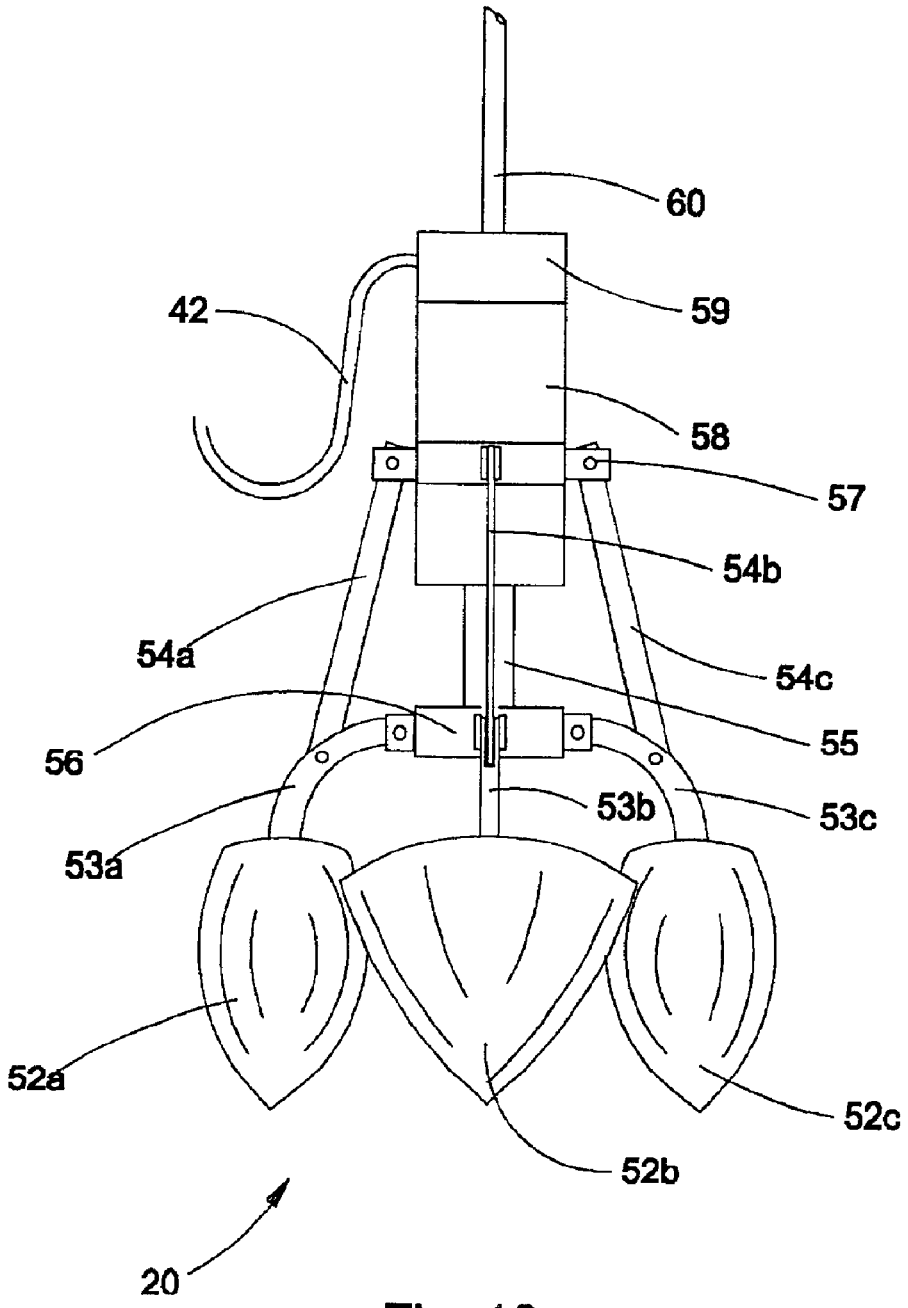
FIG. 10 is a side view of the claw assembly of the present invention in the open position.
Figure 11:
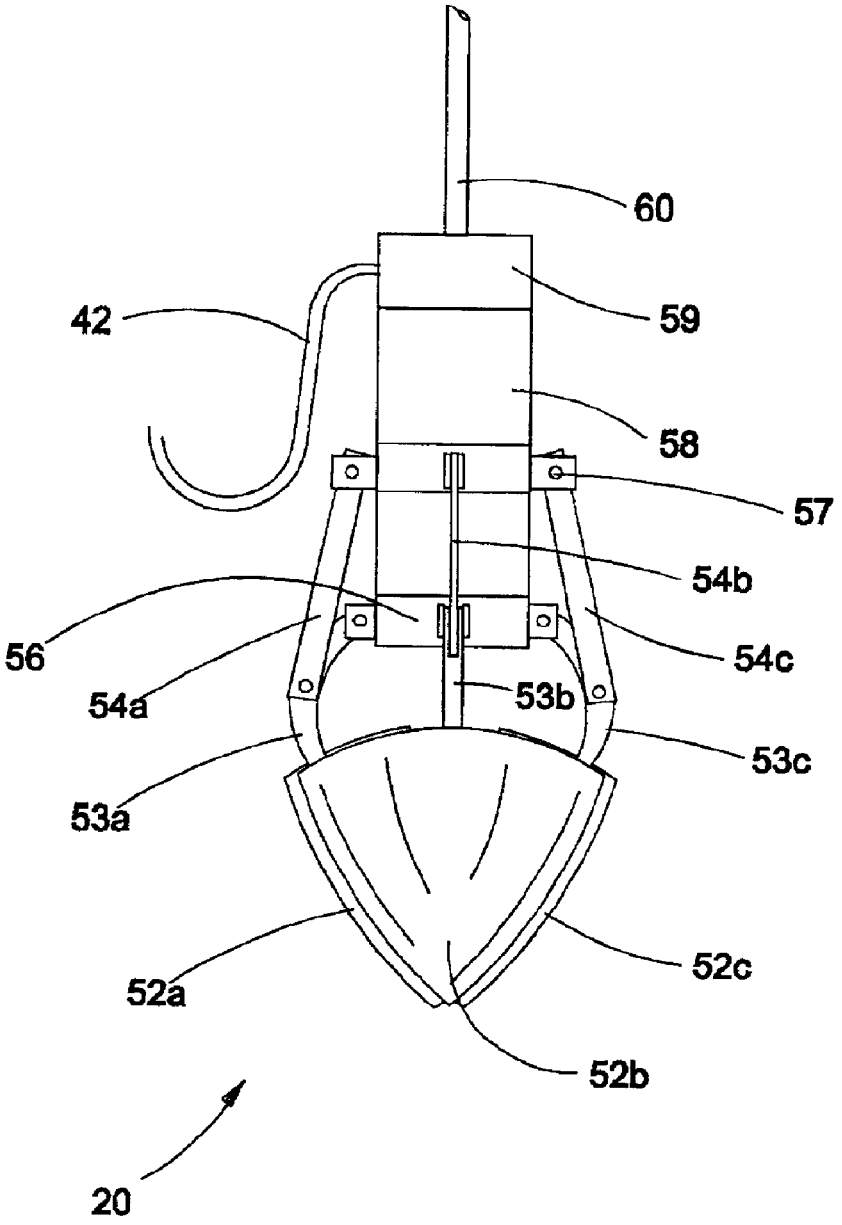
FIG. 11 is a side view of the claw assembly of the present invention in the closed position.

Referring now to FIGS. 10–13, which shows side views of the claw assembly of the present invention. As shown in FIGS. 11 and 12, when a current is passed through coil 62 proximate ballast 61, an electromagnet is created, which attracts plunger 55. The attraction of plunger 55 causes attached claw connector 56 to move along with the plunger 55 toward the coil. Movement of the claw connector in direction of the plunger acts upon the claw interconnects and the claw tines, such that contraction of the claw tines and the claw scoops occurs. Contraction of the claw tines and the claw scoops provides means by which prizes/objects may be secured as shown in FIG. 3.

As shown in FIGS. 10 and 13, when current has ceased to pass through the coil, the magnetic effect upon plunger 55 is ceased and the plunger allowed to relax. The plunger, claw tines 53*a*–*c* and claw scoops 52*a*–*c*, thus return to the rest position under their own weight and open the claw assembly.

As shown in FIGS. 3–6, after being signaled to ascend and after the claw assembly has reached the "Home" position above the scale plate, the claw assembly is signaled to open such that any secured prizes/objects are allowed to fall into the prizes/object gate and onto scale plate 21 for weighing.

Scale and Prize/Object Gate Operation

The scale assembly, the scale plate, and the prizes/objects gate generally weigh, dispense and return game prizes/objects. As previously indicated, the object of the amusement game is to place an amount of prizes/objects greater than a predetermined minimum, but less than a predetermined maximum, onto the scale plate such that a player is awarded the game prizes/objects or other prize. If a player places prizes/objects on the plate which exceed the predetermined maximum, the player loses!

As shown in FIGS. 3–6, 18 and 22, weighing of game prizes/objects 22 is conducted by placing the game prizes/objects on scale plate 21. The scale plate is operatively arranged to transfer the weight of the game prizes/objects to scale 91 and to a lesser extent, changes in weight to load cell 93, after which needle motor 27 is signaled to cause needle indicator 29 movement.

As shown in FIG. 3, before prizes/objects are placed onto the scale plate for weighing, needle indicator 29 remains in the "continue to add" range 30 of needle indicator assembly 17. However, when a sufficient amount of game prizes/objects 22 are placed on the scale plate (between the minimum and maximum settings), needle motor 27 is signaled to move needle indicator 29 into the "take win or continue" range 31. When the needle indicator passes into this range, light display 33 is illuminated. Additionally, when the needle indicator enters this range, a player is tasked to choose between continuing play (and adding more prizes/objects to the scale plate) or pressing the "take win" button. As shown in FIG. 5, pressing the "take win" button causes the prizes/object gate to move toward the left such that the game prizes/objects are moved over prizes/object delivery chute 23, which causes game prizes/objects 22 to be dispensed to the game player via prizes/objects ejection door 13. Alternatively, as shown in FIG. 6, if the weight of the game prizes/objects is greater than the maximum setting such that the needle indicator passes into the "overload" range 32, the prizes/objects gate is signaled to move to the right and game prizes/objects 22 are returned to the game platform via prizes/objects return chute 28.

Lateral (right and left) movement of the prizes/objects gate 24 is best understood with reference to FIGS. 16–18. As shown in FIGS. 16–18, prizes/objects gate 24 is operatively arranged for lateral movement such that prizes/objects can be awarded or returned to the game platform. Lateral movement of prizes/objects gate 24 is accomplished by a series of cables, pulleys, supports and shafts that ultimately transfer movement from prizes/objects gate motor 88. As shown in more detail in FIG. 17, prizes/objects gate motor 88 is operatively arranged for providing rotation to attached drive pulley 89*a*, which rotates drive belt 90. Rotation of drive belt 90 engages belt pulley 89*b*, such that rotation of belt pulley 89*b* is caused. Rotation of belt pulley 89*b* causes rotation of cable pulley 80*a*, which is operatively arranged to engage and provide lateral movement to drive cable 82 about pulleys 80*a* and 80*b*. Lateral movement of drive cable 82 causes lateral movement of cable support/switch activator 81, which is attached thereto. Movement of cable support/switch activator 81 causes movement of attached bearing block support 86. Movement of bearing block support 86, thus, causes movement of attached support bracket 74, which causes lateral movement of attached prizes/object gate 24. Bearing block support 86 is provided with bearing blocks 75*a* and 75*b* for slidable movement upon shafts 76*a* and 76*b*, which provide support for easing the lateral movement of prizes/objects gate 24. Shafts 76*a* and 76*b* are secured to cabinet 11 by means of shaft support blocks 78*a* and 78*b*. Left and right stop blocks 79*a* and 79*b* are provided for limiting the lateral movement of prizes/objects gate 24. Right, center and left limit switches, 83, 84 and 85, respectively, are provided for contacting cable support/switch activator 81 such that the prizes/objects gate maintains proper orientation and positioning.

Electronic Circuit Diagram

Figure 26:
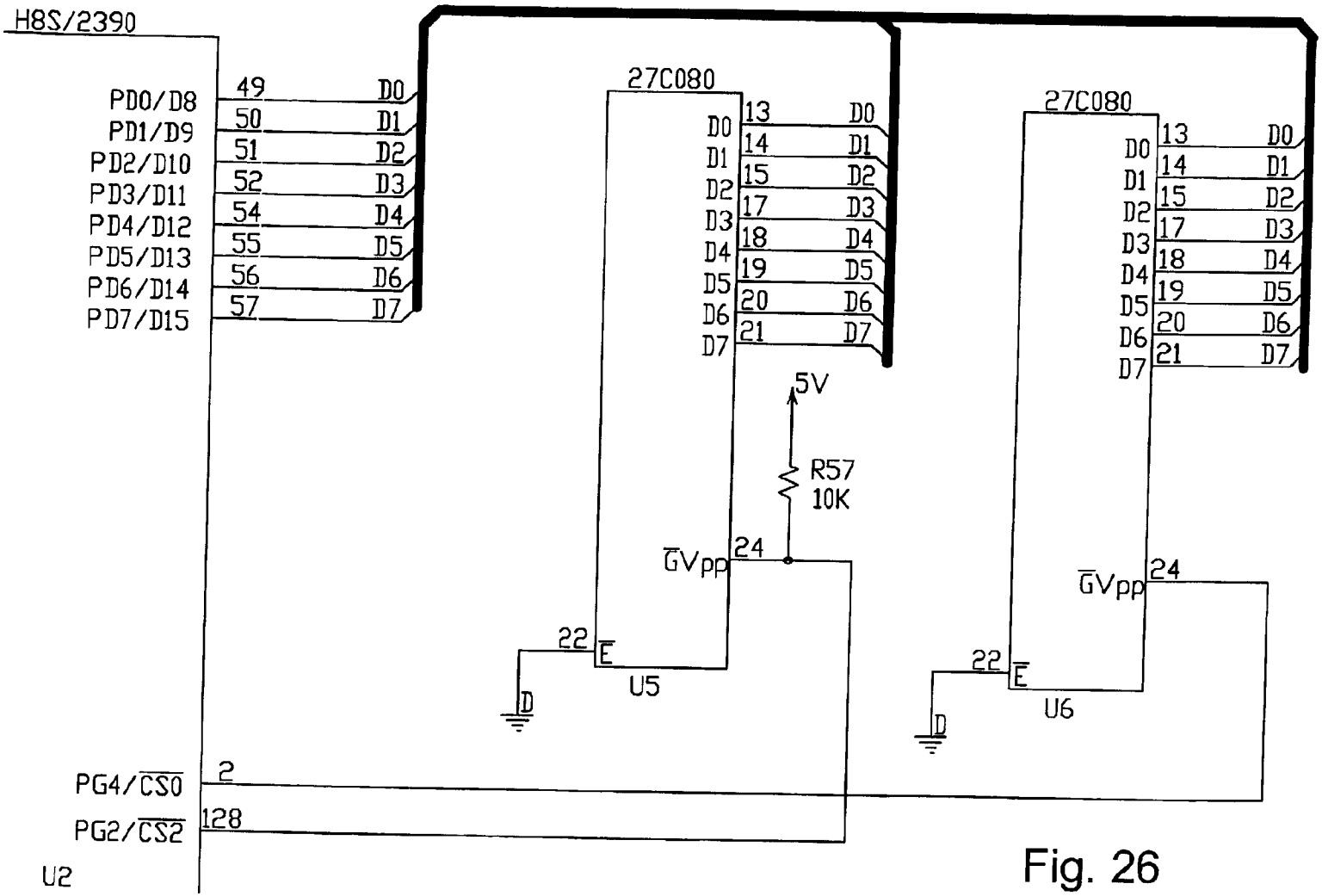
FIG. 26 is a schematic diagram illustrating data and chip selects for the microprocessor to the EPROMS of the electronic circuit.
Figure 27:
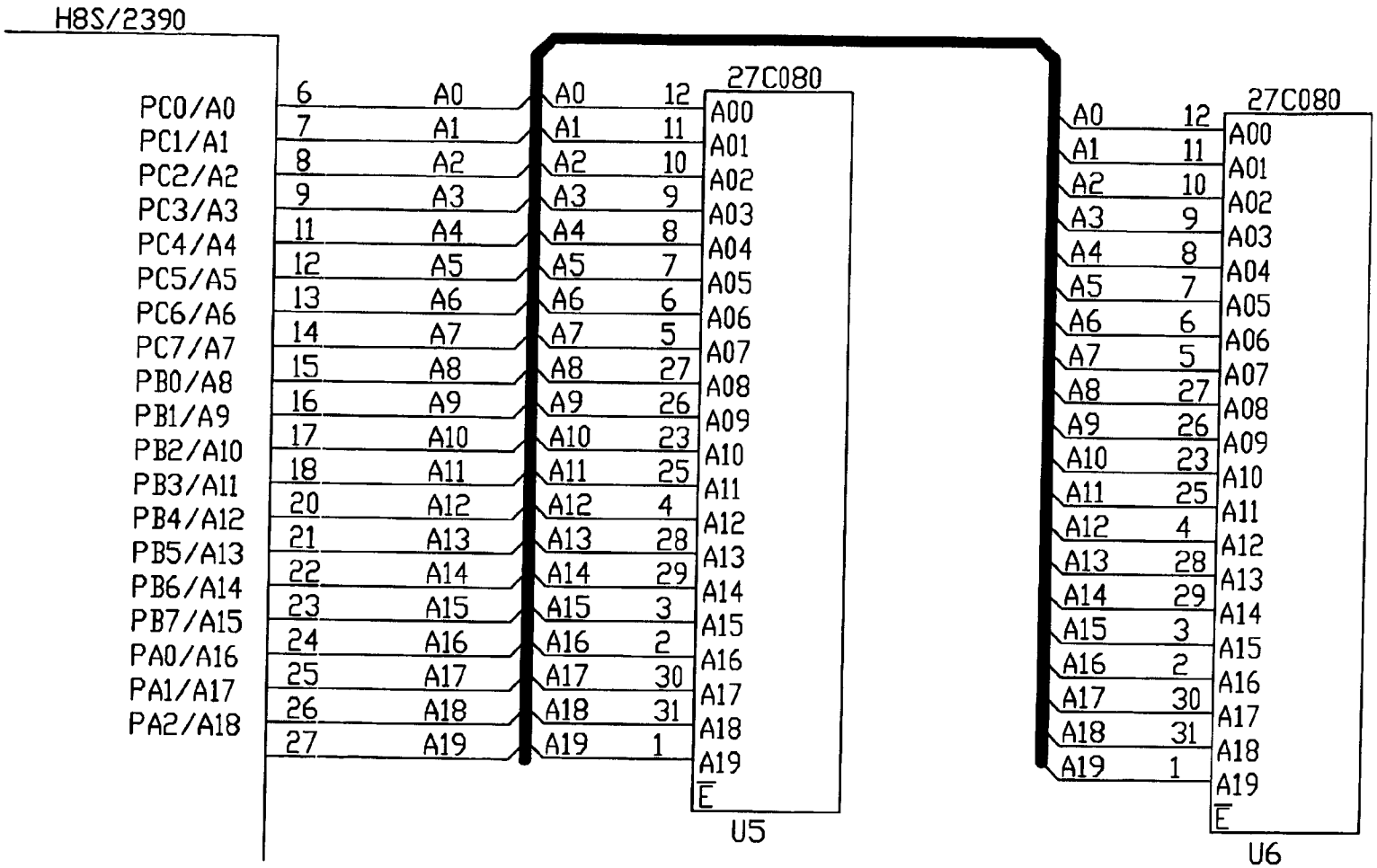
FIG. 27 is a schematic diagram illustrating the address connections between the microprocessor and the EPROMs of the electronic circuit.

The general electronic control circuits 92 which control the electromechanical devices of the invention, via leads and cables (not shown), are illustrated in FIGS. 23–50. The game is microprocessor controlled, and, in a preferred embodiment, microprocessor U2 is Hitachi model H8S/2390, or equivalent. Sections of the microprocessor U2 appear in various circuit figures. The code for the microprocessor is stored in EPROMS U5 and U6 (shown in FIGS. 26 and 27), which, in a preferred embodiment are both EPROM model 27CO80. Latches U20 and U21 (model 74HC273, or equivalent), shown in FIG. 28, ensure proper communication of the output signals to external devices, as is well known in the art. (A latch is a type of flip-flop that accommodates the settling of data received from the microprocessor.)

Power supply section 210 of the circuit broadly comprises four bridge rectifier circuits and a plurality of voltage regulators as described below. Alternating current at 120V is reduced by a multi-tap transformer (not shown) to a plurality of outputs at various voltage levels (36, 16.5, 13.2 and 10.5 VAC) which enter the main circuit board at connector P10. This AC supply voltage is provided via fusible links to a plurality of bridge rectifiers to produce pulsed DC voltages at a plurality of different DC voltage levels: namely, a 16V unregulated source provided by bridge rectifier DB1; a 36V regulated source provided by bridge rectifier DB2 and voltage regulator VR3; a regulated 12V source provided by bridge rectifier DB3 and voltage regulator VR1; a regulated 5V source provided by bridge rectifier DB3, voltage regulator VR1, and voltage regulator VR2; and a 12V unregulated source provided by bridge rectifier DB4. Each bridge rectifier includes a corresponding capacitor to filter and smooth the voltage waveform, as is well known in the art. In a preferred embodiment, voltage regulators VR1 and VR3 are high output model LM338K ICs, VR2 is a model LM7805. Associated with the power supply are LED indicators D1, D2, D3 and D4, shown in FIG. 25, operatively arranged to indicate status (operation) of the above-described power supplies of the circuit. (For example, D4 is operatively arranged to indicate the status of the 12V unregulated power supply.

Figure 33:
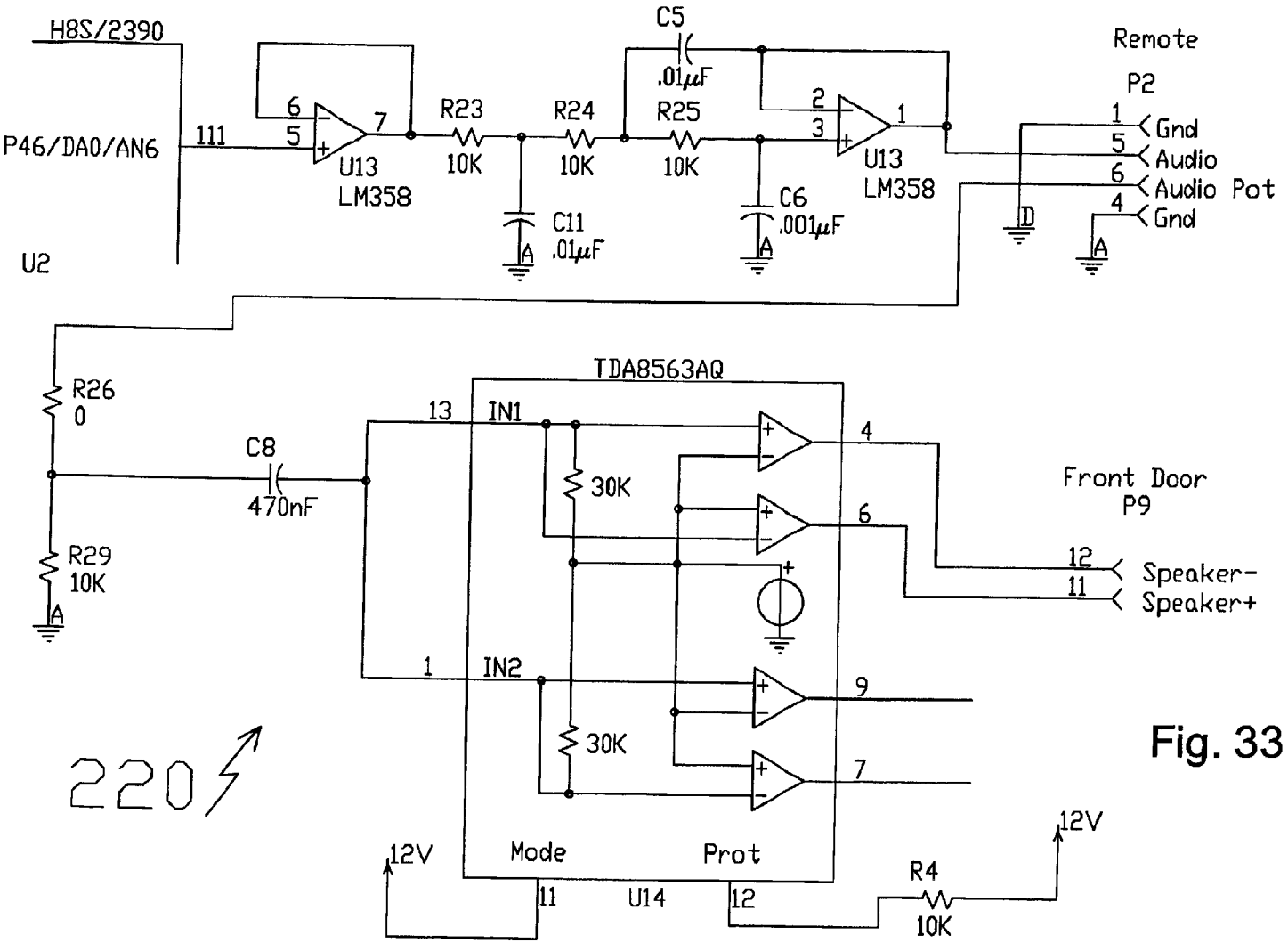
FIG. 33 is a schematic diagram of the audio amplifier.

The audio output section 220 of the circuit, illustrated in FIG. 33, broadly comprises all of the circuit elements shown in FIG. 33. Digital audio signals are initially stored in EPROMS U5 and/or U6 (shown in FIGS. 26 and 27). The audio signals include representations of various sounds used throughout play of the game, such as, but not limited to: background sound, sounds made when a coin is inserted, when a prize is won, when a prize is lost, when the claw is open, when the claw is closed, when the gantry/crane and/or claw is in motion, etc., as is well known in the art. The microprocessor includes an integral digital to analog converter, and provides an analog audio signal at pin 111. This audio signal is communicated to the non-inverting input of operational amplifier U13 (model LM358 or equivalent). U13 and its associated support circuitry (resistors and capacitors) comprise an active low-pass filter which filters and smoothes the analog audio signal. The audio signal next communicates via connector P2 with an audio potentiometer, which enables the user of the game to adjust sound volume levels. The volume-adjusted audio signal next enters power amplifier U14 (Philips model TDA8563AQ, or equivalent), where the signal is amplified before transmission to the speaker via leads SPKR– and SPKR+.

Inputs to Main Circuit

There are various input signals to the main circuit board from various sensors, switches, mechanical controllers, etc., of the invention.

The input signals enter the main board at various sections. Front door section 230 includes connector P9 (FIG. 23) arranged to receive input signals JoyFront (joystick front), JoyRear (joystick rear), JoyRt joystick right), JoyLt (joystick left), JoyBtn (joystick button), Coin1 (coin slot 1), Coin2 coin slot 2), and DBV (dollar bill validator). The "joystick front" position is toward the player; the "joystick rear" position is away from the player. The "joystick right" position is toward the right of the player; the "joystick left" position is toward the left of the player. It is assumed for this description that the player is facing the front of the game. As the joystick is moved, appropriate signals are sent to the board at P9. As coins are inserted into either of the two coin slots, appropriate signals are sent to the board at P9. When a dollar bill is validated, an appropriate signal is sent to the board at P9.

Figure 23:
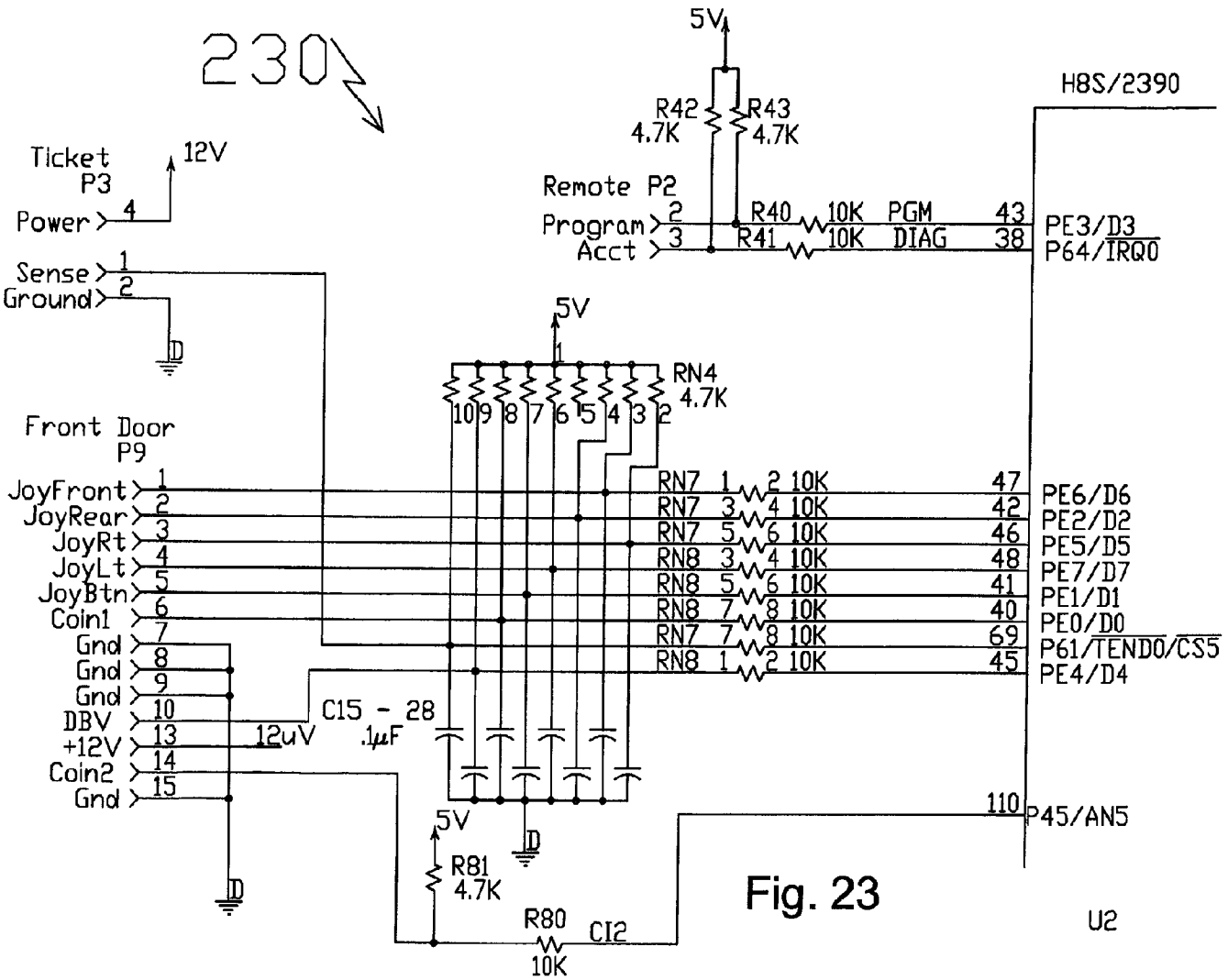
FIG. 23 is a schematic diagram illustrating a plurality of inputs to the microprocessor of the invention.
Figure 24:
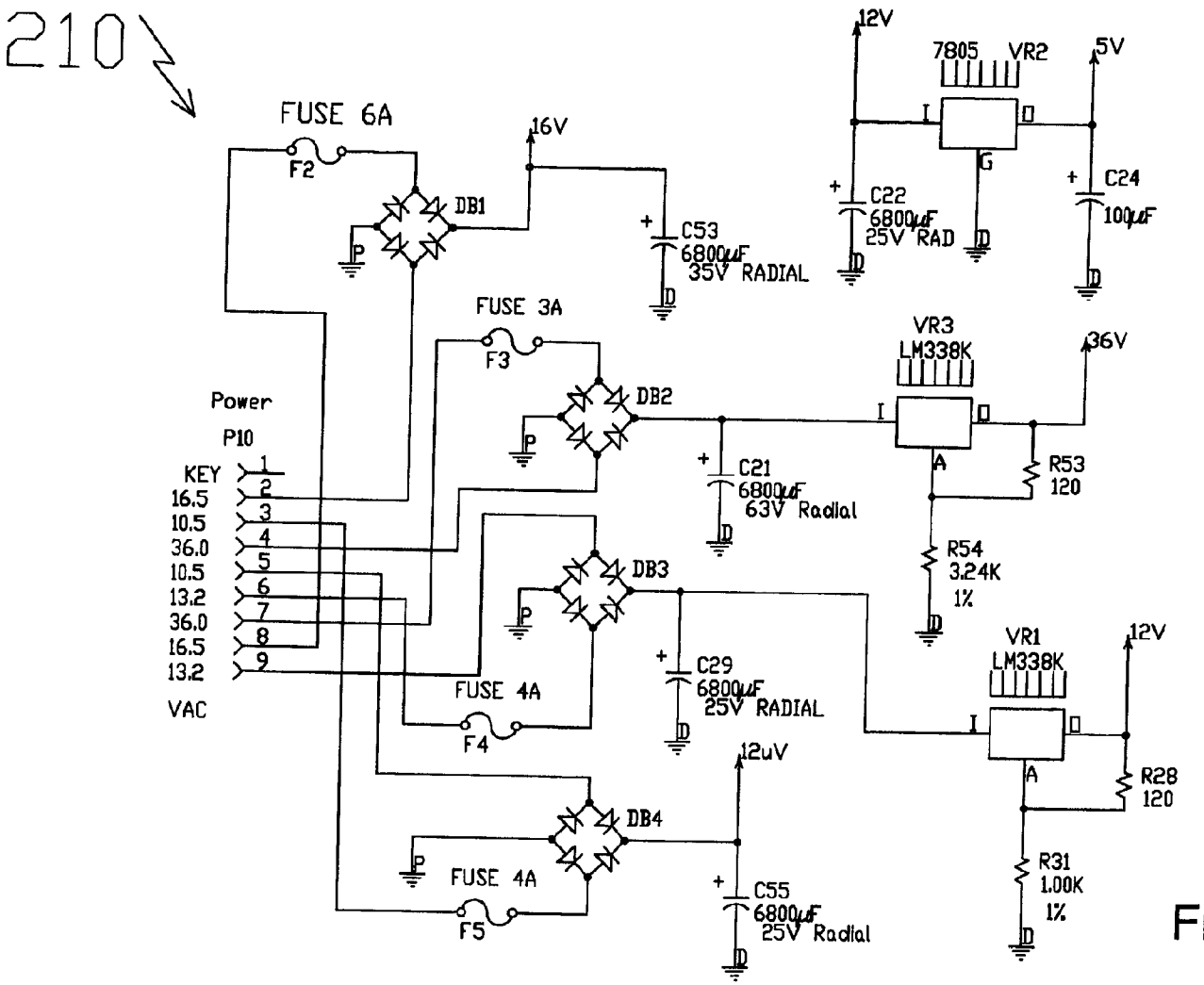
FIG. 24 is a schematic diagram of the power supply section of the electronic circuit of the invention.
Figure 25:
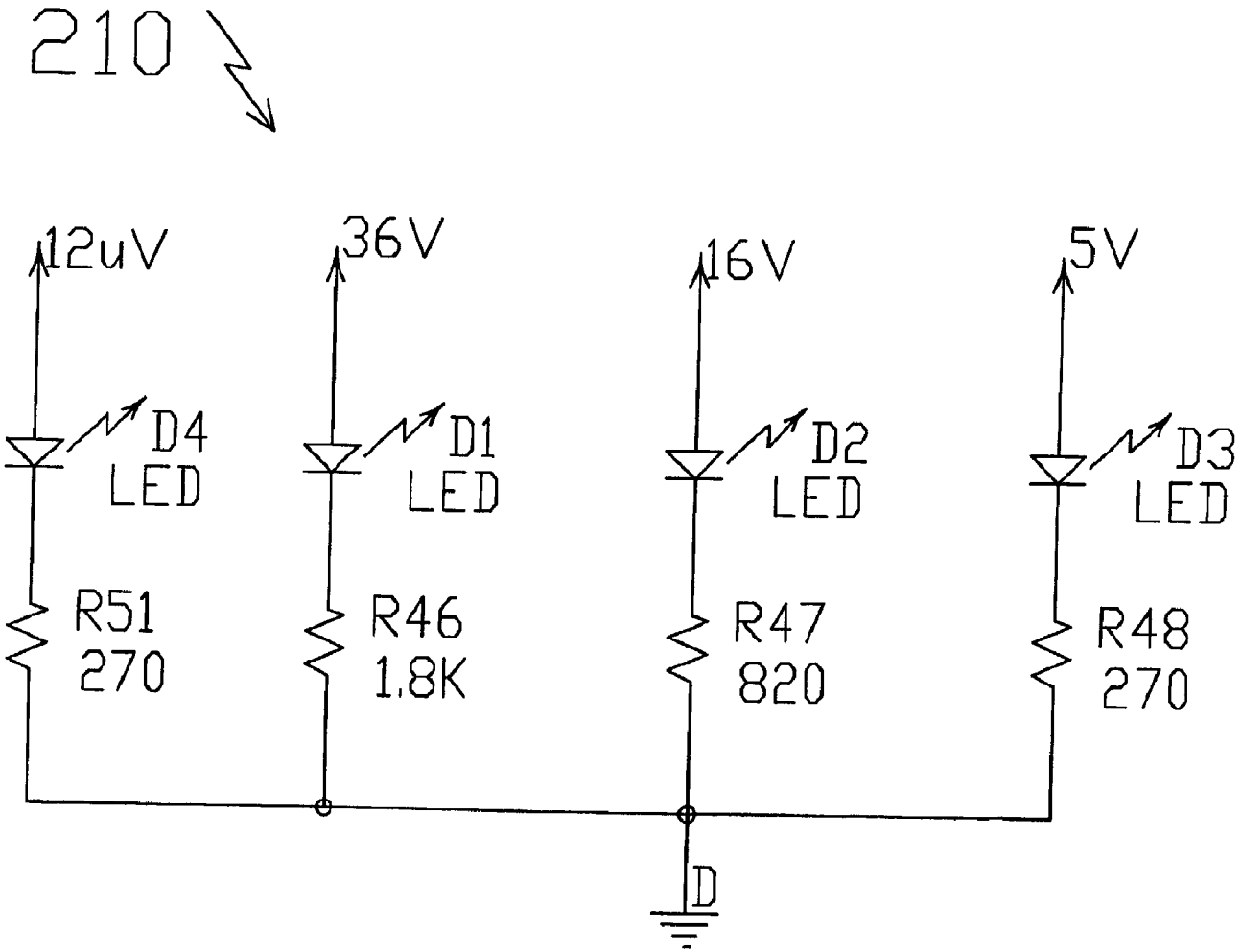
FIG. 25 is a schematic diagram of the power supply operational indicators of the electronic circuit of the invention.

Also shown in FIG. 23 is connector P3 for ticket acknowledgement. This signal indicates that redemption tickets are being dispensed by a ticket dispenser (some jurisdictions require the dispensing of tickets when a player fails to win a prize with the claw).

Also shown in FIG. 23 is connector P2 for accounting and programming functions, as is well known in the art.

Figure 38:
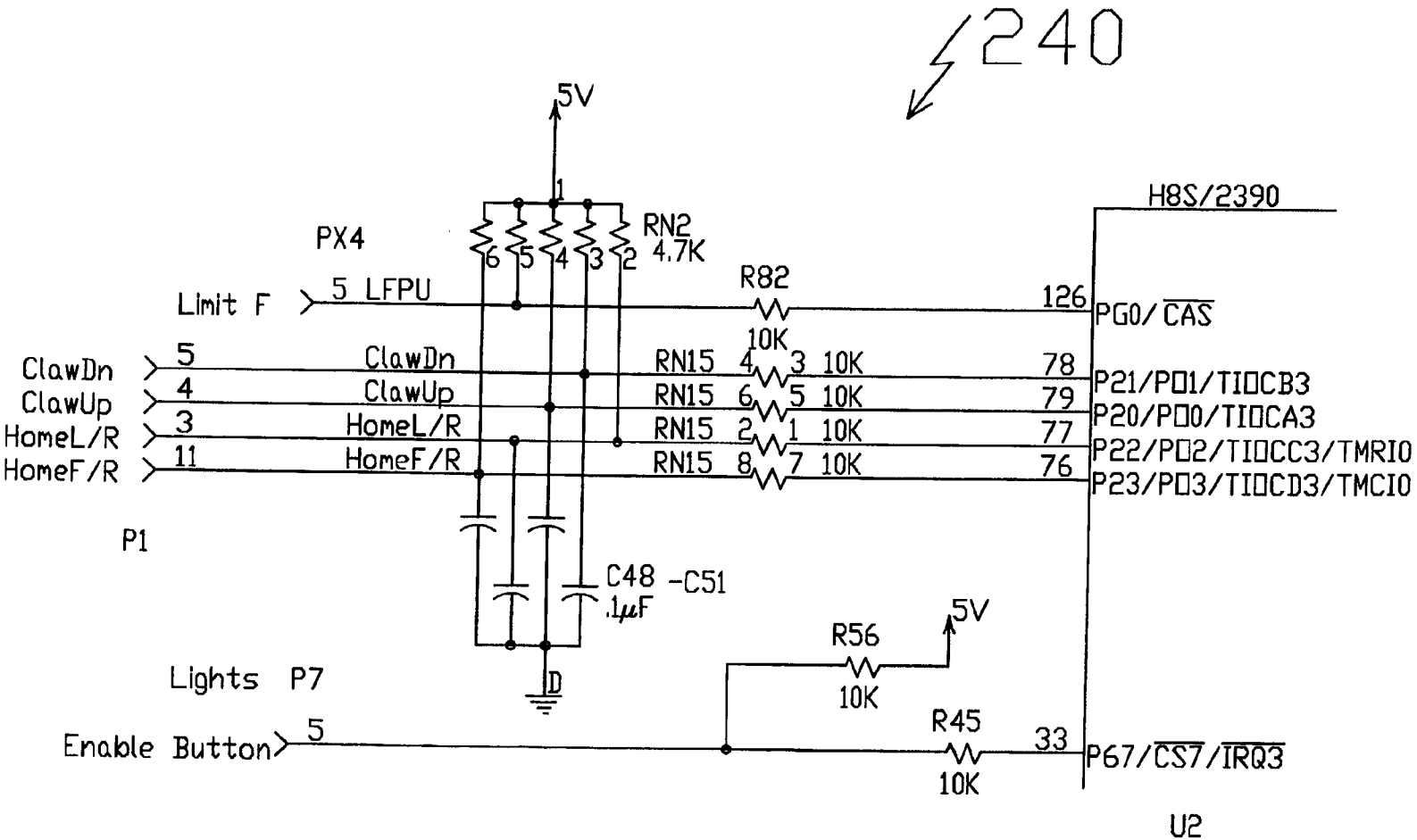
FIG. 38 is a schematic diagram of the limit switch input circuits for the gantry, crane and claw assemblies as well as the "take win" button input.

Other input signals enter circuit section 240 from the gantry (carriage) assembly at connector P1 as shown in FIG. 38. Connector P1 receives input signals, HomeF/B (home front rear), HomeL/R (home left right), ClawUp (claw up), ClawDn (claw down). The Home input signals indicate when the crane assembly is in its "Home" position, and the Claw input signals indicate when the claw assembly has reached the top and bottom of its travel. An additional signal enters connector PX4 to indicate front limit (i.e., limiting movement of the gantry toward the player). Also shown in this figure is connector P7, operatively arranged to receive an optional door switch signal, which indicates the status of the front door of the game.

Connectors PX1 (FIG. 35), PX2 (FIG. 29) and PX3 (FIG. 34) connect the main board to the up/down, left/right, and front/rear motors, respectively, of the invention. Input signals ErrorHR, ErrorHL, and ErrorP enter the board at PX1 from the up/down motor drive daughter controller board to indicate various errors on the controller board. Input signals ErrorHR, ErrorBL, and ErrorP enter the board at PX2 from the left/right motor drive daughter controller board to indicate various errors on the controller board. Input signals ErrorHR, ErrorBL, and ErrorP enter the board at PX3 from the front/rear motor drive daughter controller board to indicate various errors on the controller board.

Output Signals

Figure 28:
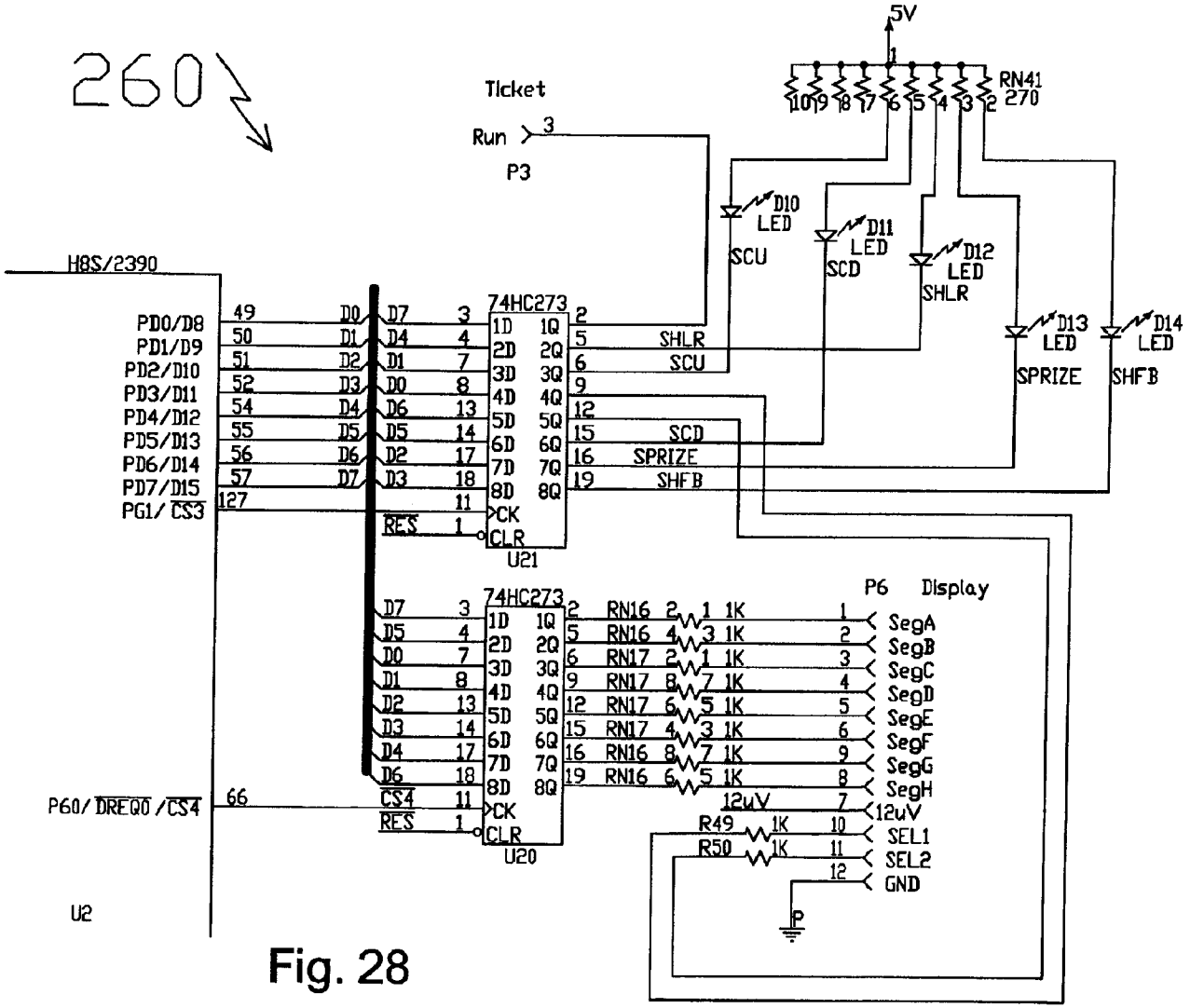
FIG. 28 is a schematic diagram illustrating the display outputs and diagnostic display of the electronic circuit, and ticket dispenser control.
Figure 36:
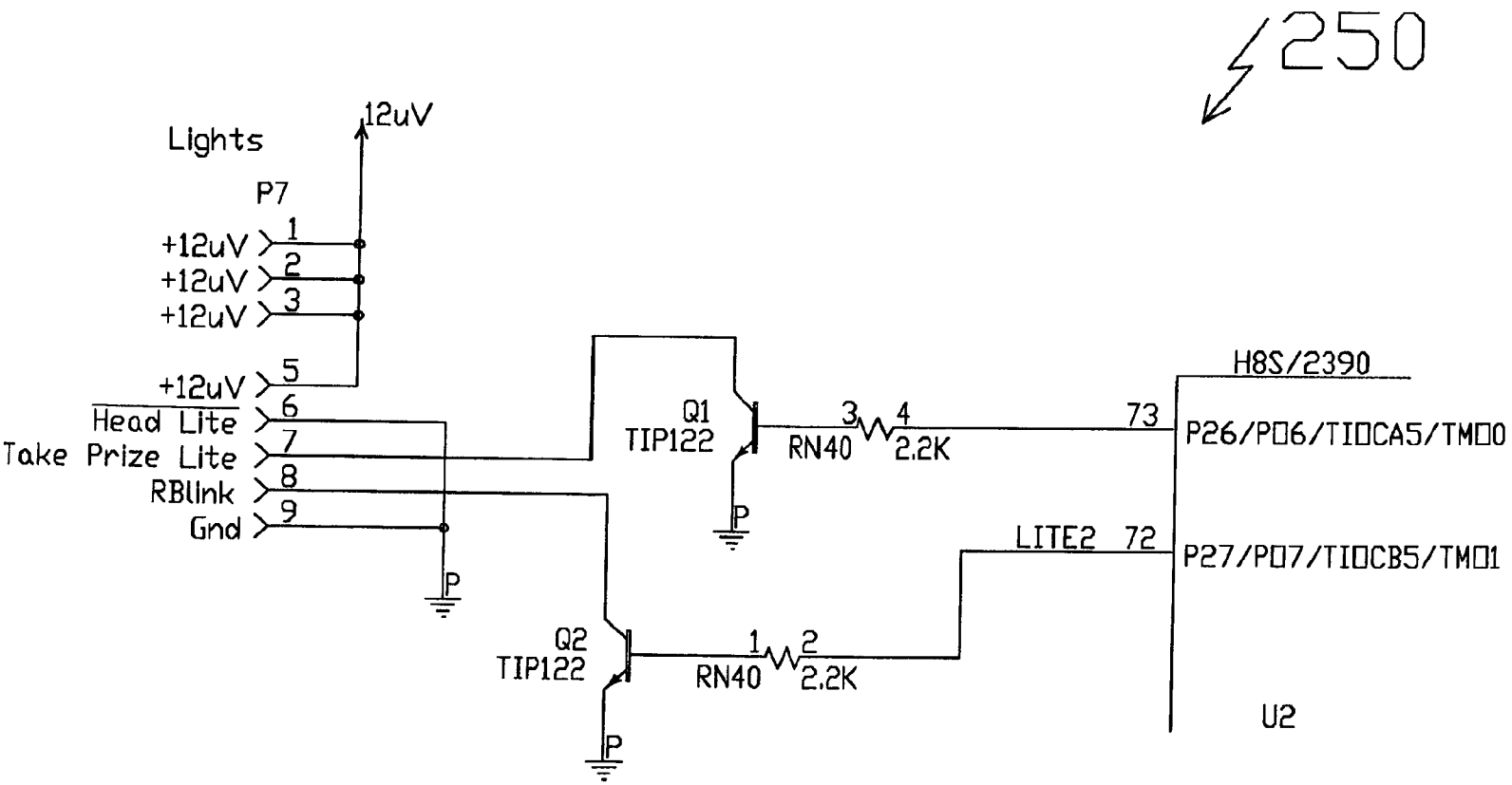
FIG. 36 is a schematic diagram of the high current light control.
Figure 37:
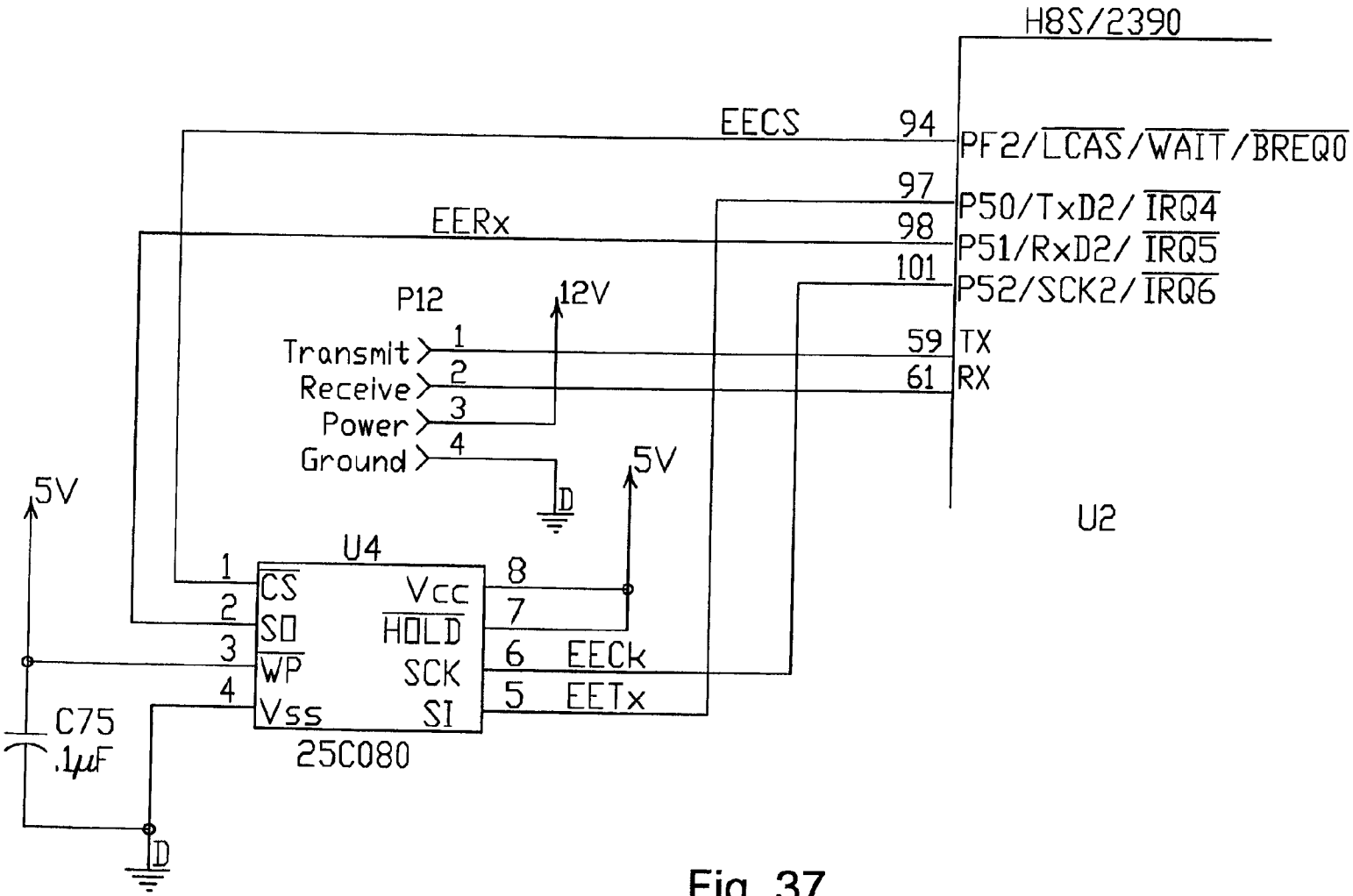
FIG. 37 is a schematic diagram of the nonvolatile memory.

The connectors on the main board also include a plurality of output connections. As shown in FIG. 33, circuit section 220 comprises connector P9. This connector includes outputs Speaker+ and Speaker− for the audio speaker connection. Connector P7, shown in FIG. 36, is part of circuit section 250, and includes provisions for connecting light outputs at LBlink and RBlink. Connector P3, shown in FIG. 28, is part of circuit section 260, and includes provisions for output signal TRUN which tells the ticket dispenser to operate.

Figure 35:
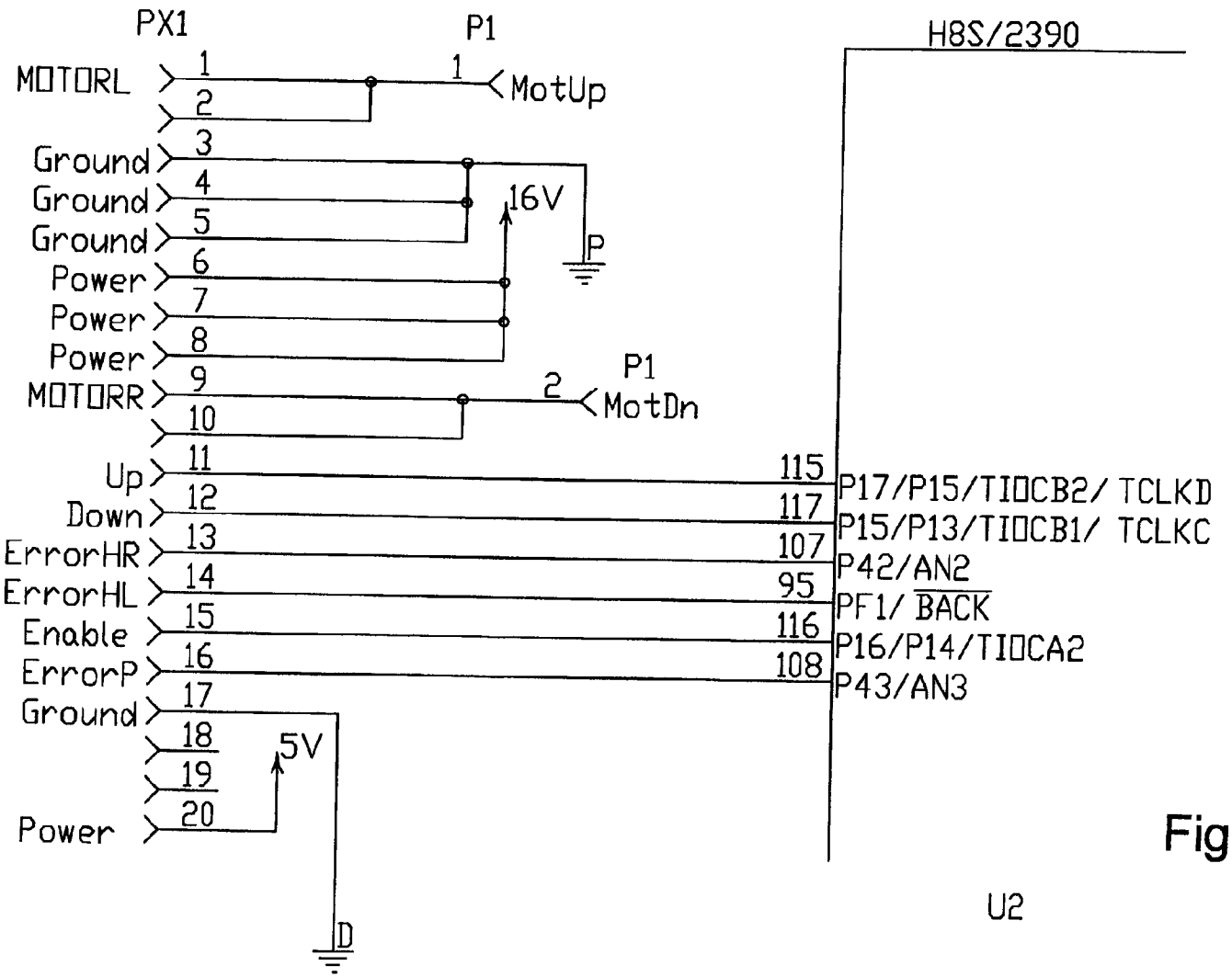
FIG. 35 is a schematic diagram of the up/down daughter board interface.
Figure 41:
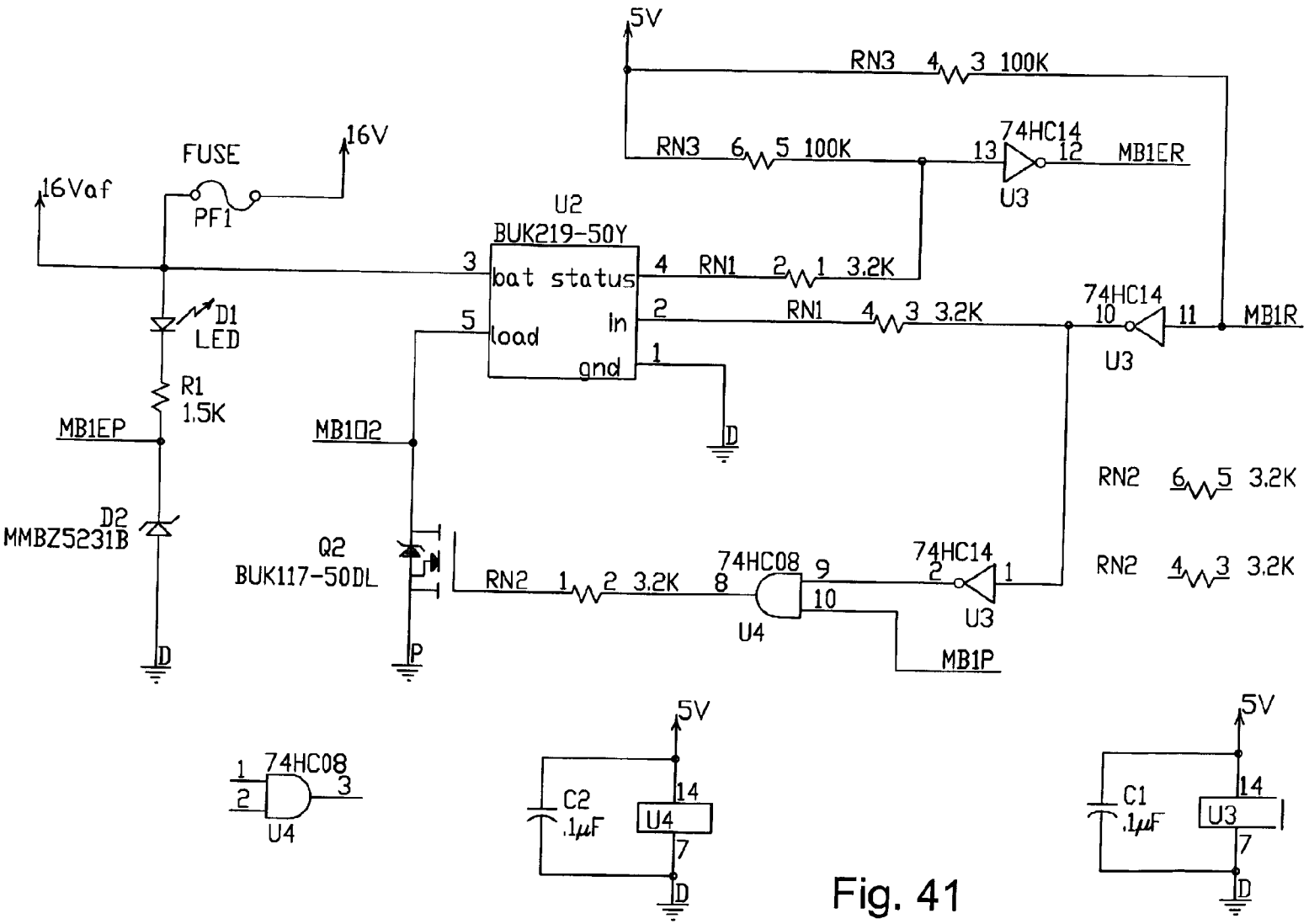
FIG. 41 is a schematic diagram illustrating the right half of the H-bridge driver controller board.
Figure 42:
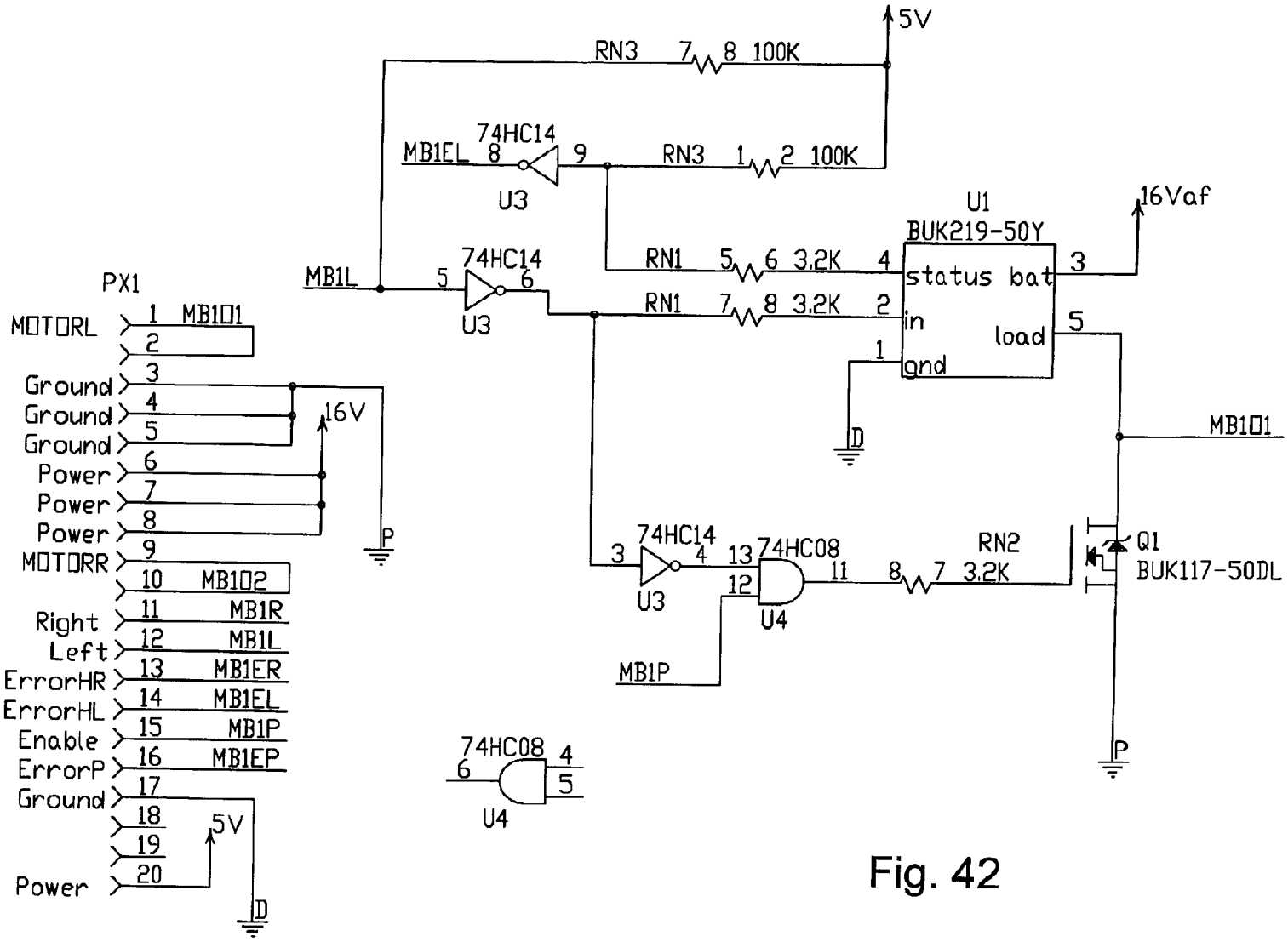
FIG. 42 is a schematic diagram illustrating the left half of the H-bridge driver controller board and connection for same.

Motor up/down drive connections are shown in FIG. 35. Drive currents MotUp and MotDn leave connector P1 for the up/down motor as shown in FIG. 35. In operation, the microprocessor sends control signals via connector PX1 to the motor daughter board, the circuit of which is shown in FIGS. 41 and 42. In turn, the daughter board sends appropriate drive currents back to the main board at PX1, and motor drive currents leave the main board at P1 to control the up/down motor.

Figure 29:
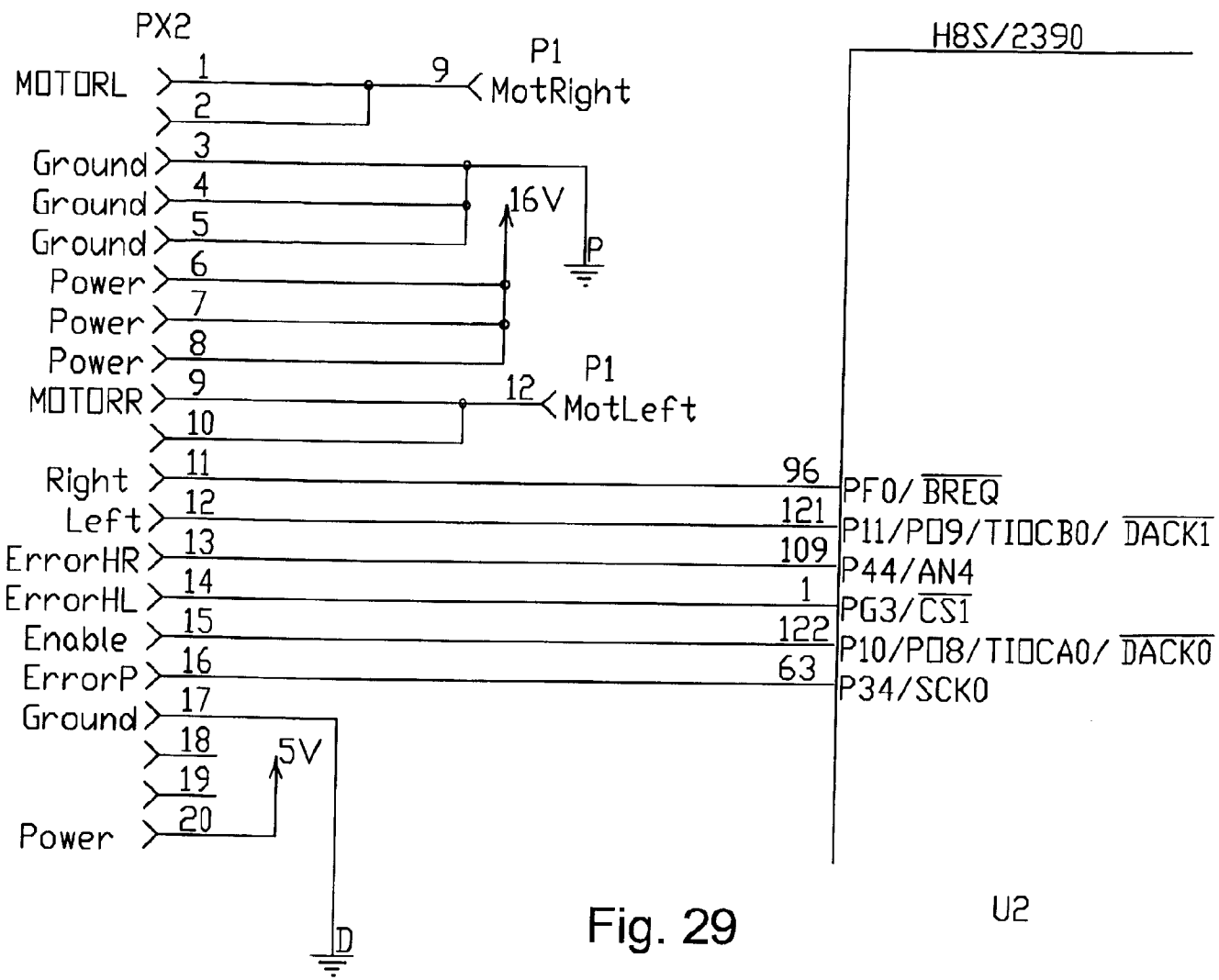
FIG. 29 is a schematic diagram of the left/right daughter board interface.
Figure 30:
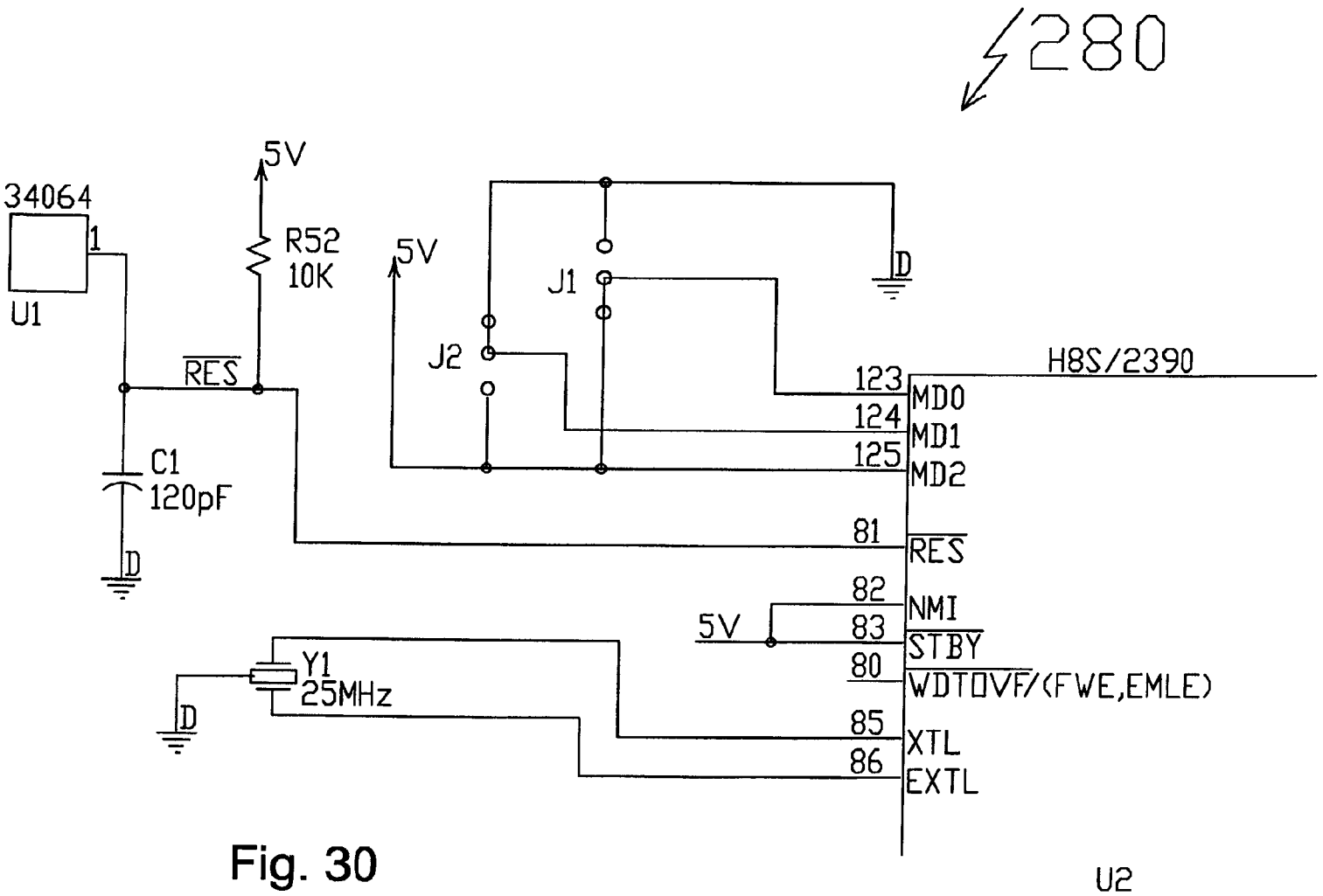
FIG. 30 is a schematic diagram of the microprocessor reset, crystal and control.
Figure 31:
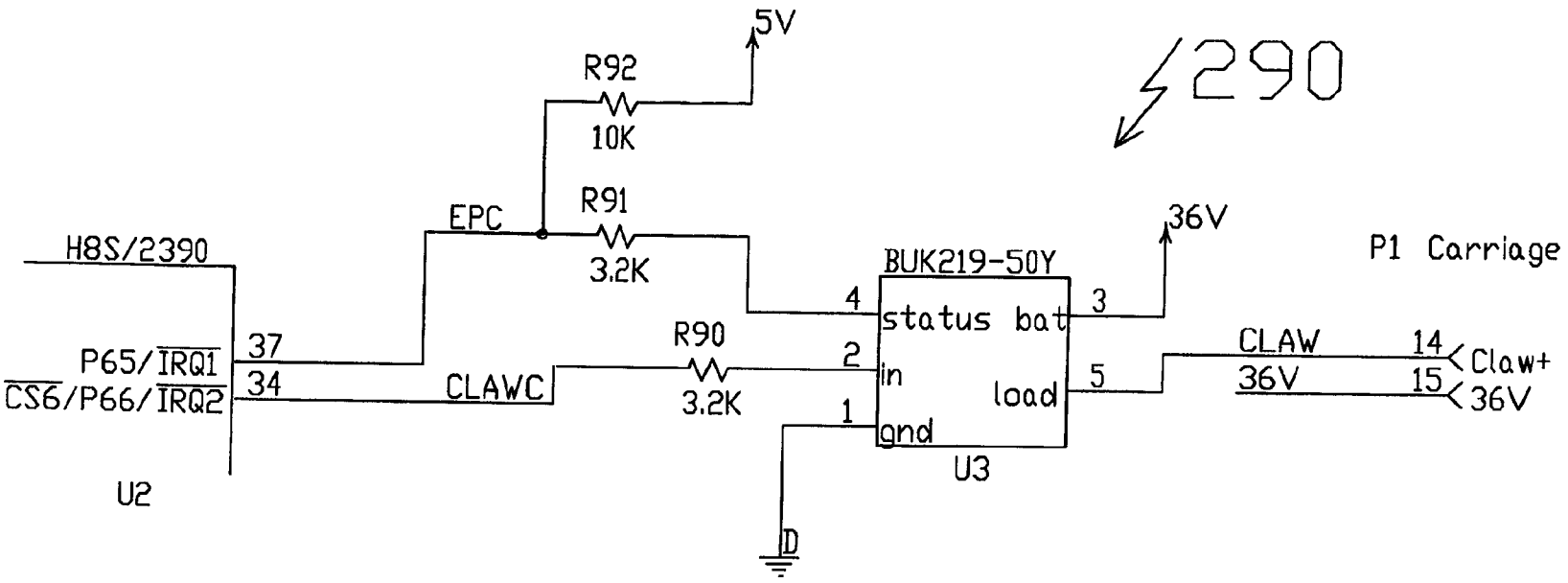
FIG. 31 is a schematic diagram of the claw control.
Figure 32:
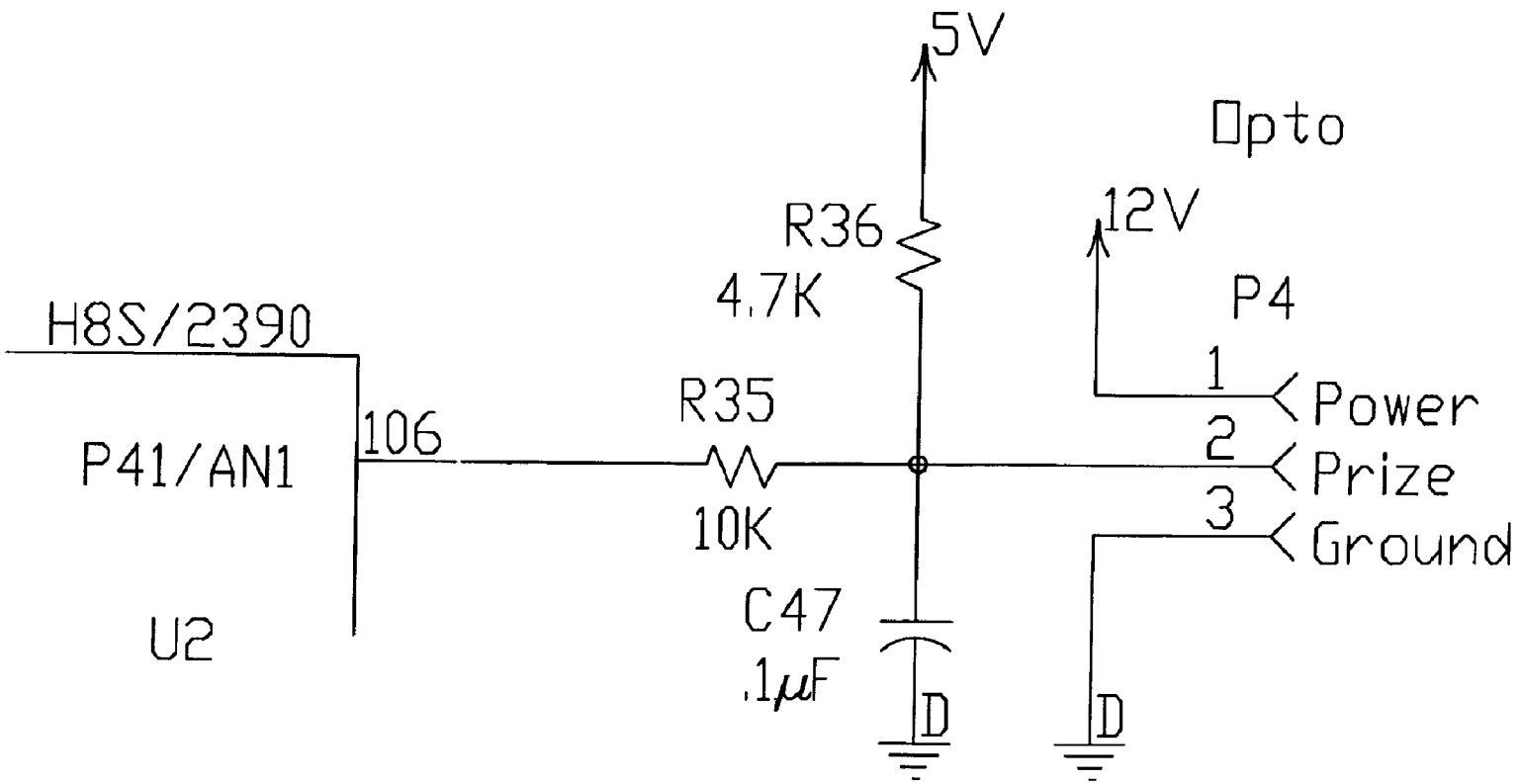
FIG. 32 is a schematic diagram of the prize detector interface to the main board.

Motor left/right drive connections are shown in FIG. 29. Drive currents MotRight and MotLeft leave connector P1 for the up/down motor as shown in FIG. 29. In operation, the microprocessor sends control signals via connector PX2 to the motor daughter board, the circuit of which is shown in FIGS. 41 and 42. In turn, the daughter board sends appropriate drive currents back to the main board at PX2, and motor drive currents leave the main board at P1 to control the left/right motor.

Figure 34:
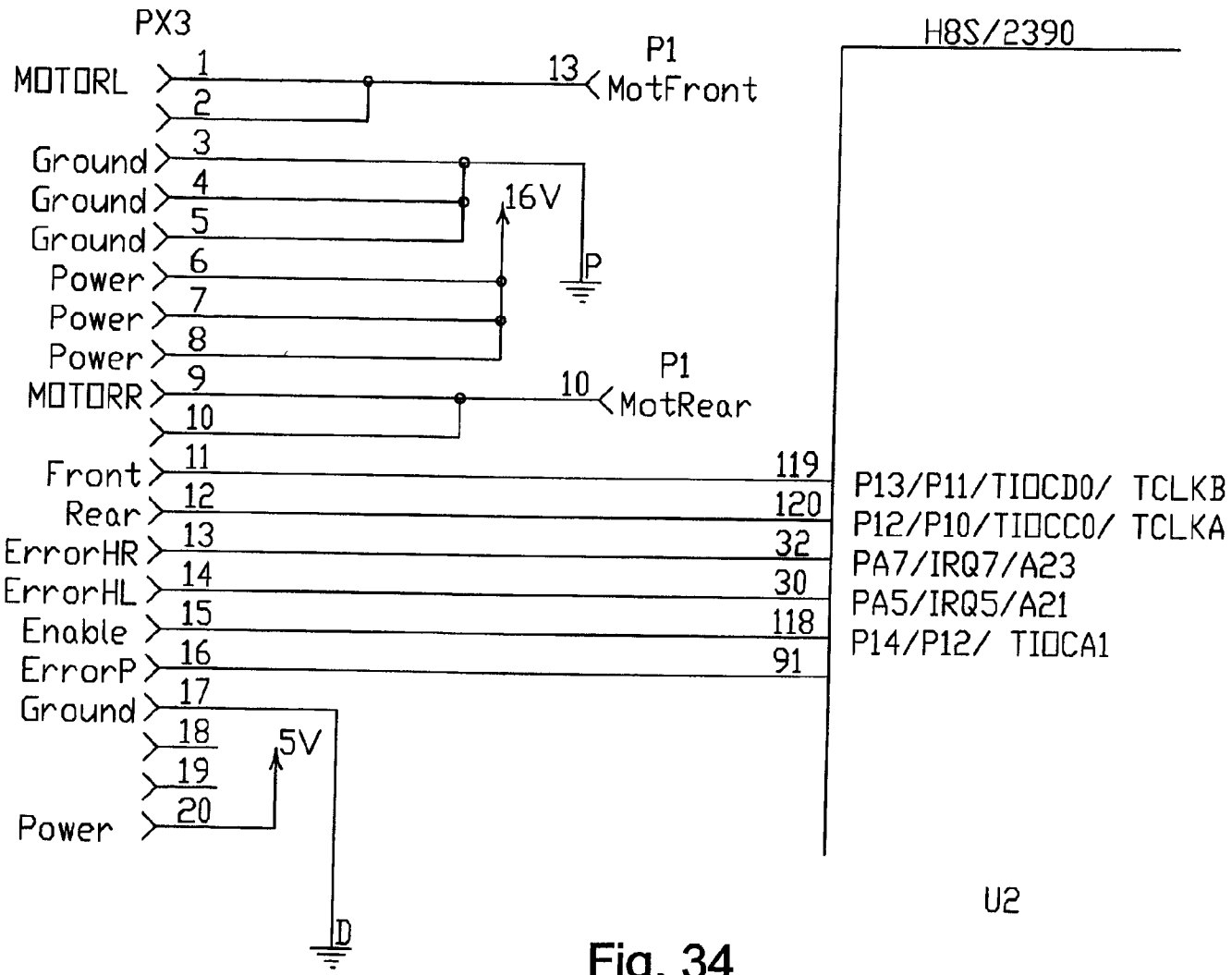
FIG. 34 is a schematic diagram of the front/back daughter board interface.

Motor front/rear drive connections are shown in FIG. 34. Drive currents MotFront and MotRear leave connector P1 for the front/rear motor as shown in FIG. 34. In operation, the microprocessor sends control signals via connector PX3 to the motor daughter board, the circuit of which is shown in FIGS. 41 and 42. In turn, the daughter board sends appropriate drive currents back to the main board at PX3, and motor drive currents leave the main board at P1 to control the front/rear motor.

Figure 39:
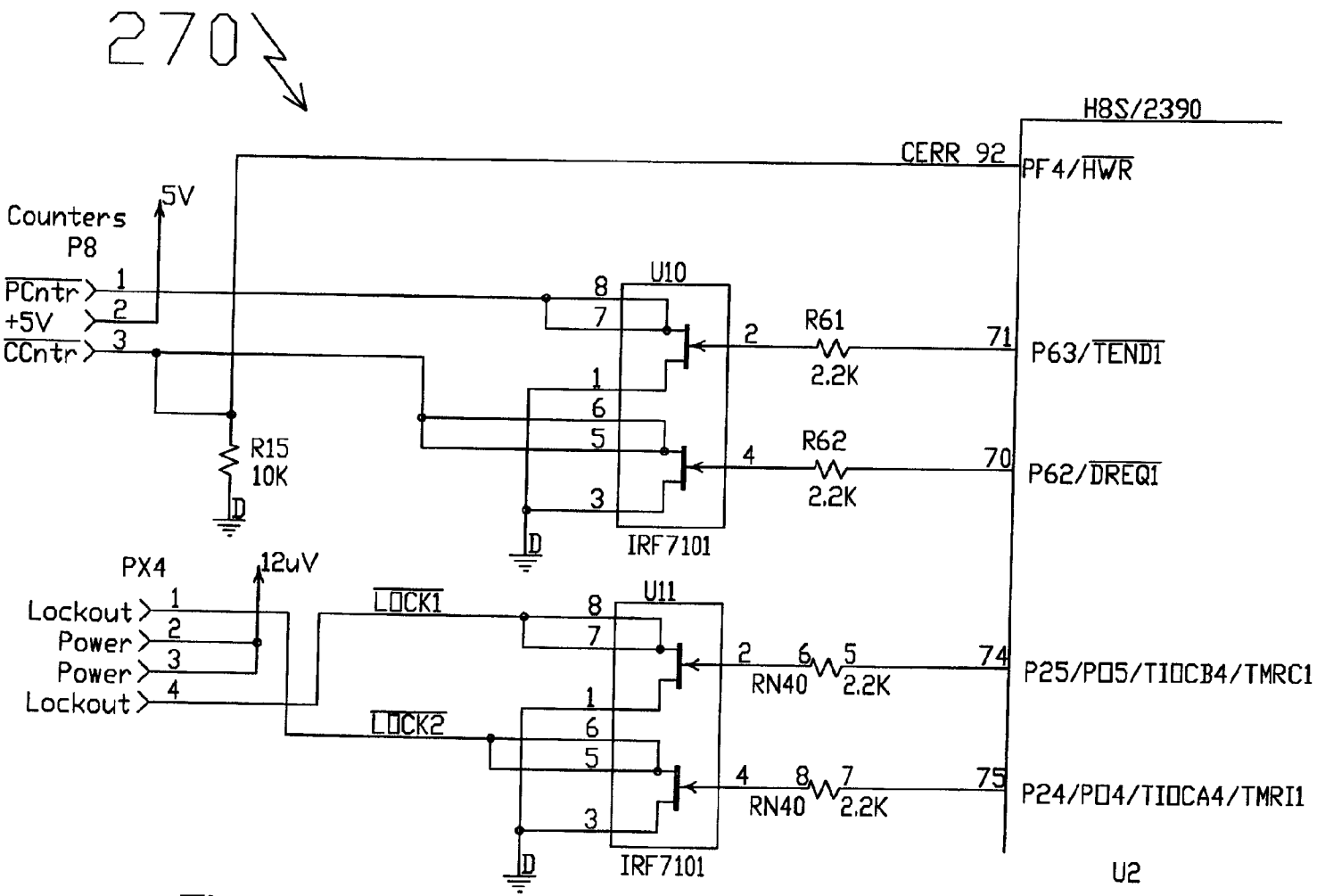
FIG. 39 is a schematic diagram of the counters and lockout control.
Figure 40:
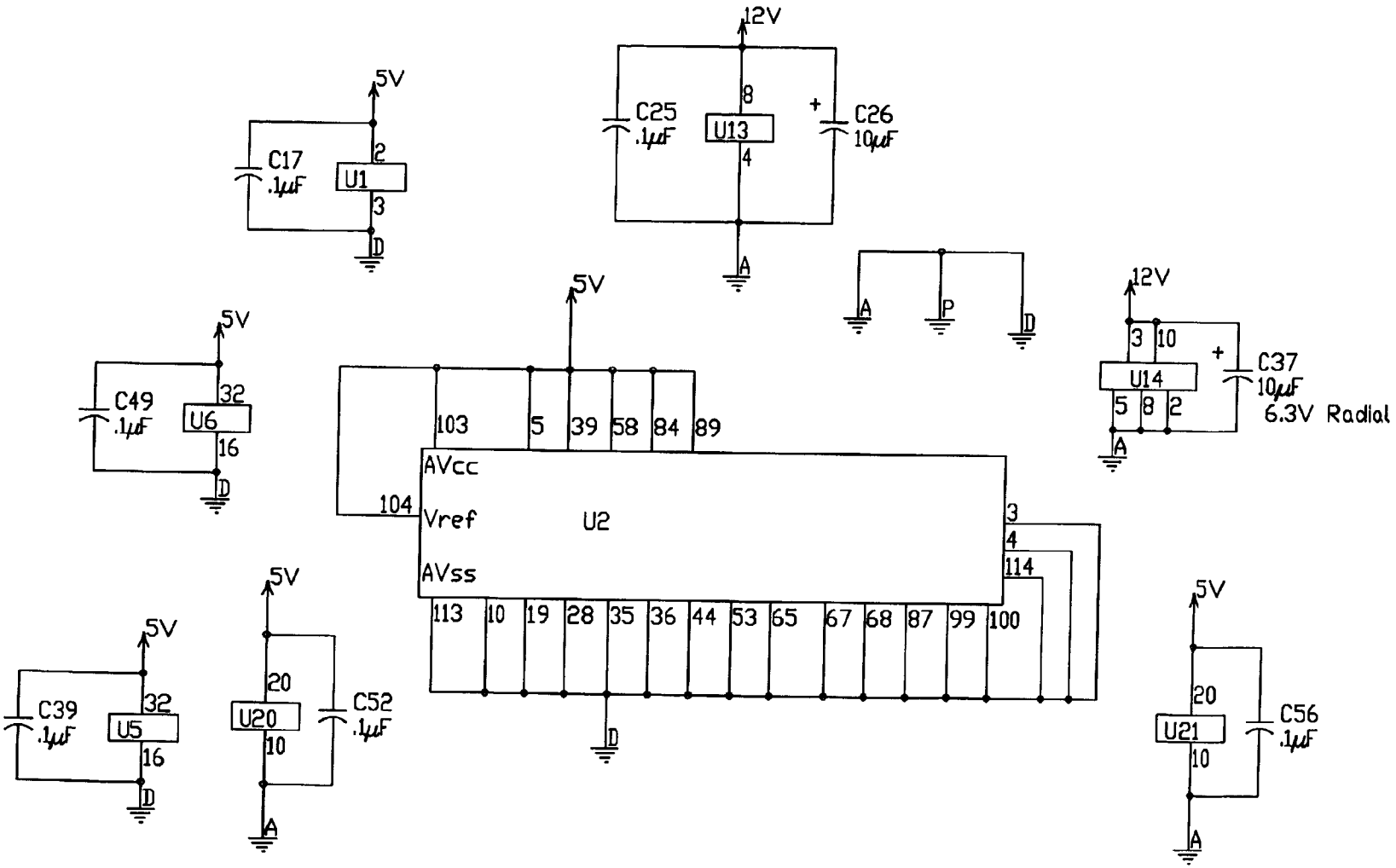
FIG. 40 is a schematic diagram of the power and ground connections for the integrated circuit chips on the main board.

Circuit section 270 includes connector PX4, (shown in FIG. 39). Connector PX4 includes two lockout output signal connections (labeled "Lockout") to energize lockout coils to prevent coins from being accepted in the coin slots. For example, in certain jurisdictions, such as New Jersey and California, it is not permitted to allow the machine to build up credits, and the coin slot mechanism must be deactivated until the current credit is used.

Also shown in FIG. 39 is connector P8 (part of circuit section 270) which includes two output signal connections, PCntr, which is a "plush" or "prize" counter to count the number of prizes awarded, and CCntr, which is a coin counter signal. For example, an owner/operator of the game can use these signals to determine how many coins were taken in and how many prizes were awarded.

Finally, output display signal connections are made at connector P6. The game includes LED displays to indicate the number of credits remaining, as well as a time counter which, in a preferred embodiment, counts down as the game is in progress.

Miscellaneous Circuit Elements

Circuit section 280 comprises circuit element U1, a reset circuit which functions to ensure that supply voltage to the processor is adequate; otherwise the processor is disabled. In a preferred embodiment, ceramic resonator Y1 provides a 25 MHz clock signal to the microprocessor. Circuit section 250 (Shown in FIG. 36) comprises transistors Q1 and Q2, operatively arranged to driver lights, which are optional in the game. Circuit section 290 comprises drive transistor U3 (Shown in FIG. 31), operatively arranged to provide power to the claw (at 36V). Circuit section 260 (Shown in FIG. 28) comprises diagnostic LEDs D10–D14, operatively arranged to provide diagnostic feedback to the operator.

Electrical Operation During Game Play

Figure 19A:
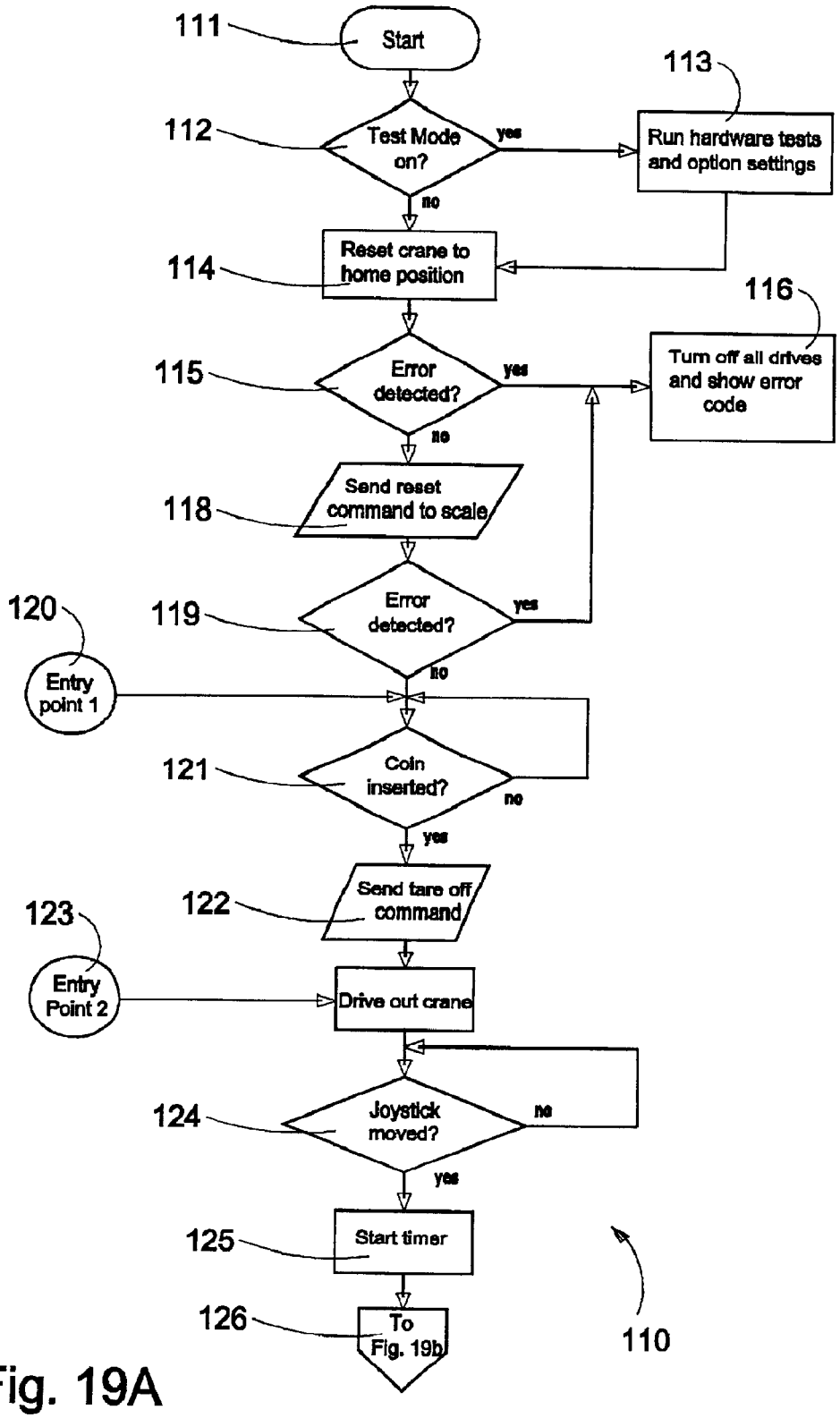
FIG. 19*a* is a flow chart which illustrates operation of the game of the invention.
Figure 19B:
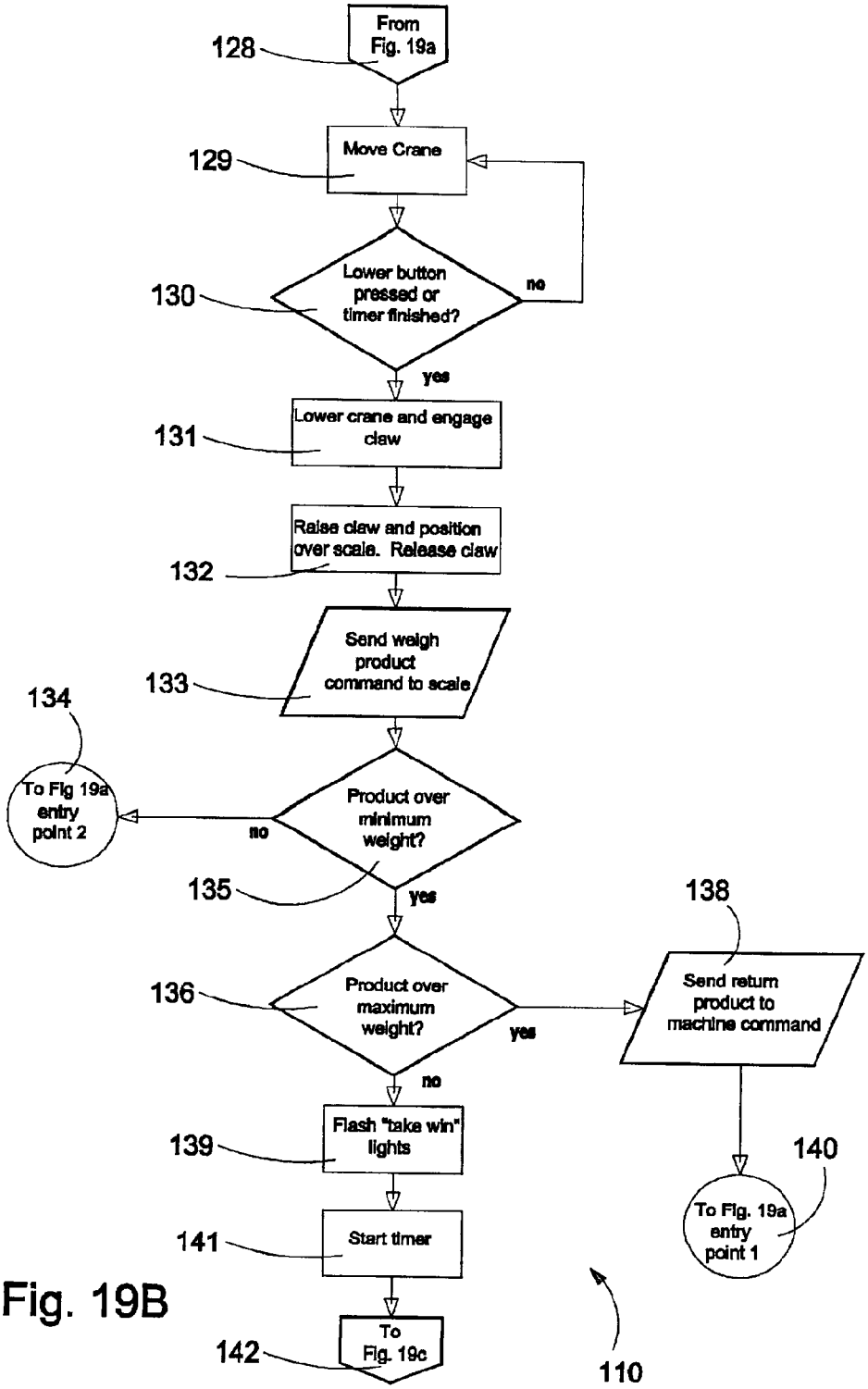
FIG. 19*b* is a continuation of the flow chart of FIG. 19*a;*
Figure 19C:
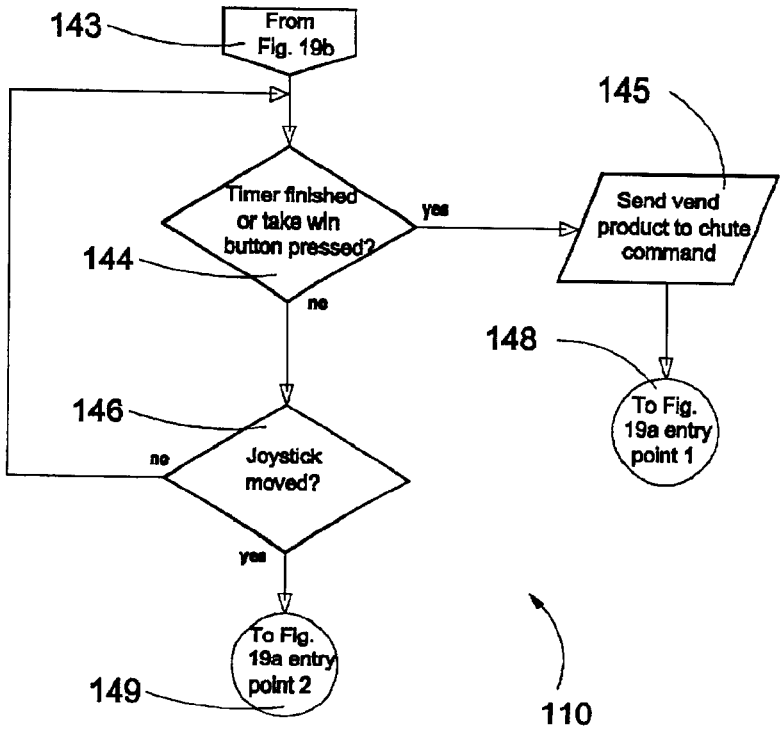
FIG. 19*c* is continuation of the flow chart of FIG. 19*b;*
Figure 20A:
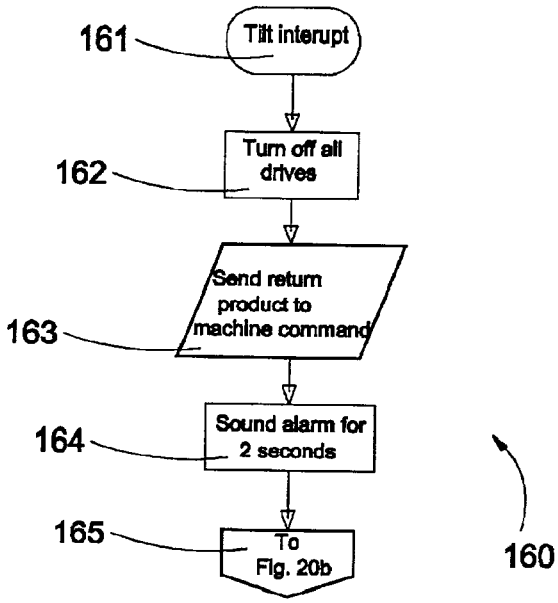
FIG. 20*a* is a flow chart of the tilt interrupt mechanism of the invention.
Figure 20B:
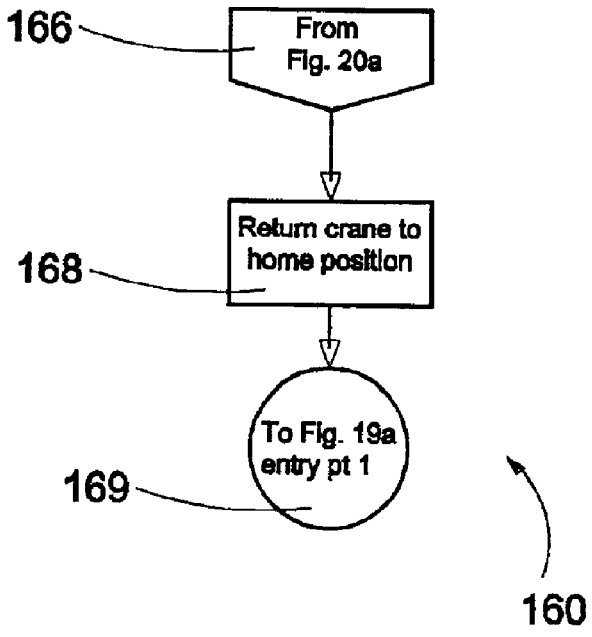
FIG. 20*b* is a continuation of the flow chart of FIG. 20*a;*
Figure 21:
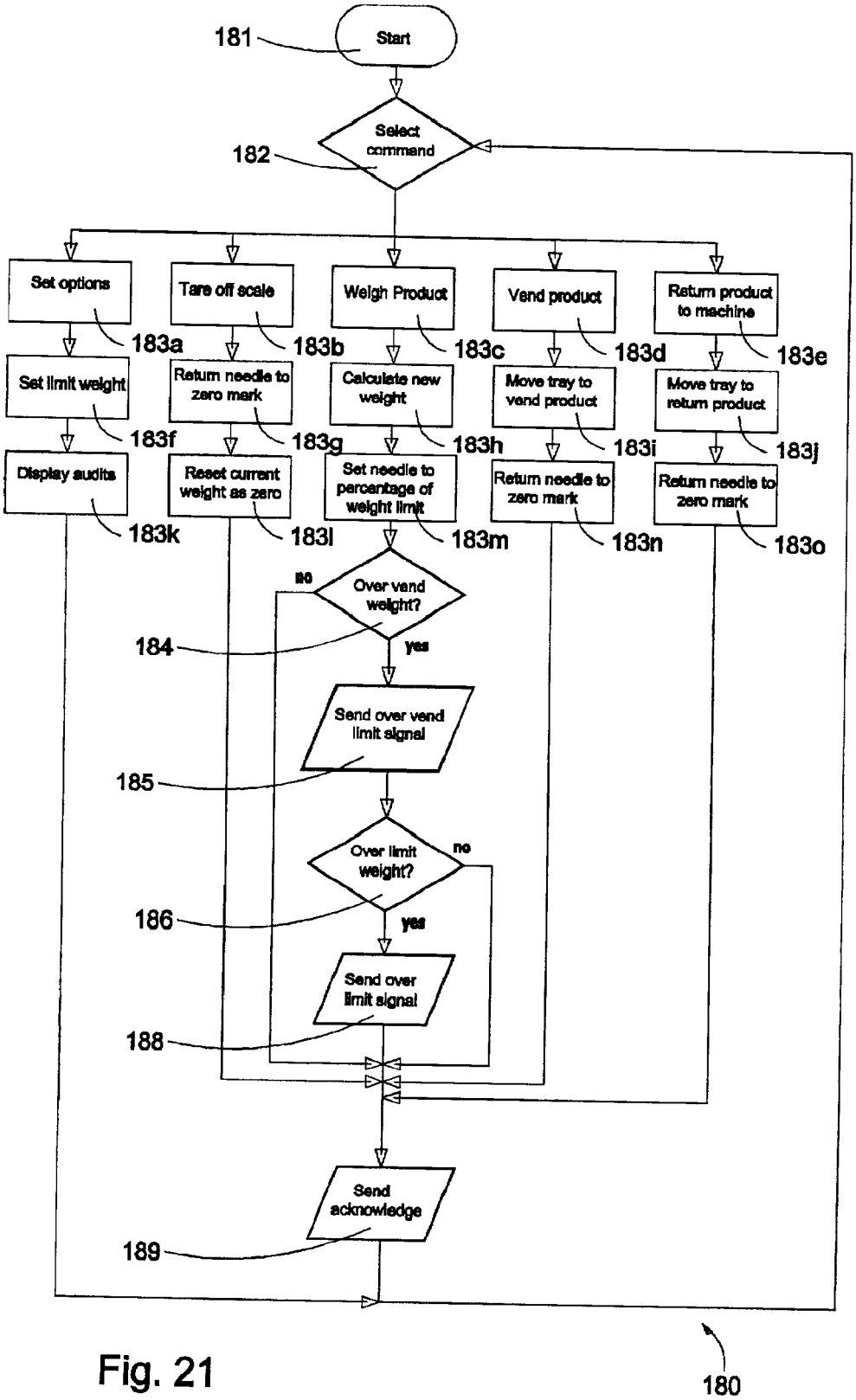
FIG. 21 is a flow chart which illustrates operation of the scale of the invention.

Adverting now to FIGS. 19*a*–21; which are flow diagrams of the amusement game; prior to start 111 of a game, the game can be programmed to maintain an "attract" mode. While in the attract mode, the gantry assembly, the crane assembly and the claw assembly maintain the "Home" position and the game emits sounds, or displays various lights in an effort to attract game players. Also, prior to the start of a game, the test mode 112 can be enabled to allow the game to conduct diagnostic tests of its mechanical and electronic components. As shown in FIG. 19*a*, when the test mode is toggled, the game is instructed to run hardware tests 119 and review options settings. The game then resets the gantry, crane and claw assemblies to the "Home" position 114. If a critical error is detected 115, all game drives are turned off and an error code is displayed 116 on display 38. If no errors are detected, the reset scale command is sent to the scale. Where the test mode indicates that everything is in proper working order the gantry, crane, and claw assemblies remain in the "Home" position.

To commence a game, a player inserts money or tokens into the game in one of three ways. In a preferred embodiment, the money is inserted into either first coin slot, a second coin slot, or the dollar bill validator. All of these devices, as indicated above, send appropriate signals to the motherboard from the front door via connector P9 (at pins 6, 14 and 10, respectively). These coin/dollars signals are active low signals (which means the signals go from +5V to ground). This signal is communicated to the microprocessor, which detects insertion of a coin or credit, and initiates a "money insert" sound. Once the preprogrammed "cost of game" amount has been detected by the microprocessor (it make take a plurality of coins to reach this amount) 121, the game is started. Once the game is activated the microprocessor sends appropriate signals to connector PX4 to turn off the lockout devices. If lockout coils are attached, they prevent any further coins from being inserted. This is required in certain jurisdictions.

At this point, the game starts to play background music, if preprogrammed to do so, and the gantry and crane centers itself in the "Home" position, generally indicated by reference number 123. The music is stored in a digital format in the EPROMs, converted to analog signals in the microprocessor and output at pin 111 (AUDIO) to the audio amplifier (U13). In a preferred embodiment, the "centering" position of the gantry, crane and claw is shown in FIG. 8, although this position is programmable. Centering is accomplished by left/right and translational movement of the gantry and crane, which motor control will become clear from the following description of circuit operation during game play.

During game play, the player moves the joystick in the general direction that she wishes the claw to move. The joystick is coupled to sensing switches that, in turn, send signals to the main board. The microprocessor interprets and processes these signals and sends appropriate control signals to control the up/down motor, left/right motor, and front/rear motor, respectively. To control the up/down motor, appropriate enabling and directional signals are sent from the microprocessor to connector PX1, which, in turn, sends appropriate up/down control signals to the up/down motor daughter control board. To control the left/right motor, appropriate enabling and directional signals are sent from the microprocessor to connector PX2, which, in turn, sends appropriate left and right control signals to the left/right motor daughter control board. To control the front/rear motor, appropriate enabling and directional signals are sent from the microprocessor to connector PX3, which, in turn, sends appropriate front and rear control signals to the front/rear motor daughter control board.

From the centered position shown in FIG. 8 to the position shown in FIG. 9, the joystick would be moved leftwardly and frontwardly, causing leftward and frontward movement of the gantry. Electronically, a "JoyLt" signal would be received at connector P9, that tells the microprocessor that the joystick has been moved leftwardly, and a "JoyFront" signal would be received at connector P9, that tells the microprocessor that the joystick has been moved frontwardly. The microprocessor, in turn, sends appropriate enabling and directional signals to PX2, instructing left/right movement of the left/right motor. Similar "JoyRt" and "JoyRear" signals would be received at connector P9 to effect movement in the rightward and rearward directions, respectively. It should be appreciated that the player can move, at her option, in more than one direction (front-left, rear-left, front-right, rear-left) at a time, or may move the gantry in a first direction, and then a second direction, etc.

As shown in FIG. 2, once the player has positioned the claw above a desired prize, she then presses pushbutton 35 on the joystick which, in turn, sends a signal JoyBtn to connector P9. This signal is processed by the microprocessor, which, in turn, sends appropriate enabling and directional signals to connector PX1, instructing the up/down motor (via its daughter board) to cause translational movement of the claw in the down direction, as shown in FIG. 2. As the claw proceeds downwardly, the claw is in an open position. This downward movement of the claw continues, in a preferred embodiment, until the claw contacts a desired prize, or any obstacle (e.g., game platform), at which point a sensor, operatively arranged to sense slack (or degree of tautness) in a cable or string, which supports the claw, sends a ClawDn signal to connector P1, which signal passes through its filter network to become filtered signal CD. This signal is sent to pin 78 of U2. U2 then desserts signal Down to stop the claw from moving down. Immediately after stopping the claw downward movement, the claw closes as shown in FIGS. 3 and 11. To close the claw, a signal CLAWC is sent from pin 34 of U2 to U3, which, in turns provides the necessary 36V signal to pin 14 (CLAW) of connector P1, closing the circuit to energize the coil in the claw, thereby closing the coil.

After a preprogrammed time (of approximately 1 second), the claw is programmed to travel in the upward direction. This is accomplished by the processor asserting the Up signal at pin 115, which transfers the appropriate signal to PX1, which transfers the appropriate signal to the up/down motor control daughter board to move the claw upwardly (via appropriate signals at connector P1 for MotUp). The claw continues in an upward direction until signal ClawUp is asserted at pin 4 of P1, which is interpreted via the CU signal of the filter network by the microprocessor (pin 79), and then processed by the microprocessor to stop the upward movement.

At this point, depending on the position of the claw at the time of grabbing the prize, the microprocessor sends appropriate signals and output commands to position the crane and claw directly over the scale (Home position, as shown in FIG. 3). The microprocessor "knows" the crane is in its Home position when a first signal is asserted at the HomeL/R pin of connector P1, which means it is Home (from a leftward/rightward perspective), and when a signal is asserted at the HomeF/R pin of connector P1, which means it is translationally Home (from a front/rear perspective). At this point, the CLAWC signal is de-asserted (after about a one second wait), removing power from the claw, causing the claw to open due to the spring and weight, thereby releasing any prize held in the claw onto the scale plate.

Once prizes/objects are placed on the scale plate, there is a brief time delay to allow the scale to stabilize. The processor then transmits a command to the scale circuitry to obtain the current weight of the prizes/objects. Commands are sent to the scale circuit via pin 59 of U2 through pin 1 of connector P12 (Shown in FIG. 37). Replies from the scale circuit to the main processor are returned through pin 2 of P12 into pin 61 of U2. A digital packet of information pertaining to the weight of the prizes/objects is returned to the main processor. Based upon the weight information, the main processor then evaluates the weight and determines whether the weight of the prizes/objects falls within the "take win" range and transmits a command to the scale circuitry for positioning the needle indicator.

In a preferred embodiment, where the processor evaluates a weight which falls below the programmed "take win" range 31 (See FIG. 3), play continues and additional prizes/objects may be added upon scale plate 21. Where the processor evaluates a weight above the programmed "take win" range, the player loses and a command is transmitted from the main processor to the scale processor to move the prize/object gate to the right and return prize/objects to the game platform, which ends game play (Shown in FIG. 6). Where the processor evaluates a weight within the "take win" range, the player is allowed to continue play or take the prizes/objects. At this point, the main processor asserts pin 73 of U2 in FIG. 36 (circuit section 250), which turns on transistor Q1 enabling the range light display 33. Moving the joystick while the weight remains within the "take win" range signals the processor of the player's intention of continuing play. Where a player chooses to take their win, depressing "take win" button 35 activates pin 33 (Shown in FIG. 38) of U2, which commands the scale circuit to dispense the prizes/objects, which causes the prize/object fence to move to the left. After moving to the left or the right, the prize/object gate then returns to its centered position above the scale plate.

Operating options are stored in U4 (shown in FIG. 37) and are communicated with the main processor via pins 94, 97, 98, and 101 of U2. These devices use the industry standard SPI method of communication for storing and retrieving nonvolatile information.

Scale Board

Figure 47:
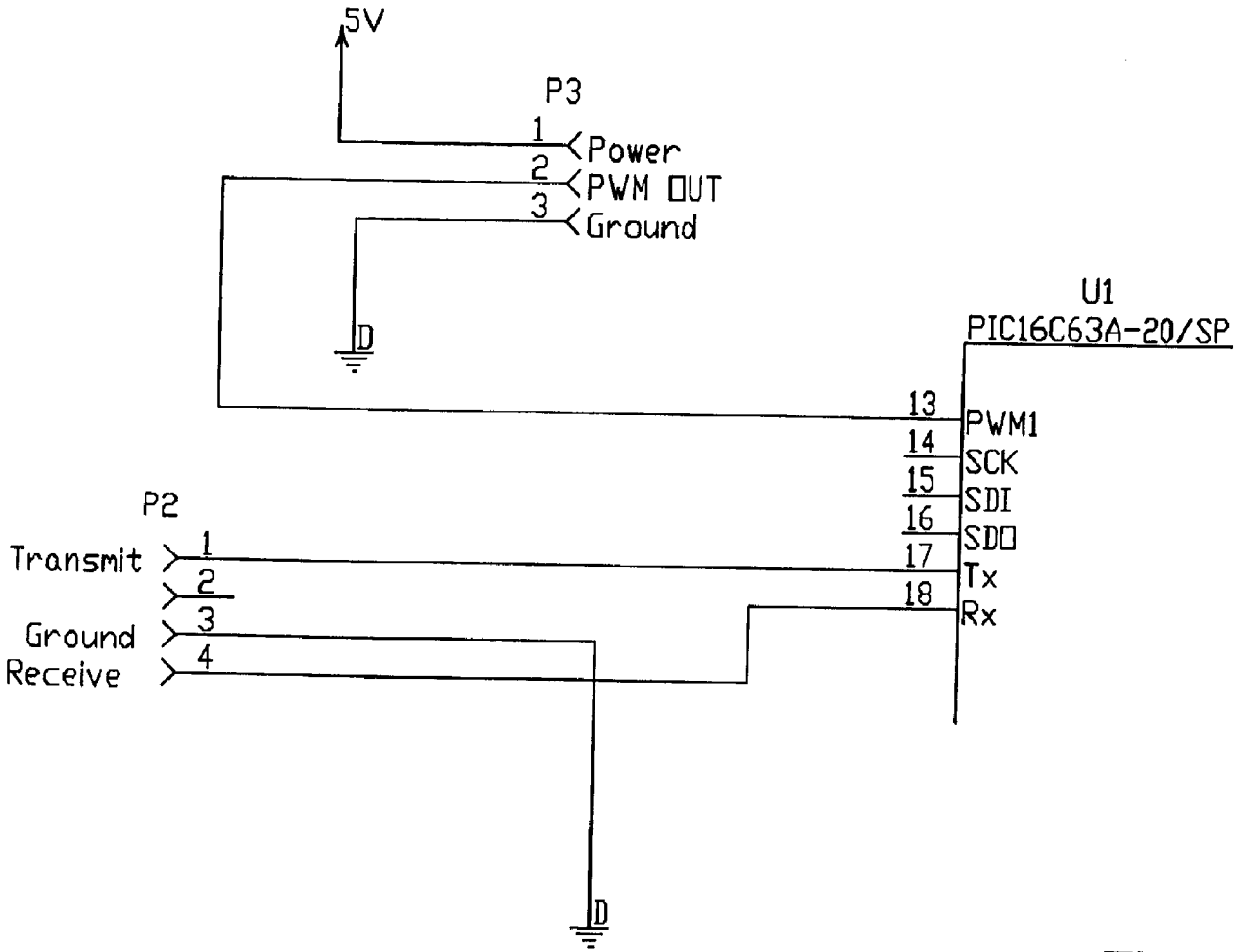
FIG. 47 is a schematic diagram illustrating the between the communications connector and the microprocessor and the needle indicator motor.

Commands from the main processor arrive at pins 1 and 4 of connector P2 as shown in FIG. 47, which are connected to the send and receive pins 17 and 18, respectively, of U1.

Figure 46:
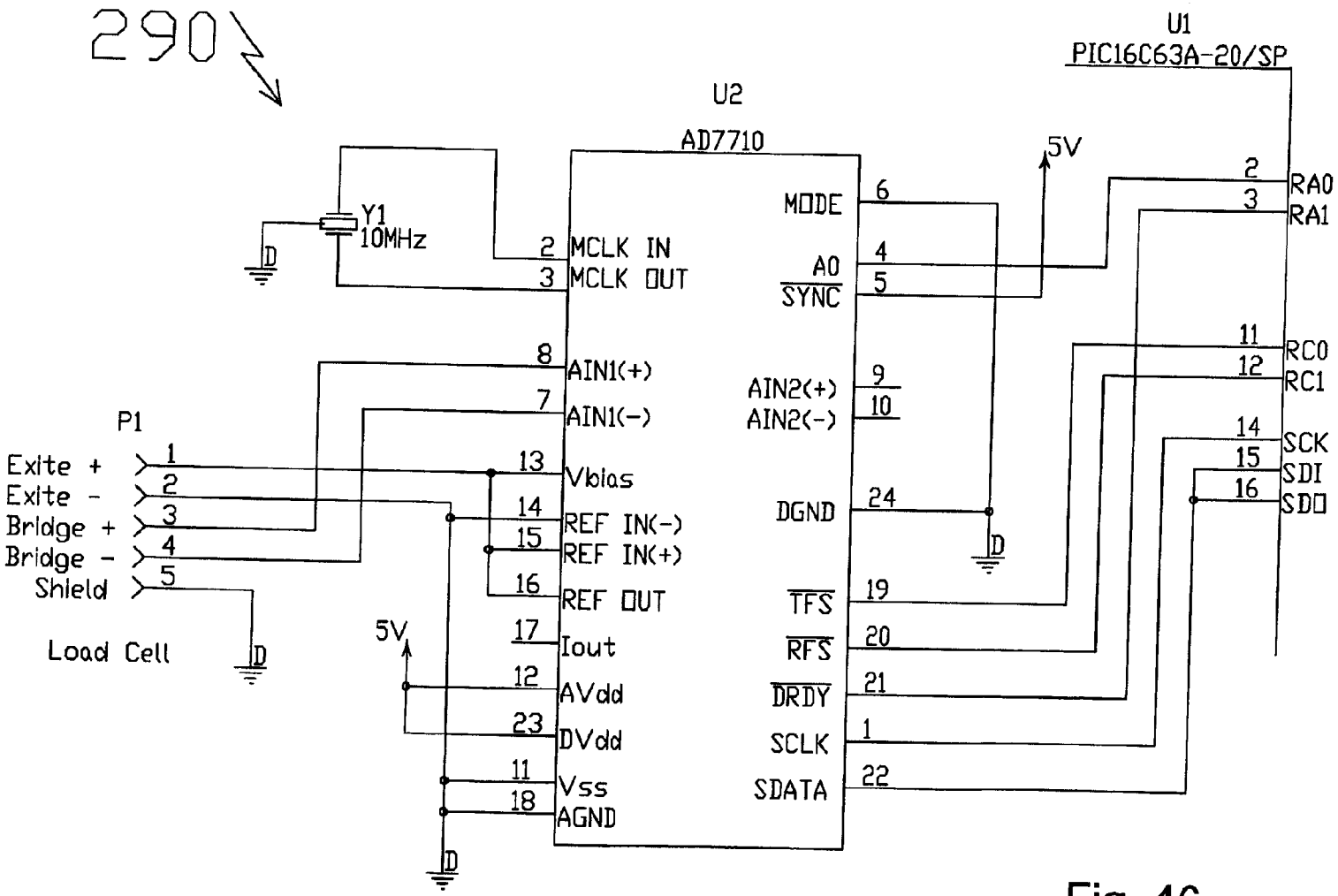
FIG. 46 is a schematic diagram illustrating the connections of the load cell A/D converter to the microprocessor.

When the scale processor receives the "get weight" command from the main processor, it performs several processes to obtain the "weight" information. Scale circuit section 290 is shown in FIG. 46, which illustrates the load cell connections to the A/D converter (U2). The weight of prizes/objects placed on scale plate 21, which is connected to load cell 92 (as shown in FIG. 22), presents a unique voltage at pins 3 and 4 of connector P1. The very small changes in voltage are amplified and converted into a stream of digital information by U2. Commands are sent using pins 2, 3, 11, 12 and 16 from U1 to U2 to obtain a digital weight representation. This information is then transferred to U1 via pins 14, 15 and 16 by means of digital data packets and stored within scale processor U1. This information is relayed back to the main processor, finishing the "get weight" command.

The "position needle" command from the main processor causes the scale processor to position the needle indicator. As shown in FIG. 47, pin 2 of connector P3, a variable duty cycle signal is presented by pin 13 of U1.

Figure 48:
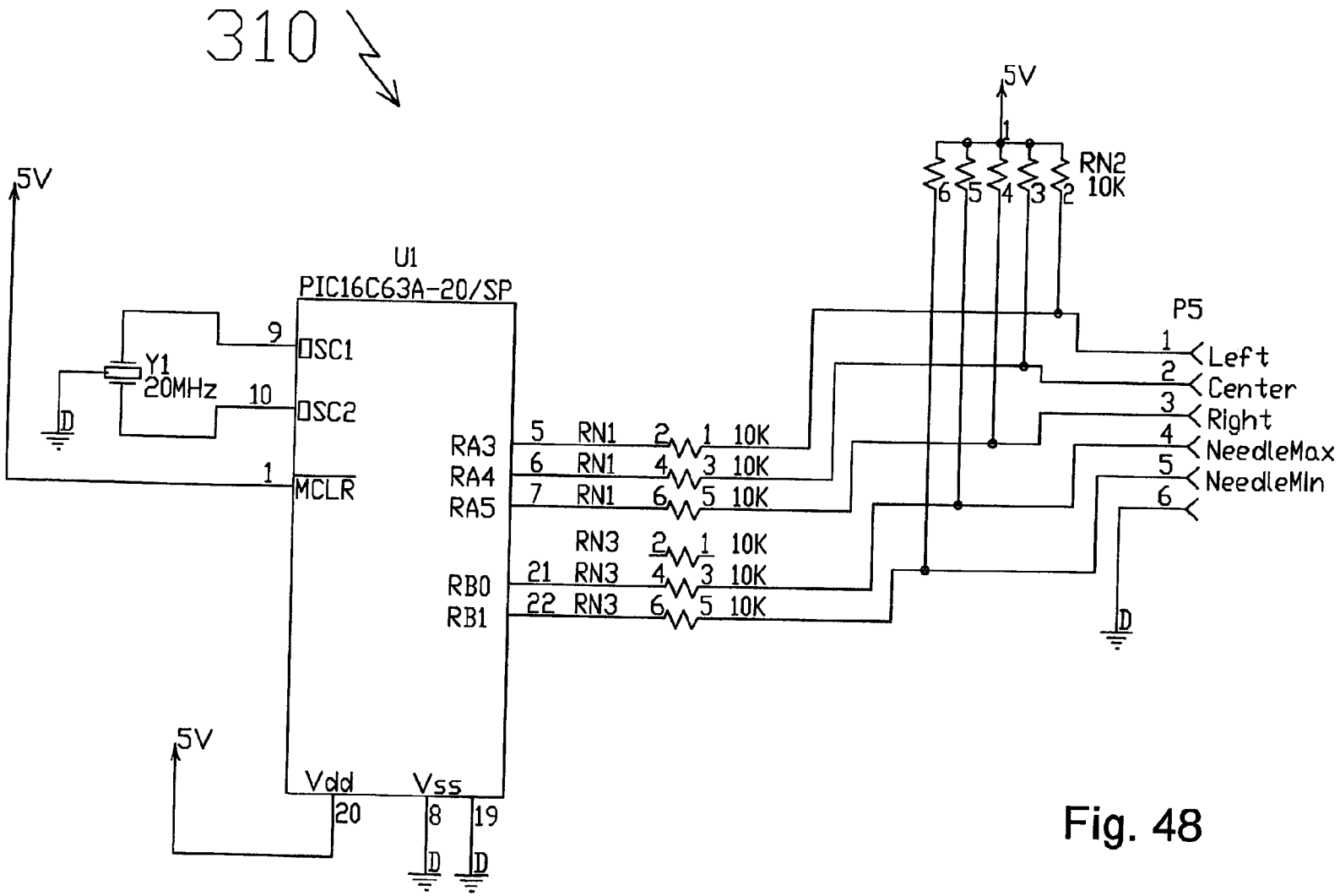
FIG. 48 is a schematic diagram illustrating the processor and the motor positional inputs for the prize/object gate and the needle indicator.
Figure 50:
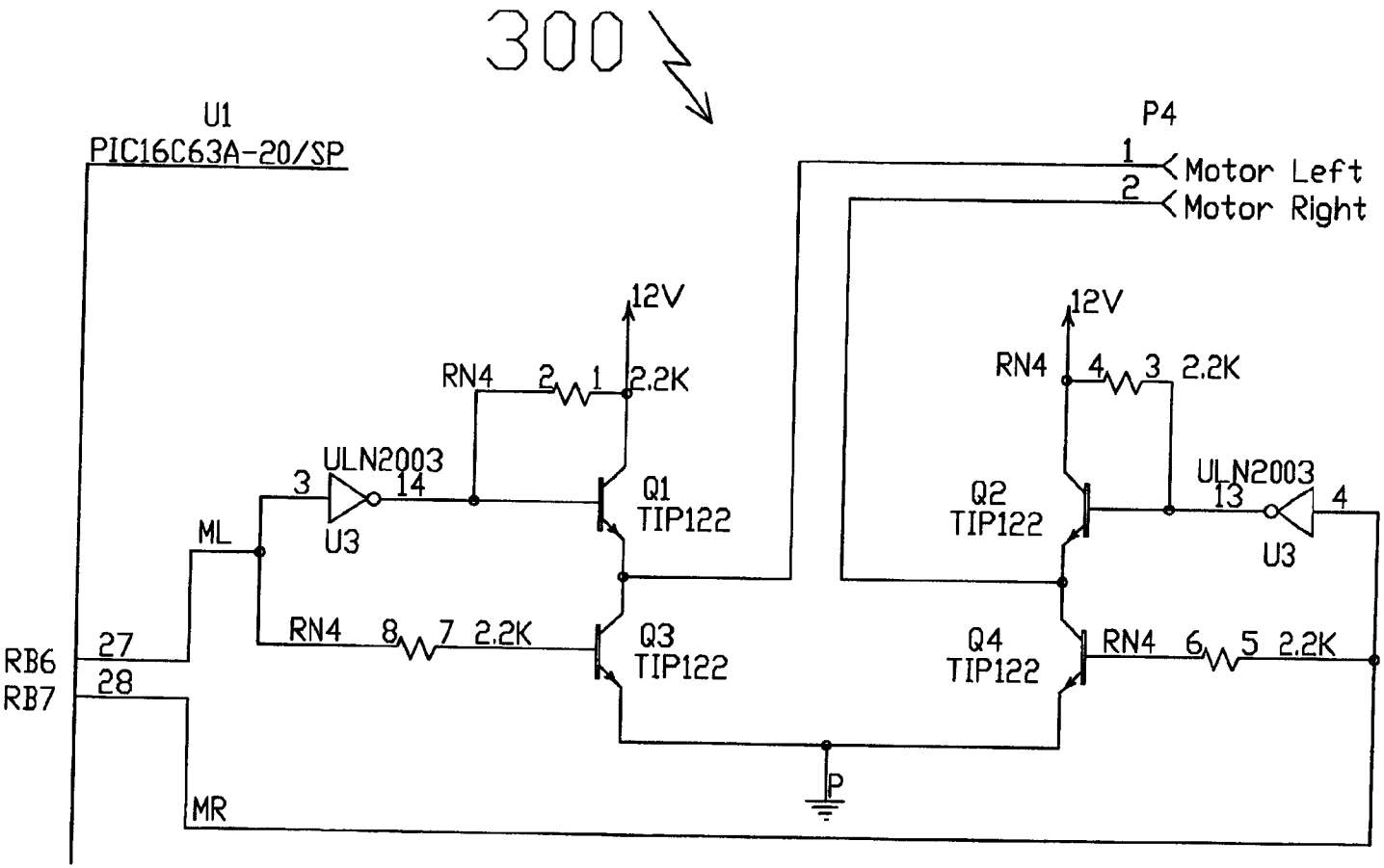

We now describe circuit sections 300 and 310 shown in FIGS. 50 and 48, respectively. The "return prizes/objects" command from the main processor causes the prize/object gate to move to the right. The scale processor U1 asserts the MR command, at pin 28, which turns on transistor Q4 and turns off transistor Q2. U1 also de-asserts the ML command, at pin 27, which turns on transistor Q1 and turns off transistor Q3 of the H-bridge. This provides positive voltage at pin 1 of connector P3 and ground at pin 2 of connector P3, thereby enabling the motor to move the prize/object gate to the right. The prize/object motor continues operation until the right limit switch input at pin 3 at connector P5 is activated. When the input switch is activated, the processor de-asserts the MR command. The ML command is asserted to drive transistor Q3 and turn off Q1, which enables the prize/object motor to move the prize/object gate to the left until the center "home" switch at pin 2 of connector P5 is activated. The ML command is de-asserted thereby stopping the prize/object gate motor at the center position.

The "dispense prize" command is similar in function to the "return prize" command; the ML command is asserted and MR de-asserted, which causes the prize/object motor to move the prize/object gate to the left until it activates the left limit switch at pin 1 of connector P5. ML is then de-asserted and MR asserted causing the prize/object gate to move to the right until the center "home" switch is activated and MR de-asserted.

Figure 49:
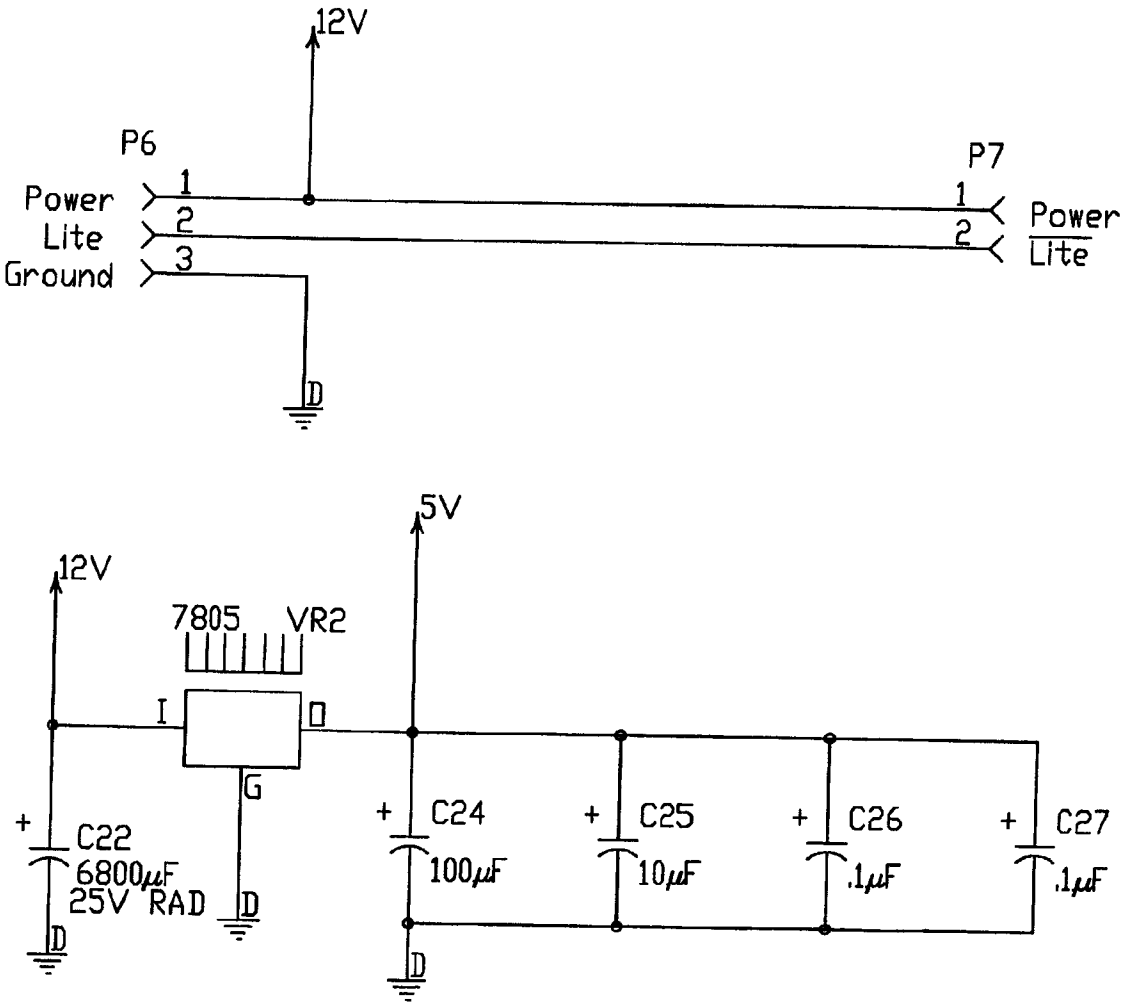
FIG. 49 is a schematic diagram illustrating the regulator and range light display connector; and, FIG. 50 is a schematic diagram illustrating the H-bridge motor control for the object/prize gate.

FIG. 49 is an illustration of the power supply circuit showing capacitors C22, C24, C25, C26, and C27, and VR2, which comprise the preferred embodiment of the present invention, as well as the connector P7 which turns on range light display 33.

Displays

Figure 43:
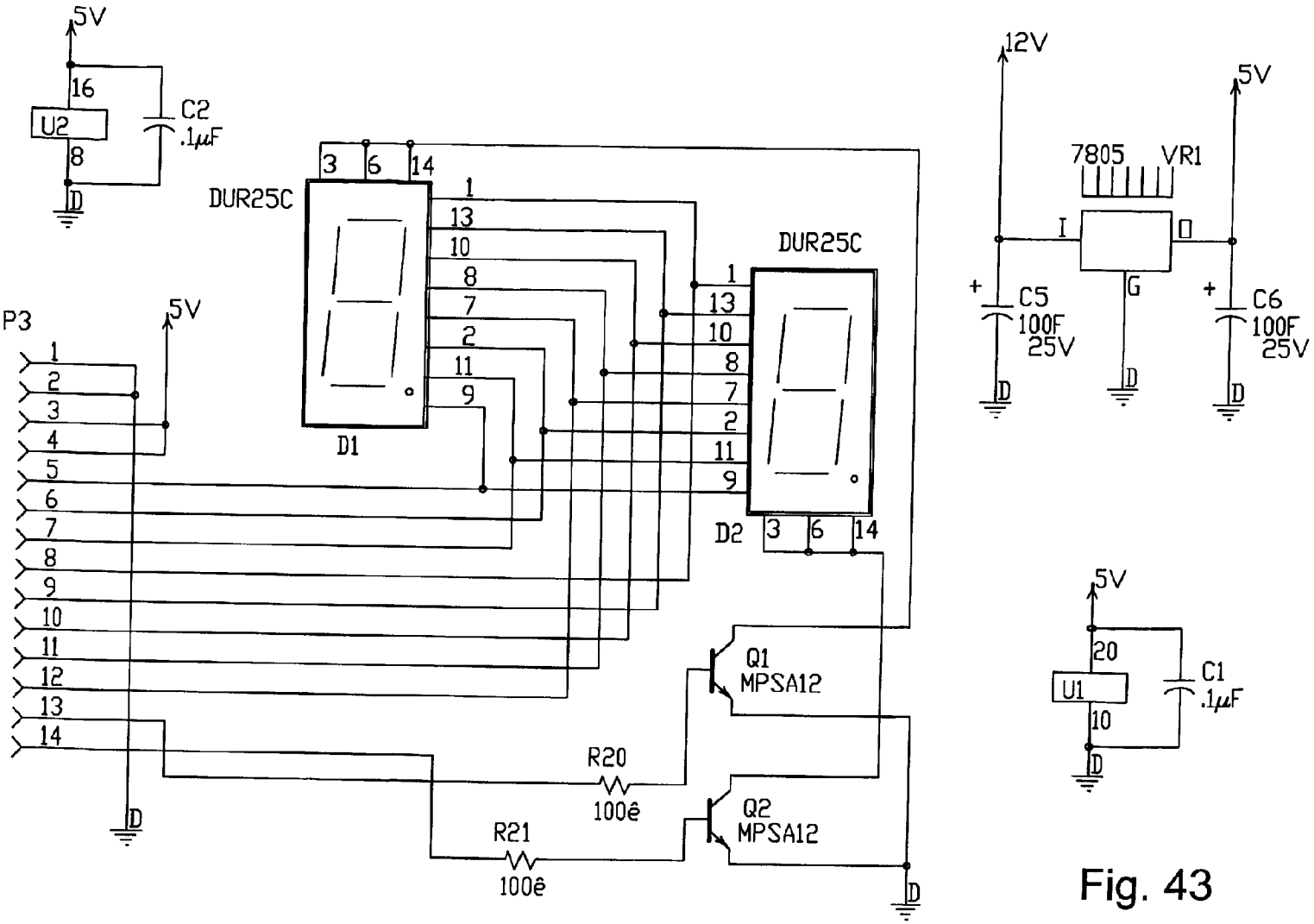
FIG. 43 is a schematic diagram illustrating the credits display and connection.
Figure 44:
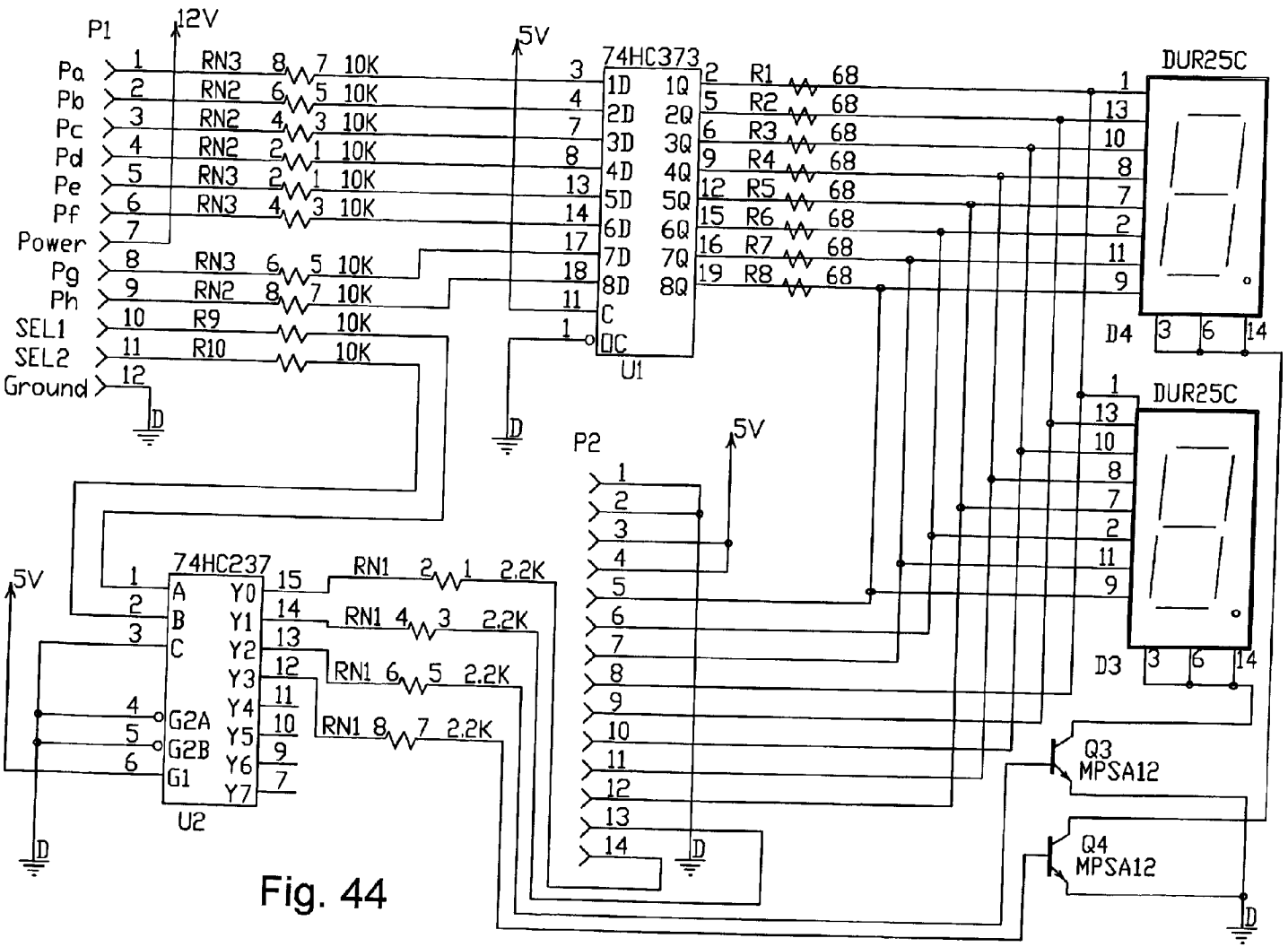
FIG. 44 is a schematic diagram illustrating the time display and connection.
Figure 45:
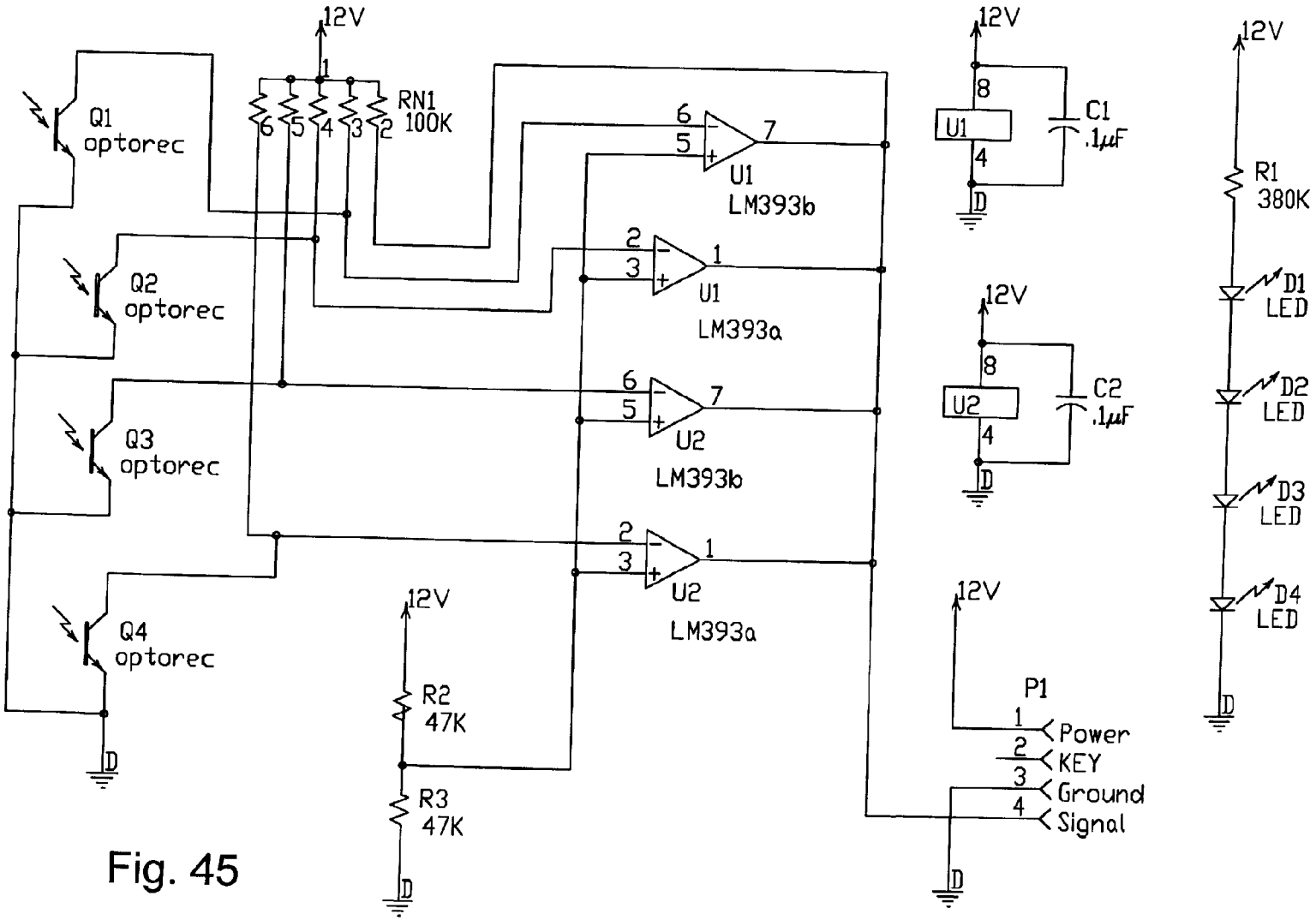
FIG. 45 is a schematic diagram illustrating the prize detector board.

In a preferred embodiment, the game includes two displays, both dual LED displays. One display is used to display credits, and the other is used to display time remaining in the game. In a preferred embodiment, the game is preprogrammed for a game time of 20 seconds, but this is of course programmable. The LED display drive circuits are shown in FIGS. 43 and 44. Operation of the drive circuit is well known in the art.

Driver Board

The game includes three motors: a front/rear motor, an up/down motor for the claw, and a left/right motor. There are, therefore, three controller daughter boards for controlling these motors. The controller circuits for the three translational (front/rear, left/right and up/down) motors are identical, and shown in FIGS. 41 and 42. The circuit includes three inputs MB1L, MB1R and MB1P. MB1P is the enable line, and the remaining two inputs are used to signal movement in a first (up, forward, left) or second (down, rear, right) direction. The drive circuit is a standard H bridge configuration. When the enable signal is low, transistors Q1 and Q2 are turned off, so the motor cannot be energized. When the enable signal is high, transistors Q1 and Q2 are enabled, so the motor can be energized. The polarity and direction of rotation of the motor is, of course, determined by the control signals MB1L and MB1R. With the enable signal high, a high signal at MB1L results in a high output signal from pin 11 of AND gate U4, thereby turning on Q1 to provide power to the motor at MB101. With the enable signal high, a high signal at MB1R results in a high output signal from pin 8 of AND gate U4, thereby turning on Q2 to provide power to the motor at MB102. The H bridge thus functions to provide power to, and, depending on the received input signals, change the polarity of the applied voltage to the motor, to change the direction of rotation.

Thus, it is seen that the objects of the present invention are efficiently obtained, although it should be readily apparent to those having ordinary skill in the art that changes and modifications can be made to the invention without departing from the spirit and scope of the invention as claimed. It should especially be appreciated that the subject game is programmable, both by the manufacturer and by the user. Hence, it should be appreciated that variations of the game may be made, used and sold, and yet be within the spirit and scope of the claims, since the programmability of the game inherently invites such variations. For example, it should be readily apparent that the predetermined weight range conditions under which a prize is "won" or "lost" is programmable. It should also be readily apparent that, although in a preferred embodiment, the criteria used for determination of a prize award is based on weight, the spirit and scope of the invention is intended to include other prize characteristics, such as, but not limited to, mass, shape, size, color, magnetic characteristics, and the like.

What is claimed is:

1. An amusement game, comprising:

a platform for presenting at least one prize/object;

means for securing and removing said at least one prize/object from said platform;

a device for determining at least weight of said at least one prize/object; and, means for awarding a prize.

2. The amusement recited in claim 1 wherein said device for determining at least weight is a scale.

3. The amusement game recited in claim 2 further comprising means for determining if said at least one prize/object is within a predetermined weight range.

4. The amusement game recited in claim 3 further comprising means for awarding said at least one prize/object when said at least one prize/object is within said predetermined weight range.

5. The amusement game as recited in claim 4 wherein said means for awarding said at least one prize/object when said at least one prize/object is within said predetermined weight range comprises at least a button, a prize/object gate, and a prize/object delivery chute.

6. The amusement game recited in claim 3 further comprising means for ending a game session when said at least one prize/object is not within said predetermined weight range.

7. The amusement game as recited in claim 3 further comprising means for returning said at least one prize/object to said platform when said at least one prize/object is not within said predetermined weight range.

8. The amusement game as recited in claim 7 wherein said means for returning said at least one prize/object to said platform comprises a prize/object gate and a prize/object return chute.

9. The amusement game as recited in claim 2 wherein said scale comprises means for indicating the weight of said prize/object visually.

10. The amusement game as recited in claim 2 wherein said scales comprises means for indicating the weight of said prize/object audibly.

11. The amusement game as recited in claim 1 wherein said means for securing and removing comprises a crane.

12. The amusement game as recited in claim 11 wherein said crane comprises a gantry assembly, a crane assembly and a claw assembly, all operatively arranged for movement.

13. The amusement game as recited in claim 12 wherein said gantry assembly is operatively arranged for translational movement.

14. The amusement game as recited in claim 12 wherein said gantry assembly is operatively arranged for translational movement along a first pair of parallel disposed rails.

15. The amusement game as recited in claim 12 wherein said gantry assembly comprises a second pair of parallel disposed rails.

16. The amusement game as recited in claim 12 wherein said crane assembly is operatively arranged for translational movement.

17. The amusement game as recited in claim 16 wherein said crane assembly is operatively arranged for translational movement along said second pair of parallel disposed rails.

18. The amusement game as recited in claim 11 wherein said claw assembly is operatively arranged for vertical movement.

19. The amusement game as recited in claim 1 wherein said means for securing and removing is controllable by a player via a control means.

20. The amusement game a recited in claim 19 wherein said control means comprise a joystick.

21. The amusement game as recited in claim 19 wherein said control means comprise a trackball.

22. The amusement game as recited in claim 19 wherein said control means comprise at least one push button.

23. The amusement game recited in claim 1, wherein said means for awarding a prize awards said prize when said weight of said prize/object satisfies certain predetermined criteria.

24. The amusement game recited in claim 23 wherein said prize/object is said prize.

25. A method of playing an amusement game comprising the steps of:

presenting at least one prize/object on a platform securing and removing said at least one prize/object from said platform;

weighing said at least one prize/object with a scale; and, awarding a prize when weight of said prize/object is within a predetermined range.

26. The method of playing an amusement game recited in claim 25 wherein said prize/object is said prize.

* * * * *